US007267933B2

(12) United States Patent
Oyamada et al.

(10) Patent No.: US 7,267,933 B2
(45) **Date of Patent: *Sep. 11, 2007**

(54) IMAGE FORMING METHOD USING PHOTOTHERMOGRAPHIC MATERIAL

(75) Inventors: Takayoshi Oyamada, Knagawa (JP); Senzo Sasaoka, Kanagawa (JP); Katsutoshi Yamane, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/448,280

(22) Filed: May 30, 2003

(65) Prior Publication Data

US 2004/0038156 A1 Feb. 26, 2004

(30) Foreign Application Priority Data

Jun. 3, 2002 (JP) ..... 2002-161615
Aug. 23, 2002 (JP) ..... 2002-243258
Sep. 20, 2002 (JP) ..... 2002-275552

(51) Int. Cl.
*G03C 5/16* (2006.01)
*G03C 1/498* (2006.01)

(52) U.S. Cl. ..... 430/350; 430/619; 430/620

(58) Field of Classification Search ..... 430/350, 430/620, 619, 631, 584, 517, 21
See application file for complete search history.

(56) References Cited

U.S. PATENT DOCUMENTS 4,395,484 A * 7/1983 McCarney ..... 430/620
4,968,599 A * 11/1990 Pitt et al. ..... 430/631
5,677,121 A * 10/1997 Tsuzuki ..... 430/619
5,698,380 A * 12/1997 Toya ..... 430/363
6,074,814 A * 6/2000 Deroover et al. ..... 430/619
6,413,711 B1 * 7/2002 Kimura ..... 430/619
6,468,720 B1 * 10/2002 Hirabayashi et al. ..... 430/350
6,514,678 B1 * 2/2003 Burgmaier et al. ..... 430/353
6,582,898 B2 6/2003 Morita
6,814,506 B2 * 11/2004 Nanami ..... 396/569
7,105,282 B2 * 9/2006 Yamane et al. ..... 430/350
2002/0068245 A1 6/2002 Yoshioka et al.

FOREIGN PATENT DOCUMENTS

JP 2000-086669 3/2000
JP 2001-066727 3/2001

* cited by examiner

*Primary Examiner*—Thorl Chea
(74) *Attorney, Agent, or Firm*—Margaret A. Burke; Sheldon J. Moss

(57) ABSTRACT

An image forming method using a photothermographic material including, on at least one surface of a support, at least a photosensitive silver halide, a non-photosensitive organic silver salt, a reducing agent for silver ions, and a binder, in which (1) the photothermographic material is exposed and thermally developed during transportation at a transportation speed of 23 mm/sec or faster, (2) the non-photosensitive organic silver salt contains 30 mol % to 85 mol % of silver behenate and an amount of the time until a leading end of the photothermographic material reaches a thermal development station after a power source for ae thermal developing apparatus is turned on is 15 minutes or less, or (3) a coating amount of silver inf the photothermographic material is 1.9 g/m$^2$ or less and a thermal development time is 12 sec or less.

7 Claims, 1 Drawing Sheet

IMAGE FORMING METHOD USING PHOTOTHERMOGRAPHIC MATERIAL

CROSS-REFERENCE TO RELATED APPLICATION

This application claims priority under 35USC 119 from Japanese Patent Application No.2002-161615, 2002-243258, and 2002-275552, the disclosure of which is incorporated by reference herein.

BACKGROUND OF THE INVENTION

1. Field of the Invention

The present invention concerns a image forming methods using a photothermographic material and, more specifically, it relates to a image forming methods at high line speed during exposure and thermal development, a image forming methods at rapid starting-up and a rapid image forming method with short developing time.

2. Description of the Related Art

In recent years, decrease for the amount of processing liquid wastes in the field of films for medical imagings and field of films for graphic arts has been keenly desired with a view point for environmental protection and space saving. Then, it has been required for techniques regarding photothermographic materials as films for medical imagings and films for graphic arts that can be exposed efficiently by laser image setters or laser imagers and can form clear black-toned images of high resolution and sharpness. According to the photothermographic materials described above, thermal development systems not requiring processing chemicals, simpler and not deteriorating environments can be supplied to customers.

While similar requirements exist also in the field of usual image forming materials, since fine expression is required particularly in images for medical imagings, high image quality of excellent sharpness and granularity are required, as well as images of blue-black tones are preferred with a view point of easy diagnosis. At present, various kinds of hard copy systems utilizing pigments and dyes such as ink jet printers and electrophotographs have been marketed as usual image forming systems at present, they are not satisfactory as output systems for medical images.

On the other hand, thermal image forming systems utilizing organic silver salts are described, for example, in U.S. Pat. Nos. 3,152,904 and 3,457,075, as well as in "Thermally Processed Silver systems" (Imaging Processes and Materials), Neblette, 8th edition, written by D. Klosterboer, edited by J. Sturge, V. Warlworth, and A. Shepp, Chapter 9, page 279 in 1989.

Particularly, the photothermographic material generally comprises a photosensitive layer in which a catalytically active amount of photocatalyst (for example, a silver halide), a reducing agent, a silver salt capable of being reduced (for example, an organic silver salt) and, optionally, a toner for controlling the tone of developed silver image dispersed in a matrix of a binder.

The photothermographic material, when heated at high temperature (for example, 80° C. or higher) after imagewise exposure, forms black-toned silver images by oxidation/reduction reaction between a silver salt capable of being reduced (functioning as an oxidizer) and a reducing agent. The oxidation/reduction reaction is promoted by a catalytic activity of latent images of silver halide formed by exposure. Accordingly, black-toned silver images are formed in an exposed region. The photothermographic material has been described in U.S. Pat. No. 2,910,377 and JP-B No. 43-4924, as well as in many other literatures.

Also in the photothermographic material described above, it is usually required to improve the performance for thermal development processing and shorten the processing time.

Systems using laser beams such as laser imagers can continuously output photosensitive materials and are required for stability to the continuous output but stable output is difficult at present. While the photothermographic material is thermally developed at a high temperature of 100° C. or higher by being in contact with a 2-dimensional plane heater as a heat source in an automatic thermal developing apparatus, when most of photothermographic materials are thermal developed continuously, particularly, when various sizes of materials are processed continuously, since there exists delicate temperature difference between a portion of the plane heater in contact with the photosensitive material and a portion not in contact with the photosensitive material just before, this causes a problem of bringing about developer streaks to the photosensitive material to be developed subsequently. This is conspicuous, for example, in a case of processing large sized photosensitive materials immediately after processing small sized photosensitive materials. The developer streaks due to slight uneven heating result in difference in the tone of one sheet of photosensitive material to lower the stability of outputted images.

In the photothermographic material, it has been demanded that various sizes of materials can be developed in a great amount efficiently and the problem is significant.

On the other hand, for improving the processing performance and shortening the processing time, it has been demanded to increase the transportation speed (line speed) during development.

However, when the line speed is increased, temperature control for a thermally developing plate cooled by a cold photosensitive material can not be in-time and, since the state of development is different between the top end and the rear end of the heat treatment in one sheet of photosensitive material. This results in bringing about developer streaks for the photosensitive material. Such fine developer streaks causes difference in the tone in one single photosensitive material like the problem during continuous output to lower the stability of the output images to result in a significant problem.

Further, in a case where it is intended to develop just after the turning-on of a power source in a developing apparatus, temperature at the developing station of the developing apparatus is not stabilized to often cause a problem of developer streaks in the output images. It takes a considerable time from the starting of the developing apparatus by the turning-on of the power source till reaching the development temperature condition capable of obtaining stable images (referred to as times for starting-up in the present application), it is another subject in the rapid processing to shorten the times for starting-up.

Further, since all the chemicals required for development are incorporated in the photothermographic material, there is a problem caused by them, particularly, a problem of lowering performance and quality due to non-photochemical reactions between chemicals necessary for the development processing and photosensitive or image forming materials.

Among all, the problem concerning the image stability after the development processing of the photothermographic material includes a problem of worsening image storability caused by rapid processing (increase of fog with lapse of time after thermal development, that is, increase in the minimum density (Dmin) that greatly deteriorates the image quality. Since the thermal development time is short, ingredients such as organic silver salts and reducing agents in the photosensitive material can not be reacted completely to remain in the photosensitive material after development, and those ingredients react gradually during storage of processed images with lapse of time to increase Dmin.

Accordingly, it has been demanded to improve the rapid development processability without worsening the photographic performance and the image storability after processing.

As described above, it is an extremely difficult problem to compatibilize the rapid development processing and solution for various problems described above.

SUMMARY OF THE INVENTION

The present invention intends to solve the above problems in the prior art and provide a image forming methods by a photothermographic material with less difference of tone and stable output images also in a thermal developing apparatus at a high line speed during thermal development.

(1) A first aspect of the present invention is to provide an image forming method using a photothermographic material containing, on at least one surface of a support, at least a photosensitive silver halide, a non-photosensitive organic silver salt, a reducing agent for silver ions and a binder, wherein a photothermographic material is exposed and thermally developed while being transported at a transportation speed of 23 mm/sec or more.

(2) A second aspect of the present invention is to provide an image forming method using a photothermographic material containing, on at least one surface of a support, at least a photosensitive silver halide, a non-photosensitive organic silver salt, a reducing agent for silver ions and a binder, in which the non-photosensitive organic silver salt contains 30 mol % to 85 mol % of a silver behenate, and a time till the top end of the photothermographic material reaches the thermal dvelopimg station after a power source of the thermal developing apparatus is turned on is 15 minuts or less.

from the turn-on of a power source for a thermal development machine to the arrival of the top end of the photothermographic material at the thermal development station is within 15 min.

(3) A third aspect of the present invention is to provide an image forming method using a photothermographic material containing, on at least one surface of a support, at least a photosensitive silver halide, a non-photosensitive organic silver salt, a reducing agent for silver ions and a binder, in which the coating amount of silver of the photothermographic material is 1.9 g/m$^2$ or less and the thermal developing time is 12 sec or less.

DETAILED DESCRIPTION OF THE INVENTION

Figure 1:
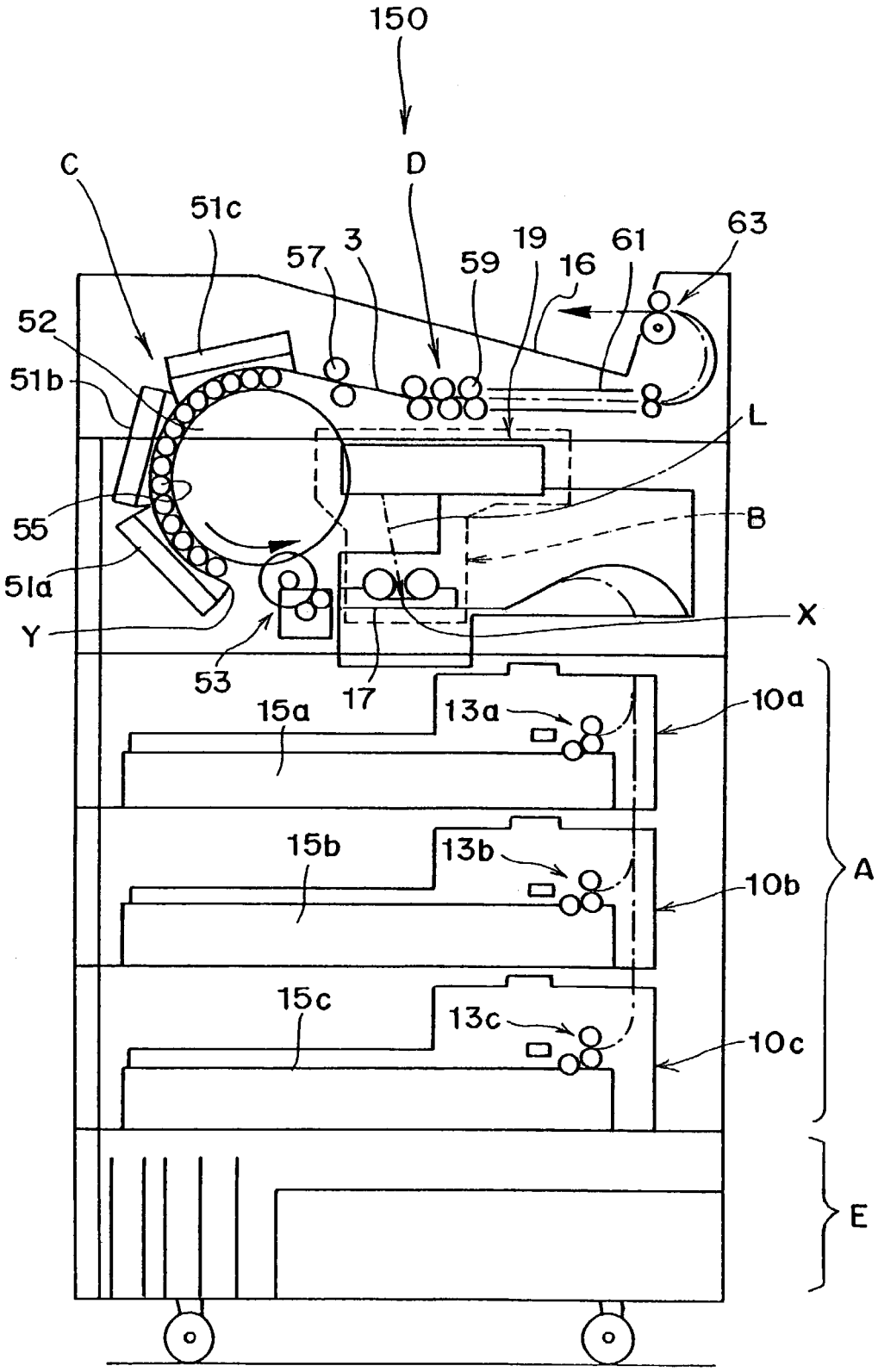
FIG. 1 is a schematic constitutional view of a thermal development recording apparatus mounted with a laser recording device according to the present invention.

The present invention is to be described in details.

1. Photosensitive Silver Halide

1) Halogen Composition

For the photosensitive silver halide used in the invention, there is no particular restriction on the halogen composition and silver chloride, silver bromochloride, silver bromide, silver bromoiodide, silver chlorobromoiodide and silver iodide can be used. Among them, silver bromide, silver bromoiodide and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, core/shell grain having a twoufold to fourfold structure can be used. Further, a technique of localizing silver bromide or silver iodide to the surface of a silver chloride, silver bromide or silver bromochloride grains can also be used preferably.

2) Method Of Grain Formation

The method of forming photosensitive silver halide is well-known in the relevant art and, for example, a method described in Research Disclosure No. 17029, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in column Nos. 0217 to 0224 in JP-A No. 11-119374 and a method described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably, 0.01 μm or more and 0.15 μm or less and, further preferably, 0.02 μm or more and 0.12 μm or less. The grain size as used herein means an average diameter of a circle converted such that it has a same area as a projection area of the silver halide grain (projection area of a main plane in a case of a tabular grain).

4) Grain Shape

The shape of the silver halide grain can include, for example, cuboidal, octahedral, plate-like, spherical, rod-like or potato-like shape. The cuboidal grain is particularly preferred in the invention. A silver halide grain rounded at corners can also be used preferably. While there is no particular restriction on the index of plane (Mirror's index) of an crystal surface of the photosensitive silver halide grain, it is preferred that the ratio of [100] face is higher, in which the spectral sensitizing efficiency is higher in a case of adsorption of a spectral sensitizing dye. The ratio is preferably 50% or more, more preferably, 65% or more and, further preferably, 80% or more. The ratio of the Mirror's index [100] face can be determined by the method of utilizing the adsorption dependency of [111] face and [100] face upon adsorption of a sensitizing dye described by T. Tani; in J. Imaging Sci., 29, 165 (1985).

5) Heavy Metal

In the present invention, a silver halide grain having a hexacyano metal complex is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily misible with water and suitable to precipitation operation of a silver halide emulsion are used preferably.

The hexacyano metal complex can be added while being mixed with water, as well as a mixed solvent of water and an appropriate organic solvent miscible with water (for example, alcohols, ethers, glycols, ketones, esters and amides) or gelatin.

The amount of the hexacyano metal complex to be added is preferably form $1\times10^{-5}$ mol to $1\times10^{-2}$ mol and, more preferably, form $1\times10^{-4}$ mol to $1\times10^{-3}$ mol per one mol of silver in each case.

In order to allow the hexacyano metal complex to be present on the outermost surface of a silver halide grain, The heacyano metal complex is directly added in any stage of: after completion of addition of an aqueous solution of silver nitrate used for grain formation, before completion of emulsion forming step prior to a chemical sensitization step, of conducting chalcogen sensitization such as sulfur sensitization, selenium sensitization and tellurium sensitization or noble metal sensitization such as gold sensitization, during washing step, during dispersion step and before chemical sensitization step. In order not to grow the fine silver halide grain, the hexacyano metal complex is rapidly added preferably after the grain is formed, and it is preferably added before completion of the emulsion forming step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of these hexacyano metal complex is added after addition of an aqueous silver nitrate just before completion of grain formation, it can be adsorbed to the outermost surface of the silver halide grain and most of them forms an insoluble salt with silver ions on the surface of the grain. Since the hexacyano iron (II) silver salt is a less soluble salt than AgI, re-dissolution with fine grain can be prevented and fine silver halide grain with smaller grain size can be prepared.

The photosensitive silver halide grain of the invention can contain metals or complexes of metals belonging to groups 8 to 10 of the periodical table (showing groups 1 to 18). The metal or the center metal of the metal complex in the groups 8 to 10 of the periodical table is preferably rhodium, ruthenium or iridium. The metal complex may be used alone, or two or more kinds of complexes comprising identical or different species of metals may be used together. A preferred content is within a range from $1\times10^{-9}$ mol to $1\times10^{-3}$ mol per one mol of silver. The heavy metals, metal complexes and the addition method thereof are described in JP-A No. 7-225449, JP-A 11-65021 (paragraph Nos. 0018-0024) and JP-A No. 11-119374 (paragraph Nos. 0227-0240).

Metal atoms that can be contained in the silver halide grain used in the invention (for example, $[Fe(CN)_6]^{4-}$), desalting method of a silver halide emulsion and chemical sensitization method are described in JP-A 11-84584 (paragraph Nos. 0046-0050), JP-A 11-65021 (paragraph Nos. 0025-0031), and JP-A 11-119374 (paragraph Nos. 0242-0250).

6) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is used preferably. Further, it is also preferred to apply phthalization treatment to substituents of gelatin. The gelatin may be used upon grain formation stage or upon the time of dispersion after desalting treatment and it is preferably used during grain formation.

7) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously. The sensitizing dyes and the addition method are disclosed, for example, JP-A No. 11-65021 (paragraph Nos. 0103 to 0109), as a compound represented by the general formula (II) in JP-A No. 10-186572, dyes represented by the general formula (I) JP-A No. 11-119374 (paragraph No. 0106), dyes described in U.S. Pat. Nos. 5,510,236 and 3,871,887 (Example 5), dyes disclosed in JP-A No. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or two or more of them may be used in combination. The sensitizing dye is added into the silver halide emulsion preferably within a period after desalting step to coating step and, more preferably, in a period after desalting to the completion of chemical ripening.

The spectral sensitizing dye used preferably in the photothermographic material of the invention is at least one spectral sensitizing dye selected from the following general formulae (2a) to (2d).

Details for the spectral sensitizing dyes represented by general formulae (2a) to (2d) is described specifically (hereinafter also referred to as infrared sensitizing dye).

General Formula (2a)

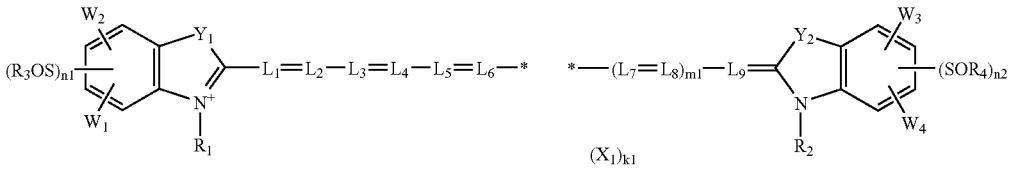

General Formula (2b)

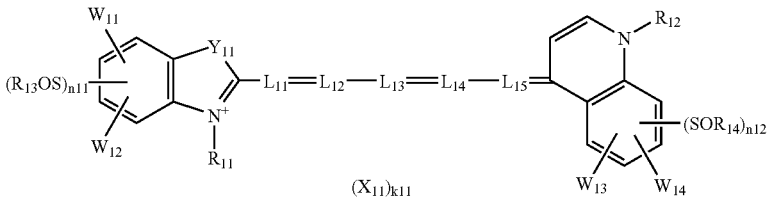

-continued

General Formula (2c)

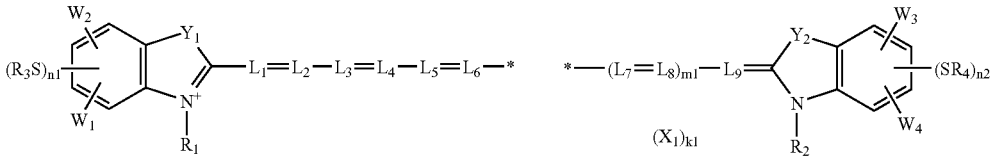

General Formula (2d)

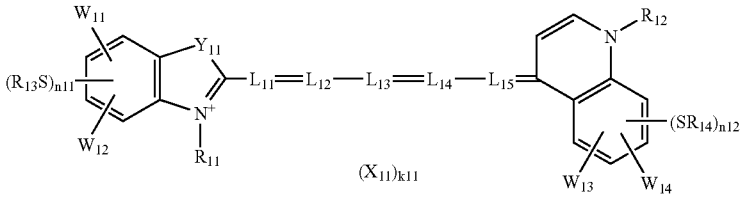

In the general formulae (2a) to (2d), the aliphatic group represented by each of $R_1$, $R_2$, $R_{11}$ and $R_{12}$ includes, for example, linear or branched alkyl group having 1 to 10 carbon atoms (for example, methyl group, ethyl group, propyl group, butyl group, pentyl group, iso-pentyl group, 2-ethyl-hexyl group, octyl group, and decyl group), an alkenyl group having 3 to 10 carbon atoms (for example, 2-propenyl group, 3-butenyl group, 1-methyl-3-propenyl group, 3-pentenyl group, 1-methyl-3-butenyl group, and 4-hexenyl group), and aralkyl group having 7 to 10 carbon atoms (for example, benzyl group and phenethyl group).

The groups described above may further be substituted with a group such as a lower alkyl group (for example, methyl group, ethyl group, and propyl group), a halogen atom (for example, fluorine atom, chlorine atom, and bromine atom), vinyl group, aryl group (for example, phenyl group, p-tolyl group, and p-bromophenyl group), trifluoromethyl group, alkoxy group (for example, methoxy group, ethoxy group, and methoxyethoxy group), aryloxy group (for example, phenoxy group, and p-tolyloxy group), cyano group, sulfonyl group (for example, methane sulfonyl group, trifluoromethane sulfonyl group, and p-toluene sulfonyl group), alkoxycarbonyl group (for example, ethoxycarbonyl group and butoxycarbonyl group), amino group (for example, amino group and biscarboxymethyl amino group), aryl group (for example, phenyl group, and carboxyphenyl group), heterocyclic group (for example, tetrahydrofurfryl, 2-pyrrolidinone-1-yl group), acyl group (for example, acetyl group and benzoyl group), ureido group (for example, ureido group, 3-methylureido group, and 3-phenylureido group), thioureido group (for example, thioureido group, 3-methylthioureido group), alkylthio group (for example, methylthio, ethylthio group), arylthio group (for example, phenylthio group), heterocyclic thio group (for example, 2-thienylthio group, 3-thienylthio, 2-imidazolylthio group), carbonyloxy group (for example, acetyloxy group, propanoyloxy group, and benzoyloxy group), acylamino group (for example, acetylamino, benzoylamino group), thioamide group (for example, thioacetoamide group, thiobenzoylamino group), or a group, for example, sulfo group, carboxy group, phosphono group, sulfate group, hydroxy group, mercapto group, sulfino group, carbamoyl group (for example, carbamoyl group, N-methylcarbamoyl group, and N,N-tetramethylenecarbamouyl group), sulfamoyl group (for example, sulfamoyl group, and N,N-3-oxapentamethylene aminosulfonyl group), sulfoneamide group (for example, methane sulfoneamide and butane sulfoneamide group), sulfonylamino group (for example, methane sulfonylaminocarbonyl, ethane sulfonylamino carbonyl group), acylaminosulfonyl group (for example, acetoamide sulfonyl, and methoxyacetoamide sulfonyl group), acylaminocarbonyl group (for example, acetoamide carbonyl, and methoxyacetoamide carbonyl group), sulfinyl aminocarbonyl group (for example, methane sulfinylamino carbonyl, ethane sulfinylamino carbonyl group).

Specific examples for the aliphatic group substituting for the group described above can include, each of the groups, for example, carboxymethyl, carboxyethyl, carboxybutyl, carboxypentyl, 3-sulfate butyl, 3-sulfopropyl, 2-hydroxy-3-sulfopropyl group, 4-sulfobutyl, 5-sulfopentyl, 3-sulfopenthyl, 3-sulfinobutyl, 3-phosphonopropyl, hydroxyethyl, N-methanesulfonyl carbamoylmethyl, 2-carboxy-2-propenyl, o-sulfobenzyl, p-sulfophenethyl and p-carboxybenzyl.

The lower alkyl group represented by each of $R_3$, $R_4$ and $R_{13}$ and $R_{14}$ is, for example, a linear or branched alkyl group of 5 or less carbon atoms, specifically, methyl group, ethyl group, propyl group, butyl group, pentyl group and isopropyl group. The cycloalkyl group can include, for example, cyclopropyl group, cyclobutyl group and cyclopentyl group. The alkenyl group can include, for example, 2-propenyl group, 3-butenyl group, 1-methyl-3-propenyl group, 3-pentenyl group, 1-methyl-3-butenyl group and 4-hexenyl group, the aralkyl group can include, for example, benzyl group, phenethyl group, p-methoxyphenylmethyl group, and o-acetylaminophenylethyl group, the aryl group includes substituted and not-substituted groups, for example, those groups such as phenyl group, 2-naphthyl group, 1-naphthyl group, o-tolyl group, o-methoxyphenyl group, m-chlorophenyl group, m-bromophenyl group, p-tolyl group or p-ethoxyphenyl group, the heterocyclic group includes substituted and not-substituted groups, for example, 2-furyl group, 5-methyl-2-furyl group, 2-thienyl group, 3-thienyl group, 2-imidazolyl group, 2-methyl-1-imidazolyl group, 4-phenyl-2-thiazolyl group, 5-hydroxy-2-benzothiazolyl group, 2-pyridyl group, and 1-pyrrolyl group.

Each of the groups described above may be substituted with a group, for example, lower alkyl group (for example, methyl group, ethyl group), lower alkoxy group (for example, methoxy group, and ethoxy group), hydroxy group, halogen atom (for example, fluorine atom, chlorine atom, bromine atom or iodine atom), aryl group (for example, phenyl group, tolyl group or chlorophenyl group), mercapto group, and lower alkylthio group (for example, methylthio group, ethylthio group).

The substituent represented by each of $W_1$ to $W_4$, and $W_{11}$ to $W_{14}$ can include, specifically, alkyl group (for example, methyl group, ethyl group, butyl group, and isobutyl group), aryl group (including monocyclic or polycyclic groups, for example, phenyl group, or naphthyl group), heterocyclic group (for example, thienyl, furyl, pyridyl, carbazolyl, pyrrolyl or indolyl group), halogen atom (for example, fluorine atom, chlorine atom, bromine atom), vinyl group, aryl group (for example, phenyl group, p-tolyl group, or p-bromophenyl group), trifluoromethyl group, alkoxy group (for example, methoxy group, ethoxy group, or methoxyethoxy group), aryloxy group (for example, phenoxy group or p-tolyloxy group), sulfonyl group (for example, methane sulfonyl group, or p-toluene sulfonyl group), alkoxycarbonyl group (for example, ethoxycarbonyl group, or butoxycarbonyl group), amino group (for example, amino group, or biscarboxymethylamino group), aryl group (for example, phenyl group or carboxyphenyl group), heterocyclic group (for example, tetrahydrofurfuryl group or 2-pyrrolidinone-1-yl group), acyl group (for example, acetyl group, benzoyl group), ureido group (for example, ureido group, 3-methylureido group, or 3-phenylureido group), thioureido group (for example, thioureido group or 3-methylthioureido group), alkylthio group (for example, methylthio group or ethylthio group), arylthio group (for example, phenylthio group), hydroxy group, and styryl group.

The groups described above can be substituted with the groups mentioned in the description for the aliphatic groups shown by $R_1$ and the like and specific examples of substituted alkyl groups can include, for example, each group of 2-methoxyethyl, 2-hydroxyethyl, 3-ethoxycarbonylpropyl, 2-carbamoylethyl, 2-methane sulfonylethyl, 3-methane sulfonylaminopropyl, benzyl, phenethyl, carboxymethyl, carboxyethyl, allyl or 2-furylethyl; specific examples of the substituent aryl group can include, for example, p-carboxyphenyl, p-N,N-dimethylaminophenyl, p-morpholinophenyl, p-methoxyphenyl, 3,4-dimethoxyphenyl, 3,4-methylenedioxyphenyl, 3-chlorophenyl, and p-nitrophenyl group; specific examples of the substituted heterocyclic groups can include, for example, each of the groups of 5-chloro-2-pyridyl, 5-ethoxycarbamoyl-2-pyridyl or 5-carbamoyl-2-pyridyl.

Condensed rings that can be formed by connecting each pair of $W_1$ and $W_2$, $W_3$ and $W_4$, $W_{11}$ and $W_{12}$, $W_{13}$ and $W_{14}$, $R_3$ and $W_1$, $R_3$ and $W_2$, $R_{13}$ and $W_{11}$, $R_{13}$ and W12, $R_4$ and $W_3$, $R_4$ and $W_4$, $R_{14}$ and $W_{13}$, and $R_{14}$ and $W_{14}$ can include, for example, saturated or unsaturated 5-membered or 6-membered condensed carbon rings. Substitution can be made at any position on the condensed rings and the group for substitution can include those groups described as the groups capable of substituting the aliphatic group.

In general formulae (2a) to (2d), the methine group shown by $L_1$ to $L_{11}$, $L_{11}$ to $L_{15}$ each represents, independently, a substituted or not substituted methine group. Specific examples of the group for substitution can include, substituted or not substituted lower alkyl group (for example, methyl group, ethyl group, iso-propyl group or benzyl group), alkoxy group (for example, methoxy group, or ethoxy group), aryloxy group (for example, phenoxy group or naphthoxy group), aryl group (for example, phenyl group, naphthyl group, p-tolyl group, or o-carboxyphenyl group), —N($V_1$, $V_2$), —SR or heterocyclic group (for example, 2-thienyl group, 2-furyl group, or N,N'-bis(methoxyethyl) barbituric acid group). R represents the lower alkyl group, aryl group or heterocyclic group described above, each of $V_1$ and $V_2$ represents substituted or not-substituted lower alkyl group or aryl group and $V_1$ and $V_2$ can be connected to each other to form a 5-membered or 6-membered nitrogen containing hetero ring. Further, the methine groups can be connected between adjacent methine groups to each other or between every other methine groups to each other to form a 5-membered or 6-membered ring.

In each of the compounds represented by the general formulae (2a) to (2d), when it is substituted with a group having cationic or anionic charge, a pair ion is formed with an equivalent amount of anion or cation so as to neutralize the charge in the molecule. For example, with the ion necessary for neutralizing the charge in the molecule represented by each of $X_1$ and $X_{11}$, specific example of cation can include, for example, proton, organic ammonium ion (each ion, for example, of triethyl ammonium or triethanol ammonium), inorganic cation (each cation, for example, of lithium, sodium, or potassium), and specific example of acid anion can include, for example, halogen ion (for example, chlorine ion, bromine ion or iodine ion), p-toluene sulfonate ion, perchlorate ion, tetrafluoro boron ion, sulfate ion, methyl sulfate ion, ethyl sulfate ion, methane sulfonate ion, or trifluoromethane sulfonate ion.

Specific examples of the photosensitive dye represented by general formulae (2a) to (2d) are shown but the invention is not restricted to such compounds.

No. 1

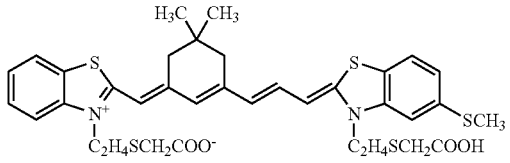

No. 2

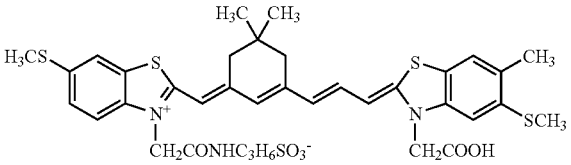

No. 3

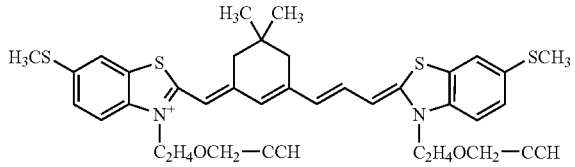

No. 4

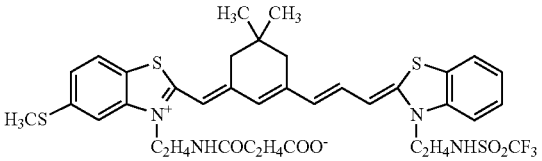

-continued
No. 5
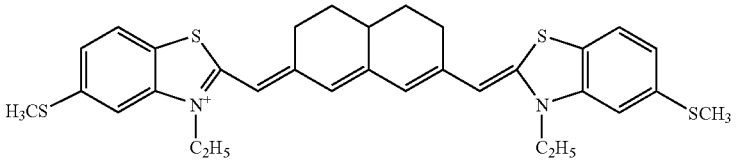
p-Ts⁻
No. 6
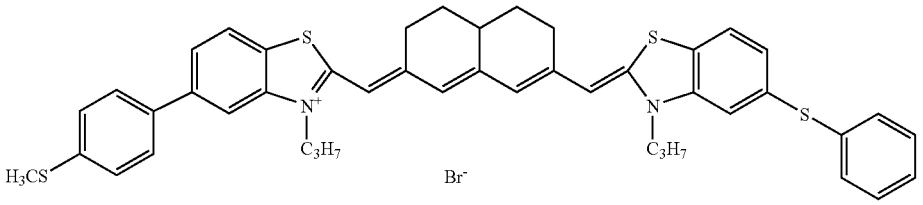
No. 7
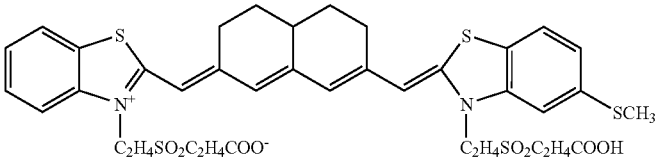
No. 8
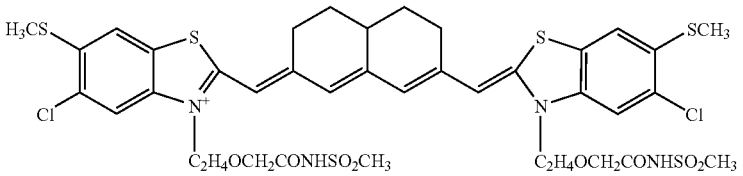
p-Ts⁻
No. 9
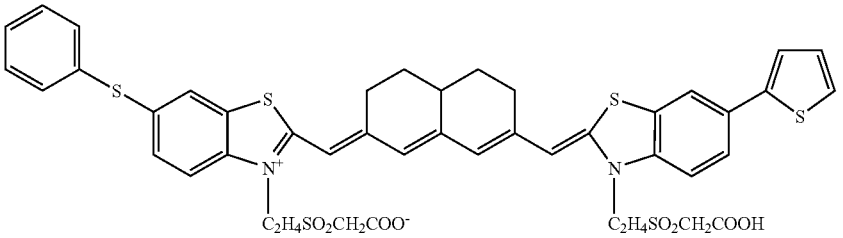
No. 10
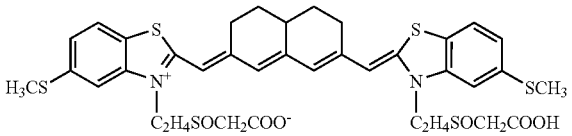
No. 11
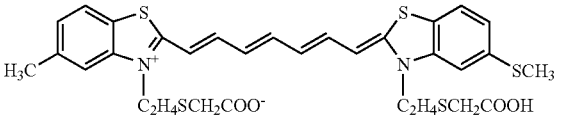
No. 12
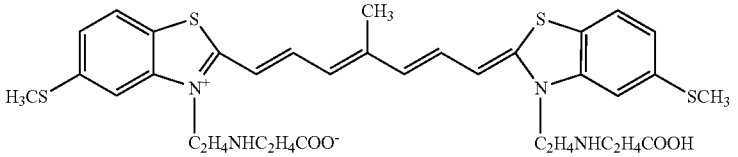

-continued
No. 13
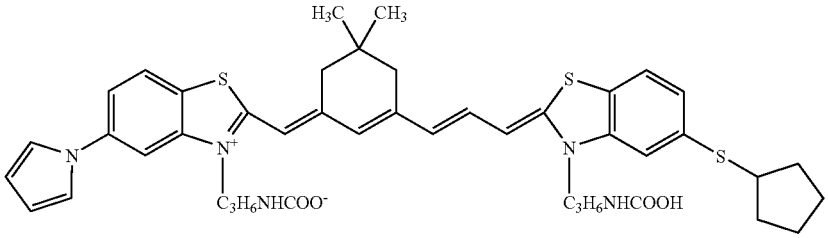
No. 14
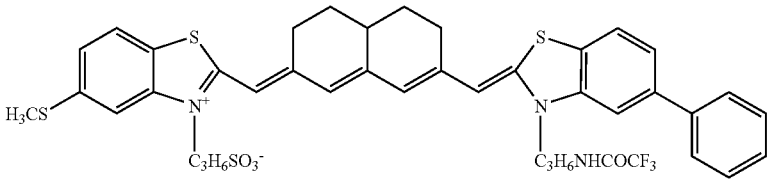
No. 15
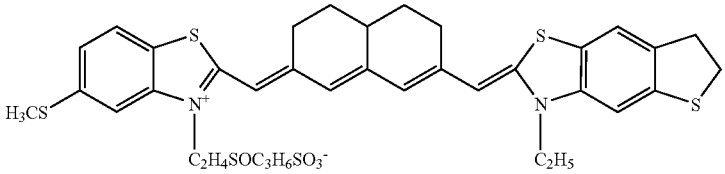
No. 16
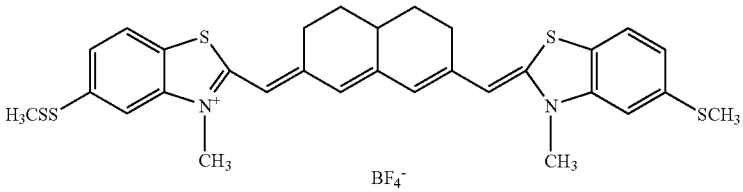
No. 17
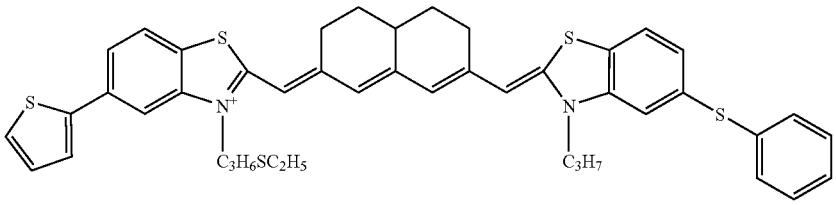
No. 18
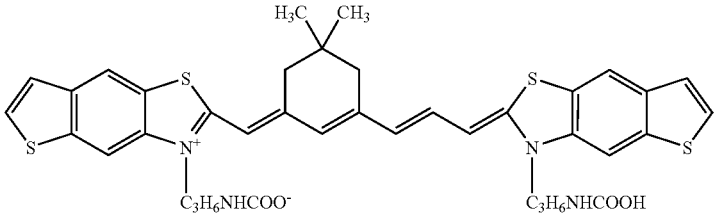
No. 19
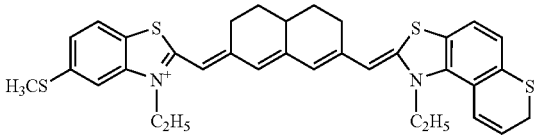
No. 20
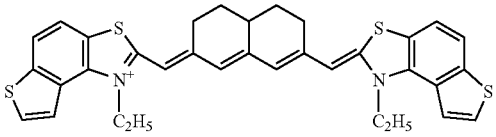

-continued
No. 21
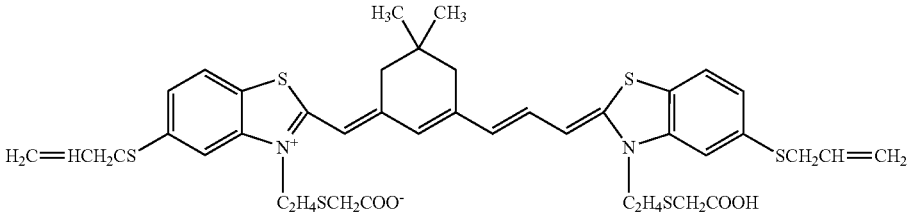
No. 22
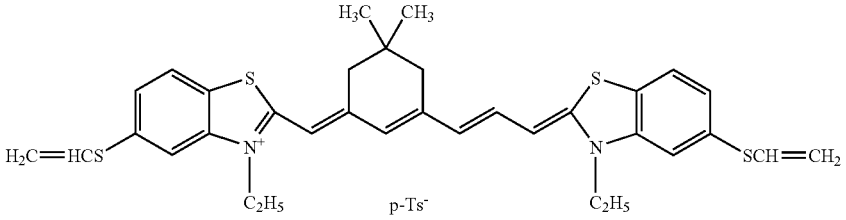
No. 23
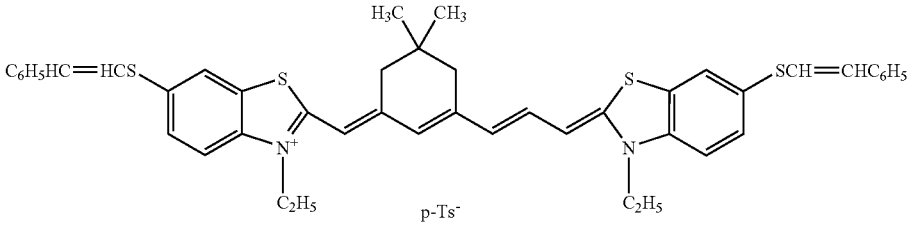
No. 24
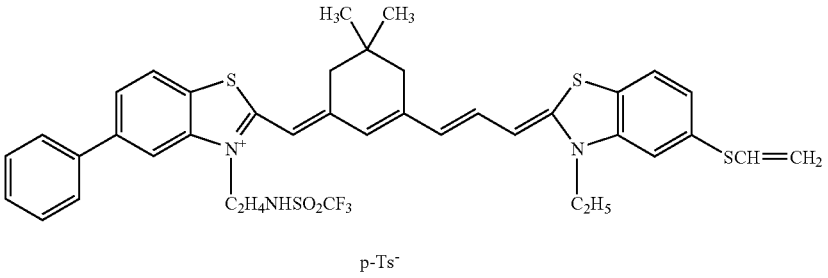
No. 25
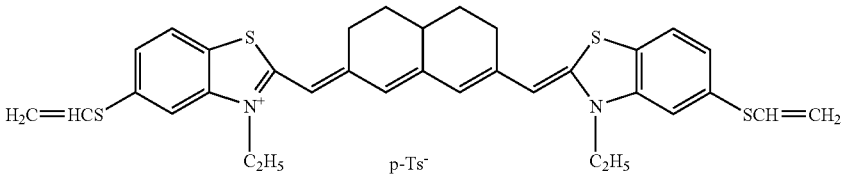
No. 26
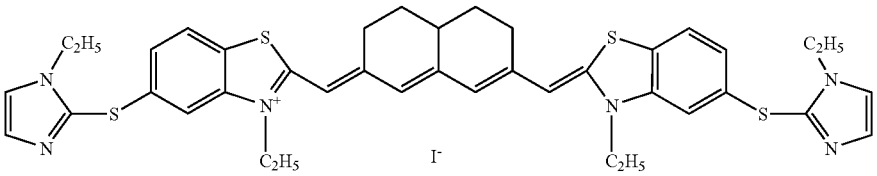
No. 27
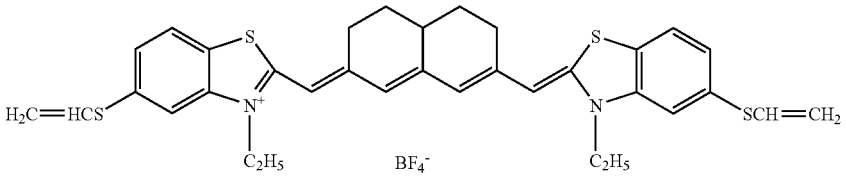

-continued
No. 28
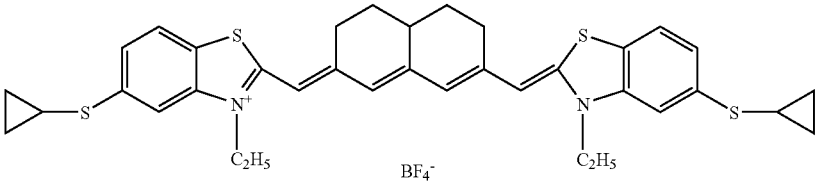
No. 29
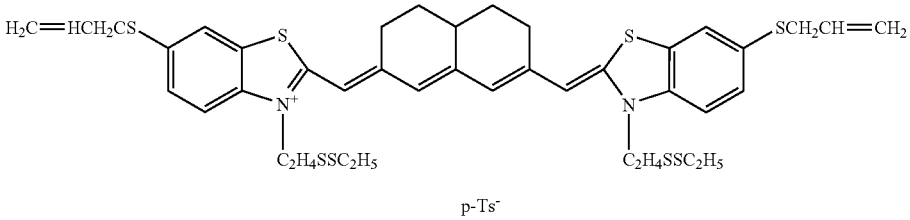
No. 30
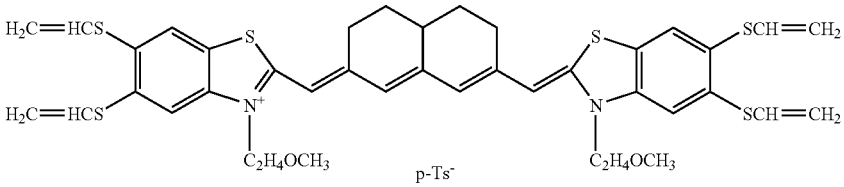
No. 31
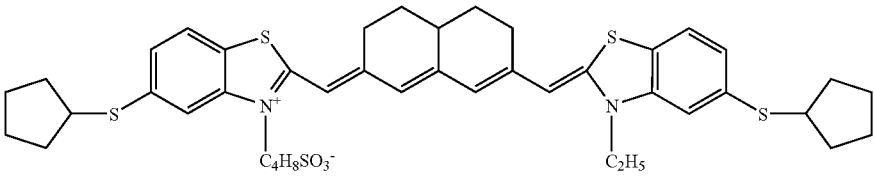
No. 32
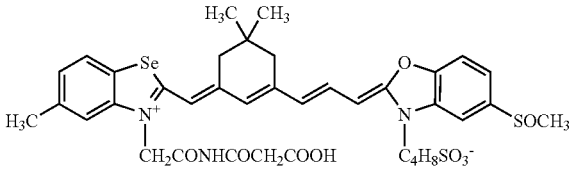
No. 33
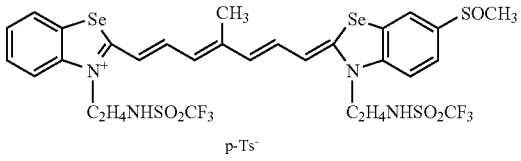
No. 34
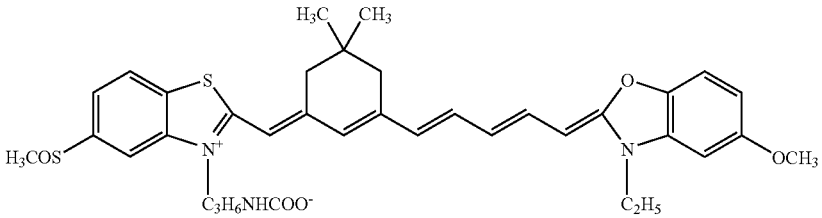
No. 35
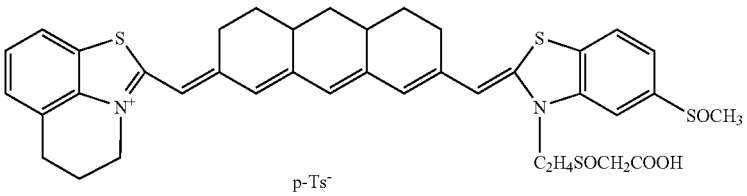

-continued
No. 36
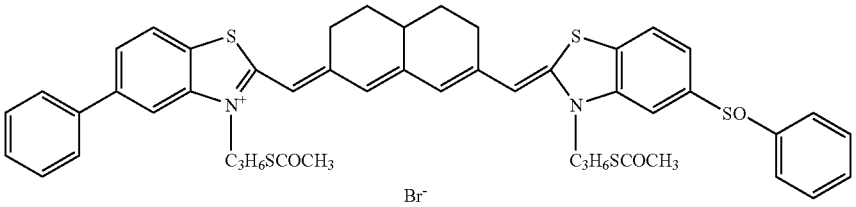
No. 37
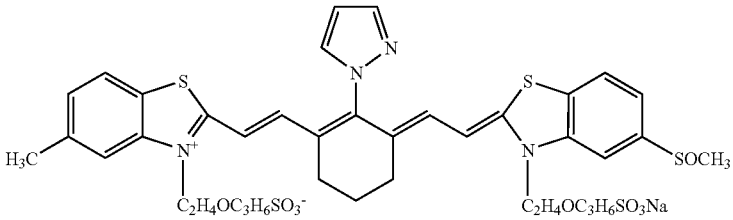
No. 38
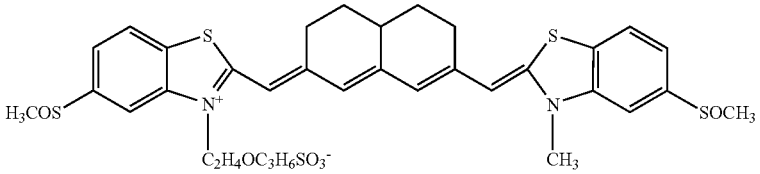
No. 39
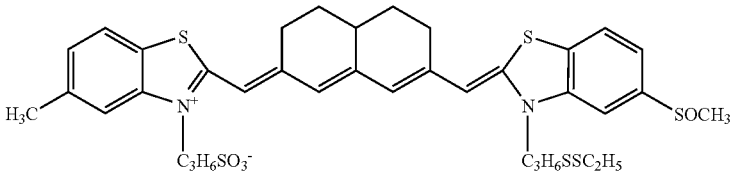
No. 40
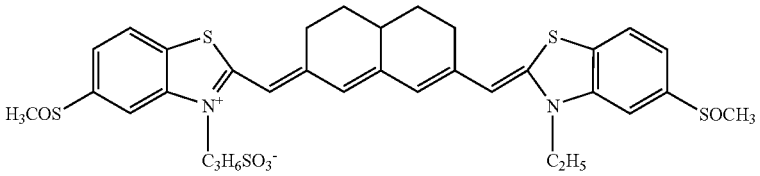
No. 41
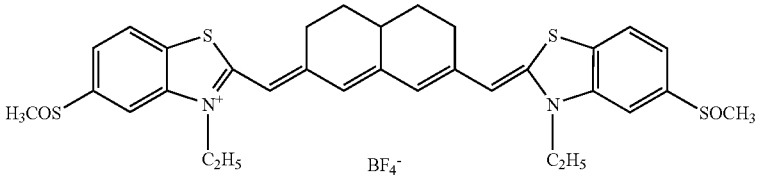
No. 42
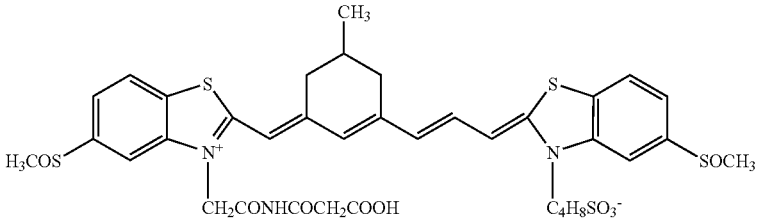
No. 43
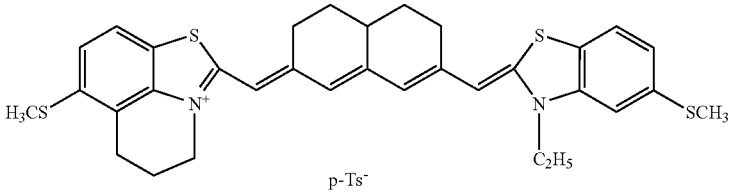

-continued
No. 44
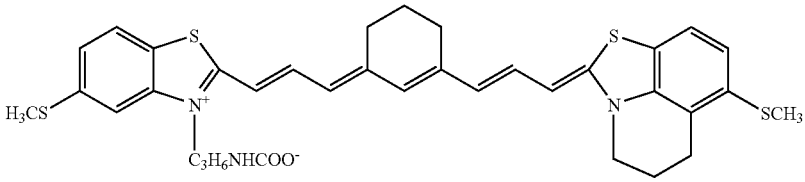
No. 45
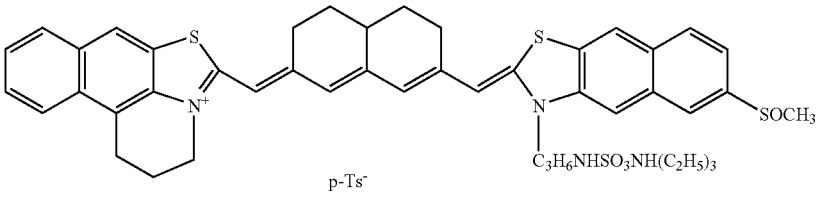
No. 46
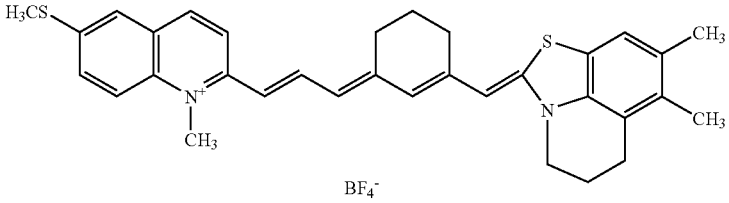
No. 47
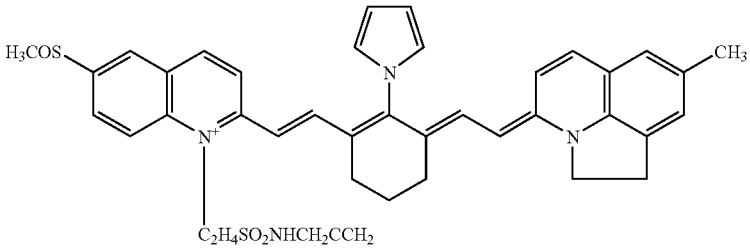
No. 48
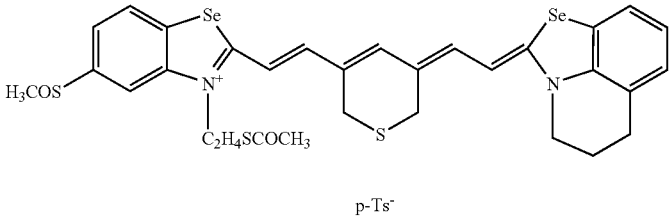
No. 49
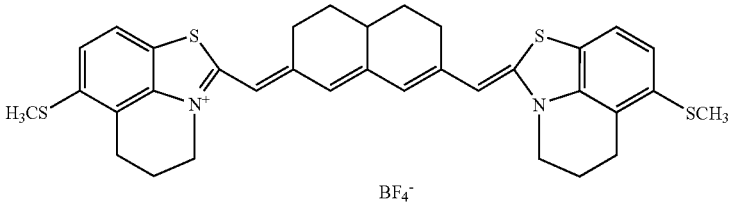
No. 50
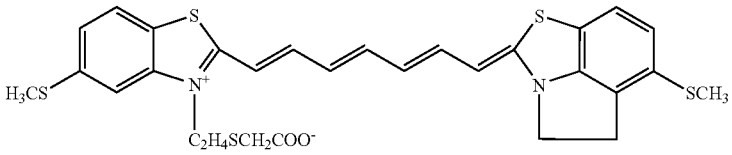

-continued

No. 51

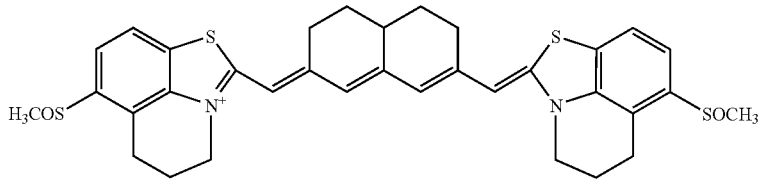

$Br^-$

No. 52

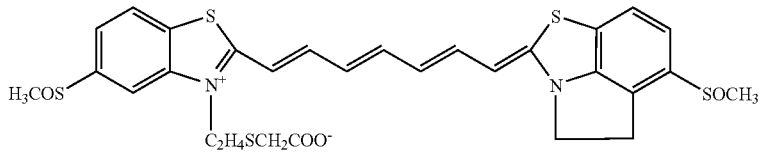

No. 53

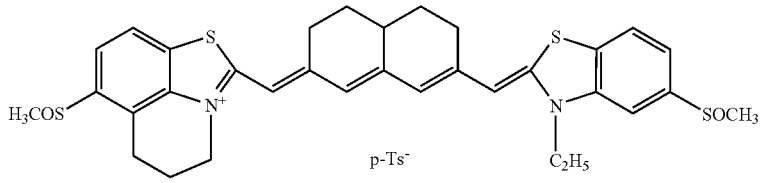

$p\text{-}Ts^-$

The infrared sensitizing dyes represented by general formulae (2a) to (2d) used in the invention can be synthesized, for example, by the methods described in "The Chemistry of Heterocyclic Compounds" by F. M. Harmer, vol. 18, "The Cyanide Dyes and Related Compounds (edited by A. Weissberger, issued from Interscience Co., New York, 1964), JP-A Nos. 3-138638 and 10-73900, JP-W No. 9-510022, specifications of U.S. Pat. No. 2,734,900 and BP No. 774779, specifications of Japanese Patent Application Nos. 10-269843 and 11-58686.

In the invention, the infrared sensitizing dyes represented by the general formulae (2a) to (2d) may be used alone but two or more kinds of the infrared sensitizing dyes may be used in combination. When the infrared sensitizing dyes are used alone or in combination, they are contained in a silver halide emulsion at a ratio of $1\times10^{-6}$ mol to $5\times10^{-3}$ mol, preferably, $1\times10^{-5}$ mol to $2.5\times10^{-3}$ mol, further preferably, $4\times10^{-5}$ mol to $1\times10^{-3}$ mol in total per one mol of the silver halide. In a case where two or more kinds of the infrared sensitizing dyes are used in combination in the invention, the infrared sensitizing dyes can be incorporated at any ratio in the silver halide emulsion.

The photothermographic material of the invention may also contain, together with the sensitizing dye, those dyes having no spectral sensitizing effect by themselves, or those substances not substantially absorbing visible light but showing super sensitizing effect.

The super sensitizers usable in the invention can include those compounds described in Research Disclosure, vol. 176, 17643 (issued, December 1978), page 23, para. IV-J, or JP-B Nos. 49-25500 and 43-4933, JP-A Nos. 59-19032 and 59-192242, EP-A No. 587,338, U.S. Pat. Nos. 3,877,943 and 4,873,184 and JP-A Nos. 5-341432, 11-109547, and 10-111543.

8) Chemical Sensitization

The photosensitive silver halide grain in the invention is preferably chemically sensitized by sulfur sensitization method, selenium sensitization method or tellurium sensitization method. As the compound used preferably for sulfur sensitization method, selenium sensitization method and tellurium sensitization method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by the general formulae (II), (III), and (IV) in JP-A No. 5-313284 are more preferred.

The photosensitive silver halide grain in the invention is preferably chemically sensitized by gold sensitization method alone or in combination with the chalcogen sensitization described above. As the gold sensitizer, those having an pxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and Japanese Patent Application No. 2001-79450 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization and (4) just before coating.

The amount of sulfur, selenium and tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol per one mol of the silver halide.

The addition amount of the gold sensitizer may vary depending on various conditions and it is generally about $10^{-7}$ mol to $10^{-3}$ mol and, more preferably, $10^{-6}$ mol to $5\times10^{-4}$ mol per one mol of the silver halide.

There is no particular restriction on the condition for the chemical sensitization in the invention and, appropriately, pH is 5 to 8, pAg is 6 to 11 and temperature is at 40° C. to 95° C.

In the silver halide emulsion used in the invention, a thiosulfonic acid compound may be added by the method shown in EP-A No. 293917.

A reductive compound is used preferably for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion production process from crystal growth to the preparation step just before coating. Further, it is preferred to apply reduction sensitization by ripening while keeping pH to 7 or higher or pAg to 8.3 or lower for the emulsion, and it is also preferred to apply reduction sensitization by introducing a single addition portion of silver ions during graine formation.

The photosensitive silver halide emulsion in the invention preferably contains an FED sensitizer (Fragmentable Electron Donating Sensitizer) as a compound generating two electrons by one photon. As the FED sensitizer, those compounds described in U.S. Pat. Nos. 5,747,235, 5,747,236, 6,054,260 and 5,994,051, and Japanese Patent Application No. 2001-86161 are preferred. The FED sensitizer may be added preferably at any stage in the photosensitive emulsion production process from the crystal growth to the preparation step just before coating. The addition amount may vary depending on various conditions and as a standard, it is about from $10^{-7}$ mol to $10^{-1}$ mol, more preferably, $10^{-6}$ mol to $5\times10^{-2}$ mol per one mol of the silver halide.

9) Combination Of Different Kinds Of Silver Halides

The photosensitive silver halide emulsion in the photosensitive material used in the invention may be used alone, or two or more kinds of them (for example, those of different average grain sizes, different halogen compositions, different crystal habits and of different conditions for chemical sensitization) may be used together. Gradation can be controlled by using a plural kinds of photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 logE or more between each of the emulsions.

10) Coating Amount

The addition amount of the photosensitive silver halide, when expressed by the coating amount of silver per 1 $m^2$ of the photothermographic material, is preferably from 0.03 $g/m^2$ to 0.6 $g/m^2$, more preferably, 0.05 $g/m^2$ to 0.4 $g/m^2$ and, further preferably, 0.07 $g/m^2$ to 0.3 $g/m^2$. The photosensitive silver halide is used by 0.001 mol to 0.7 mol, preferably, 0.03 mol to 0.5 mol per one mol of the organic silver salt.

2. Non-Photosensitive Organic Silver Salt

The feature of the invention resides in using a photothermographic material in which the non-photosensitive organic silver salt comprises a silver salt of a fatty acid and the organic silver salt contains 30 mol % to 85 mol % of silver behenate. Except for the condition described above, the non-sensitive organic silver salt can be used with no particular restriction and details are to be described below.

1) Composition

The non-photosensitive organic silver salt particle according to the invention (hereinafter sometimes referred to simply as "organic silver salt") is a silver salt which is relatively stable to light but forms silver images when heated to 80° C. or higher under the presence of an exposed photo-catalyst (such as latent images of photosensitive silver halide) and a reducing agent.

The organic silver salt may be any organic material containing a source capable of reducing silver ions. Such non-photosensitive organic silver salt is disclosed, for example, in JP-A Nos. 6-130543, 8-314078, 9-127643, 10-62899 (paragraph Nos. 0048 to 0049), 10-94074, and 10-94075, EP-A No. 0803764A1 (page 18, line 24 to page 19, line 37), EP-A Nos. 962812A1 and 1004930A2. JP-A Nos. 11-349591, 2000-7683, 2000-72711, 2000-112057, and 2000-155383.

In the non-photosensitive organic silver salt of the invention, a fatty acid is used as the organic acid and, particularly, a silver salt of long chained fatty acid carboxylic acid (number of carbon atoms having 10 to 30, preferably, 15 to 28) is preferable. Preferred examples of the silver salt of the organic acid can include, for example, silver behenate, silver arachidinic acid, silver stearate, silver oleate, silver laurate, silver capronate, silver myristate, silver palmitate and mixtures thereof. Among the organic silver salts, it is preferred to use an organic silver salt with the silver behenate content of 30 mol % to 99 mol %. Particularly, the silver behenate content is preferably 30 mol % to 85 mol %. An organic silver salt with the behenate content of 45 mol % to 70 mol % is most preferred. For the remaining organic silver salt, a silver salt of a long chained fatty acid carboxylic acid, preferably, a silver salt of long chained fatty acid carboxylic acid having 10 to 30 carbon atoms, particularly, 15 to 28 carbon atoms is preferred.

It has been found by earnest studies that the photothermographic material in which silver behenate is added at a predetermined ratio can provide a photothermographic material with less change of color tones even by uneven heating during thermal development. By the use of the photothermographic material, it can sufficiently withstand during use also in a thermal developing apparatus at a high line speed during development.

2) Shape

There is no particular restriction on the shape of the organic silver salt usable in the invention and it may needle-like, bar-like, plate-like or flaky shape.

In the invention, a flaky shaped organic silver salt is preferred. Short needle-like, rectangular, cuboidal or potato-like indefinite shaped particle with the major axis to minor axis ratio being 5 or less is also used preferably. Such organic silver particle has a feature less suffering from fogging during thermal development compared with long needle-like particles with the major axis to minor axis length ratio of 5 or more. Particularly, a particle with the major axis to minor axis ratio of 3 or less is preferred since it can improve the mechanical stability of the coating film. In the present specification, the flaky shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flaky shape. The relation is preferably: 30≧x (average)≧0.5 and, more preferably, 15≧x (average)≧1.5. By the way, needle-like is expressed as 1≦x (average)≦1.5.

In the flaky shaped particle, a can be regarded as a thickness of a plate particle having a main plate with b and c being as the sides. a in average is preferably 0.01 μm to 0.3 μm and, more preferably, 0.1 μm to 0.23 μm. c/b in average preferably 1 to 9, more preferably, 1 to and, further preferably, 1 to 4 and, most preferably, 1 to 3.

By controlling the sphere equivalent diameter to 0.05 μm to 1 μm, it causes less agglomeration in the photosensitive material and image storability is improved. The spherical equivalent diameter is preferably 0.1 μm to 1 μm. In the invention, the sphere equivalent diameter can be measured by a method of photographing a sample directly by using an electron microscope and then image-processing negative images.

In the flaky shaped particle, the sphere equivalent diameter of the particle/a is defined as an aspect ratio. The aspect ratio of the flaky particle is, preferably, 1.1 to 30 and, more preferably, 1.1 to 15 with a view point of causing less agglomeration in the photosensitive material and improving the image storability.

As the particle size distribution of the organic silver salt, mono-dispersion is preferred. In the mono-dispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images. Another method of measuring the mono-dispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The mono-dispersion can be determined from particle size (volume weighted mean diameter) obtained, for example, by a measuring method of irradiating a laser beam to an organic silver salt dispersed in a liquid, and determining a self correlation function of the fluctuation of scattered light to the change of time.

3) Preparation 3-1) Preparation of Organic Silver Salt for Addition to Organic Solvent In a case of preparing a coating solution by adding to an organic solvent, the organic silver salt is prepared by adding an alkali metal salt (for example, sodium hydroxide or potassium hydroxide) to an organic acid to prepare an alkali metal organic acid soap and then mixing with a water soluble silver salt (for example, silver nitrate). The silver halide can be added at any of the stages thereof. Main mixing step can include, four steps comprising (A) adding a silver halide previously to an organic acid and, after addition of an alkali metal salt, mixing with a water soluble silver salt, (B) mixing an alkali metal organic acid soap and a silver halide and, subsequently mixing with a water soluble silver salt, (C) forming a portion of an alkali metal soap of an organic acid into a silver salt, then mixing a silver halide and, subsequently, forming a silver salt for the remaining portion and (D) mixing a silver halide in the subsequent step after completion of an organic silver salt. Steps (B) or (C) are preferred, with the step (B) being particularly preferred.

In the step (B) or (C) it is important that the previously prepared photosensitive silver halide is mixed in the step of preparing the organic silver salt to prepare a dispersion of an organic silver salt containing the silver halide. That is, the photosensitive silver halide is formed under the absence of the non-photosensitive organic silver salt and then mixed in the process for preparing the organic silver salt. This is because a sufficient sensitivity can not sometimes be attained by the method of forming the silver halide by adding a halogenating agent to the organic silver salt.

The method of mixing the silver halide and the organic silver salt by the step (D) can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above.

All of those salt forming steps are carried out in an aqueous solvent and then the salt is dewatered, dried and then re-dispersed into a solvent such as MEK. Drying is preferably conducted in a airflow-type flash jet drier at a partial oxygen pressure of 15 vol % or less, more preferably, at 0.01 vol % to 15 vol % and, more preferably, at 0.01 vol % to 10 vol %.

3-2) Preparation of Organic Silver Salt for Addition to Water Solvent

In a case of using water as the solvent to prepare a coating solution, known methods can be applied. For example, reference can be made to JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870 and 2002-107868.

When a photosensitive silver salt is present together during dispersion of the organic silver salt, fog increases and the sensitivity becomes remarkably lower, so that it is more preferred that the photosensitive silver salt is not substantially contained during dispersion. In the invention, the amount of the photosensitive silver salt to be disposed in the aqueous dispersion, is preferably, 1 mol % or less, more preferably, 0.1 mol % or less per one mol of the organic acid silver salt in the solution and, further preferably, positive addition of the photosensitive silver salt is not conducted.

In the invention, the photosensitive material can be prepared by mixing an aqueous dispersion of an organic silver salt and an aqueous dispersion of a photosensitive silver salt and the mixing ratio between the organic silver salt and the photosensitive silver salt can be selected depending on the purpose. The ratio of the photosensitive silver salt to the organic silver salt is, preferably, within a range from 1 mol % to 30 mol %, more preferably, within a range from 2 mol % to 20 mol % and, particularly preferably, 3 mol % to 15 mol %. A method of mix two or more kinds of aqueous dispersions of organic silver salts and two or more kinds of aqueous dispersions of photosensitive silver salts upon mixing is used preferably for controlling the photographic properties.

4) Addition Amount

The organic silver salt in the invention can be used by a desired amount and, the entire coating amount of silver also including silver halide is, preferably, 0.1 $g/m^2$ to 1.9 $g/m^2$, more preferably, 0.1 $g/m^2$ to 1.7 $g/m^2$ and, further preferably, 0.3 g/m$^2$ to 1.5 g/m$^2$. Particularly, for improving the image storability, less it is preferred that the entire coating amount of silver is smaller. When a preferred reducing agent of the invention is used, a sufficient image density can be obtained even at such a small amount of silver.

3. Reducing Agent

The photothermographic material of the invention contains a reducing agent for the organic silver salt. The reducing agent may be any substance (preferably, organic substance) capable of reducing silver ions into metallic silver. Examples of the reducing agent are described in JP-A No. 11-65021 (column Nos. 0043 to 0045) and EP-A 0803764 (p.7, line 34 to p. 18, line 12).

In the invention, a so-called hindered phenolic reducing agent or a bisphenol agent having a substituent at the ortho-position to the phenolic hydroxyl group is preferred and the bisphenolic reducing agent is more preferred. Particularly, the compound represented by the following general formula (R) is preferred.

General formula (R)

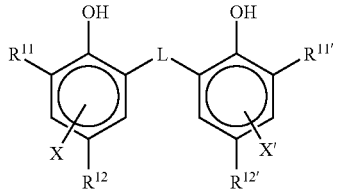

In the general formula (R), $R^{11}$ and $R^{11'}$ each independently represent an alkyl group having 1 to 20 carbon atoms. $R^{12}$ and $R^{12'}$ each independently represent a hydrogen atom or a group capable of substitution on a benzene ring. L represents a —S— group or a —CHR$^{13}$— group. $R^{13}$ represents a hydrogen atom or an alkyl group having 1 to 20 carbon atoms. X and $X^1$ each independently represent a hydrogen atom or a group capable of substituting for a hydorgen atom on a benzene ring.

Each of the substituents is to be described specifically.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, aryl group, hydroxy group, alkoxy group, aryloxy group, alkylthio group, arylthio group, acylamino group, sulfoneamide group, sulfonyl group, phosphoryl group, acyl group, carbamoyl group, ester group, and halogen atom.

2) $R^{12}$ and $R^{12'}$, X and $X^1$ $R^{12}$ and $R^{12'}$ each independently represents a hydrogen atom or a group capable of substituting for a hydorgen atom on a benzene ring.

X and $X^1$ each independently represent a hydrogen atom or a group capable of substituting for a hydorgen atom on a benzene ring. Each of the groups capable of substitution on the benzene ring can include, preferably, alkyl group, aryl group, halogen atom, alkoxy group, and acylamino group.

3) L

L represents a —S— group or a —CHR$^{13}$— group. $R^{13}$ represents a hydrogen atom or an alkyl group having 1 to 20 carbon atoms in which the alkyl group may have a substituent.

Specific examples of the non-substituted alkyl group for $R^{13}$ can include, for example, methyl group, ethyl group, propyl group, butyl group, heptyl group, undecyl group, isopropyl group, 1-ethylpentyl group, and 2,4,4-trimethylpentyl group.

Examples of the substituent for the alkyl group can include, like substituent $R^{11}$, a halogen atom, an alkoxy group, alkylthio group, aryloxy group, arylthio group, acylamino group, sulfoneamide group, sulfonyl group, phosphoryl group, oxycarbonyl group, carbamoyl group, and sulfamoyl group.

4) Preferred Substituents $R^{11}$ and $R^{11'}$ are, preferably, a secondary or tertiary alkyl group having 3 to 15 carbon atoms and can include, specifically, isopropyl group, isobutyl group, t-butyl group, t-amyl group, t-octyl group, cyclohexyl group, cyclopentyl group, 1-methylcyclohexyl group, and 1-methylcyclopropyl group. $R^{11}$ and $R^{11'}$ each represents, more preferably, tertiary alkyl group having 4 to 12 carbon atoms and, among them, t-butyl group, t-amyl group, 1-methylcyclohexyl group are further preferred, t-butyl group being most preferred.

$R^{12}$ and $R^{12'}$ are, preferably, alkyl groups having 1 to 20 carbon atoms and can include, specifically, methyl group, ethyl group, propyl group, butyl group, isopropyl group, t-butyl group, t-amyl group, cyclohexyl group, 1-methylcyclohexyl group, benzyl group, methoxymethyl group and methoxyethyl group. More preferred are methyl group, ethyl group, propyl group, isopropyl group, and t-butyl group.

X and $X^1$ are, preferably, a hydrogen atom, halogen atom, or alkyl group, and more preferably, hydrogen atom.

L is preferably a group —CHR$^{13}$—.

$R^{13}$ is, preferably, a hydrogen atom or an alkyl group having 1 to 15 carbon atoms. The alkyl group is preferably methyl group, ethyl group, propyl group, isopropyl group and 2,4,4-trimethylpentyl group. Particularly preferred $R^{13}$ is a hydrogen atom, methyl group, propyl group or isopropyl group.

In a case where $R^{13}$ is a hydrogen atom, $R^{12}$ and $R^{12'}$ each represents, preferably, an alkyl group having 2 to 5 carbon atoms, ethyl group and propyl group being more preferred and ethyl group being most preferred.

In a case where $R^{13}$ is a primary or secondary alkyl group having 1 to 8 carbon atom, $R^{12}$ and $R^{12'}$ each represents preferably methyl group. As the primary or secondary alkyl group of 1 to 8 carbon atoms for $R^{13}$, methyl group, ethyl group, propyl group and isopropyl group are more preferred, and methyl group, ethyl group, and propyl group are further preferred.

In a case where each of $R^{11}$, $R^{11'}$ and $R^{12}$, $R^{12'}$ is methyl group, $R^{13}$ is preferably a secondary alkyl group. In this case, the secondary alkyl group for $R^{13}$ is preferably isopropyl group, isobutyl group and 1-ethylpentyl group, with isopropyl group being more preferred.

The reducing agent described above show various different thermo-developing performance depending on the combination of $R^{11}$, $R^{11'}$ and $R^{12}$, $R^{12'}$, as well as $R^{13}$. Since the thermo-developing performances can be controlled by using two or more kinds of reducing agents at various mixing ratios, it is preferred to use two or more kinds of reducing agents in combination depending on the purpose.

Specific examples of the compounds represented by general formula (R) according to the invention are shown below but the invention is not restricted to them.

(I-1)
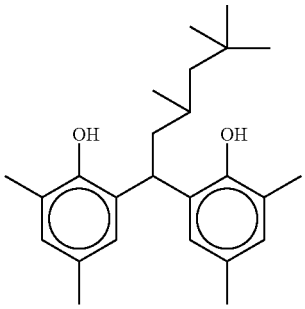
(I-2)
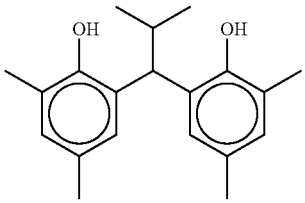
(I-3)
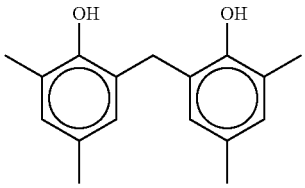
(I-4)
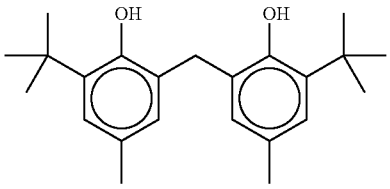
(I-5)
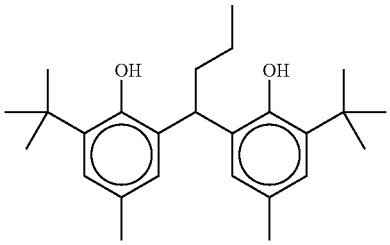
(I-6)
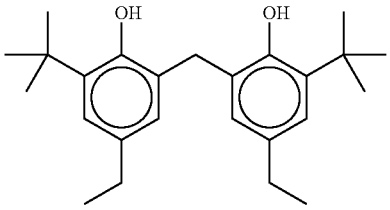
(I-7)
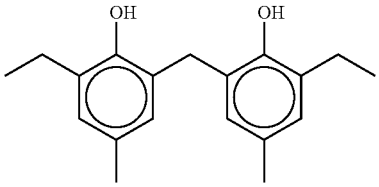
-continued
(I-8)
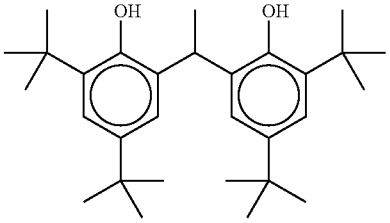
(I-9)
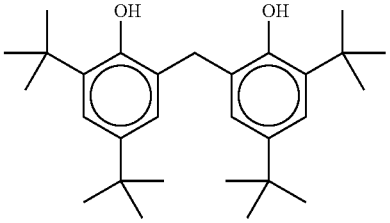
(I-10)
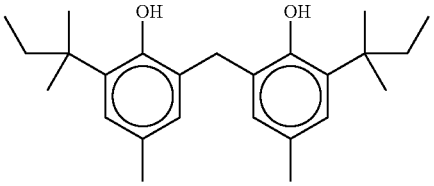
(I-11)
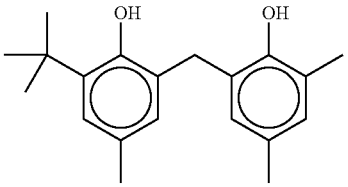
(I-12)
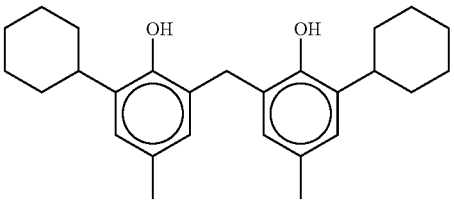
(I-13)
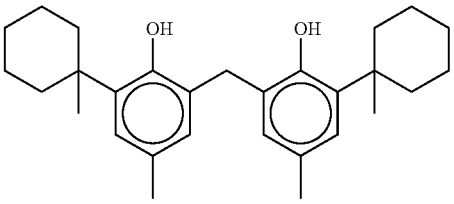
(I-14)
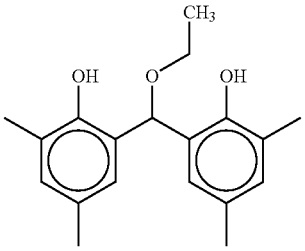

-continued (I-15)

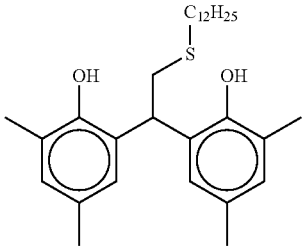

(I-16)

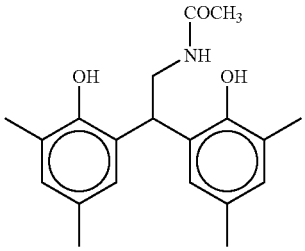

(I-17)

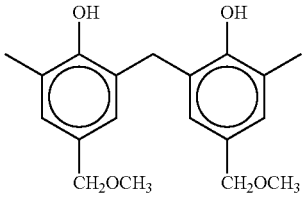

(I-18)

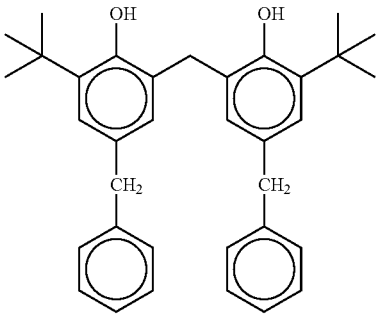

(I-19)

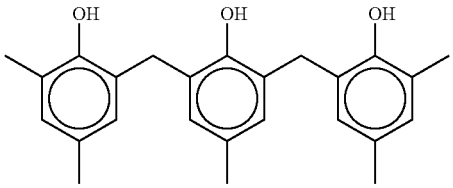

(I-20)

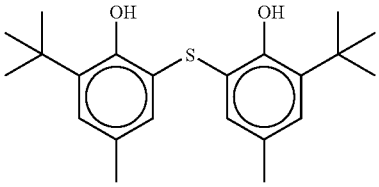

(I-21)

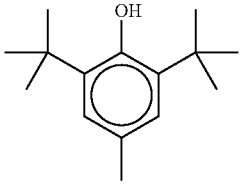

-continued (I-22)

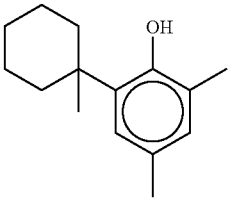

(I-23)

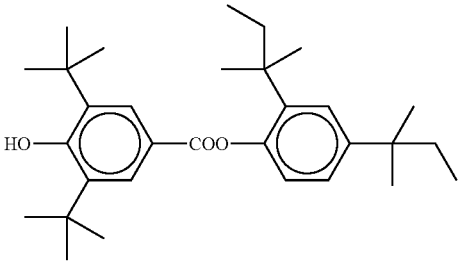

(I-24)

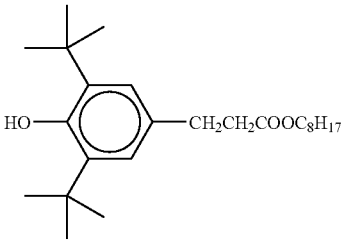

(I-25)

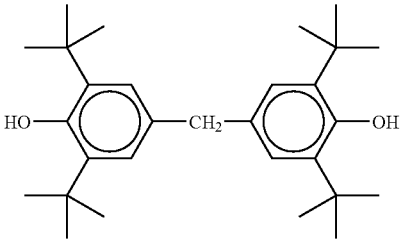

(I-26)

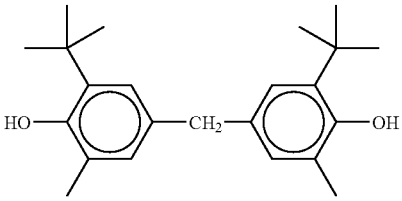

(I-27)

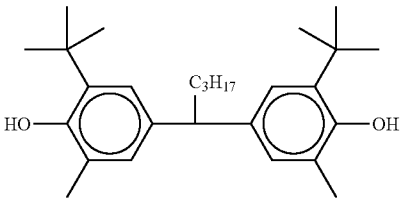

In the invention, the addition amount of the reducing agent is, preferably, from 0.01 g/m$^2$ to 5.0 g/m$^2$, more preferably, 0.1 g/m$^2$ to 3.0 g/m$^2$, and it is, preferably, contained by 5 mol % to 50 mol % and, further preferably, 10 mol % to 40 mol % per one mol of silver in the image forming layer.

The reducing agent of the invention can be added to the image forming layer containing the organic silver salt and the photosensitive silver halide and a layer adjacent thereto, and it is more preferably contained in the image forming layer.

The reducing agent of the invention may be contained in any method into the coating solution or contained in the photosensitive material such as in the form of, solution, in the form of emulsified dispersion or in the dispersion form of fine solid particles. It is preferably contained in the solution form by a method of dissolving the reducing agent into a coating solvent and then incorporating the same in the photosensitive material.

4. Development Accelerator

In the photothermographic material of the invention, sulfoneamide phenolic compounds represented by the general formula (A) described in the specification of JP-A No. 2000-267222, and specification of JP-A No. 2000-330234, hindered phenolic compound represented by the general formula (II) described in JP-A No. 2001-92075, hydrazine series compounds represented by general formula (I) described in the specification of JP-A No. 10-62895 and the specification of JP-A No. 11-15116, represented by general formula (D) of JP-A No. 2002-156727 and represented by general formula (1) described in the specification of Japanese Patent Application No. 2001-074278, and phenolic or naphthalic compounds represented by general formula (2) described in the specification of JP-A No. 2001-264929 are used preferably as the development accelerator and they are added preferably. The development accelerator described above is used within a range from 0.1 mol % to 20 mol %, preferably, within a range from 0.5 mol % to 10 mol % and, more preferably, within a range from 1 mol % to 5 mol % to the reducing agent. The introduction method to the photothermographic material can include, the same method as those for the reducing agent and, it is particularly preferred to add as a solid dispersion or an emulsion dispersion. In a case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, it is more preferred to use, among the development accelerators described above, hydrazine compounds represented by general formula (D) described in the specification of JP-A No. 2002-156727, and phenolic or naphtholic compounds represented by general formula (2) described in the specification of JP-A No. 2001-264929.

Particularly preferred development accelerators of the invention are compounds represented by the following general formulae (A-1) and (A-2).

General formula (A-1)

$$Q_1\text{-NHNH-}Q_2$$

(in which $Q_1$ represents an aromatic group or heterocyclic group coupling at a carbon atom to —NHNH-$Q_2$ and $Q_2$ represents a carbamoyl group, acyl group, alkoxycarbonyl group, aryloxycarbonyl group, sulfonyl group or sulfamoyl group).

In general formula (A-1), the aromatic group or heterocyclic group represented by $Q_1$ is, preferably, 5 to 7 membered unsaturated rings. Preferred examples are benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene ring. Condensed rings in which the rings described above are condensed to each other are also preferred.

The rings described above may have substituents and in a case where they have two or more substituent groups, the substituents may be identical or different with each other. Examples of the substituents can include halogen atom, alkyl group, aryl group, carboamide group, alkylsulfoneamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. In a case where the substituents are groups capable of substitution, they may have further substituents and examples of preferred substituents can include halogen atom, alkyl group, aryl group, carbonamide group, alkylsulfoneamide group, arylsulfoneamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group and acyloxy group.

The carbamoyl group represented by $Q_2$ is a carbamoyl group preferably having 1 to 50 carbon atoms and, more preferably, of 6 to 40 carbon atoms, for example, not-substituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbaoyl, N-3-pyridylcarbamoyl and N-benzylcarbamoyl.

The acyl group represented by $Q_2$ is an acyl group, preferably, having 1 to 50 carbon atoms and, more preferably, 6 to 40 carbon atoms and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. Alkoxycarbonyl group represented by $Q_2$ is an alkoxycarbonyl group, preferably, of 2 to 50 carbon atom and, more preferably, of 6 to 40 carbon atoms and can include, for example, methoxycarbonyl, ethoxycarbonyl, isobutyloxycarbonyl, cyclehexyloxycarbonyl, dodecyloxycarbonyl and benzyloxycarbonyl.

The aryloxy carbonyl group represented by $Q_2$ is an aryloxycarbonyl group, preferably, having 7 to 50 carbon atoms and, more preferably, of 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably, of 1 to 50 carbon atoms and, more preferably, of 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is sulfamoyl group, preferably, having 0 to 50 carbon atoms, more preferably, 6 to 40 carbon atoms and can include, for example, not-substituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different with each other.

Then, preferred range for the compounds represented by formula (A-1) is to be described. 5 to 6 membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring and a ring in which the ring described above is condensed with a benzene ring or unsaturated hetero ring are further preferred. Further, $Q_2$ is preferably a carbamoyl group and, particularly, a carbamoyl group having hydrogen atom on the nitrogen atom is particularly preferred.

General formula (A-2)

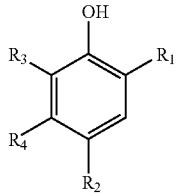

In general formula (A-2), $R_1$ represents an alkyl group, acyl group, acylamino group, sulfoneamide group, alkoxycarbonyl group, and carbamoyl group. $R_2$ represents a hydrogen atom, halogen atom, alkyl group, alkoxy group, aryloxy group, alkylthio group, arylthio group, acyloxy group and carbonate ester group. $R_3$, $R_4$ each represents a group capable of substituting for a hydrpgen atom on a benzene ring which is mentioned as the example of the substituent for general formula (A-1). $R_3$ and $R_4$ may join to each other to form a condensed ring.

$R_1$ is, preferably, an alkyl group having 1 to 20 carbon atoms (for example, methyl group, ethyl group, isopropyl group, butyl group, tert-octyl group, or cyclohexyl group), acylamino group (for example, acetylamino group, benzoylamino group, methylureido group, or 4-cyanophenylureido group), carbamoyl group (for example, n-butylcarbamoyl group, N,N-diethylcarbamoyl group, phenylcarbamoyl group, 2-chlorophenylcarbamoyl group, or 2,4-dichlorophenylcarbamoyl group), acylamino group (including ureido group or urethane group) being more preferred. $R_2$ is, preferably, a halogen atom (more preferably, chlorine atom, bromine atom), alkoxy group (for example, methoxy group, butoxy group, n-hexyloxy group, n-decyloxy group, cyclohexyloxy group or benzyloxy group), and aryloxy group (phenoxy group or naphthoxy group).

$R_3$ is, preferably a hydrogen atom, halogen atom or an alkyl group having 1 to 20 carbon atoms, the halogen atom being most preferred. $R_4$ is preferably a hydrogen atom, alkyl group or an acylamino group, with the alkyl group or the acylamino group being more preferred. Examples of the preferred substituent thereof are identical with those for $R_1$. In a case where $R_4$ is an acylamino group, $R_4$ may preferably be joined with $R_3$ to form a carbostyryl ring.

In a case where $R_3$ and $R_4$ in general formula (A-2) are joined to each other to form a condensed ring, a naphthalene ring is particularly preferred as the condensed ring. The same substituent as the example of the substituent referred to for general formula (A-1) may be joined to the naphthalene ring. In a case where the general formula (A-2) is a naphtholic compound, $R_1$, is, preferably, a carbamoyl group. Among them, benzoyl group is particularly preferred. $R_2$ is, preferably, an alkoxy group or aryloxy group and, particularly, preferably an alkoxy group.

Preferred specific examples for the development accelerator of the invention are to be described below. The invention is not restricted to them.

(A-1)

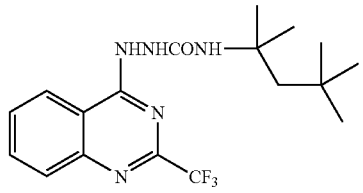

(A-2)

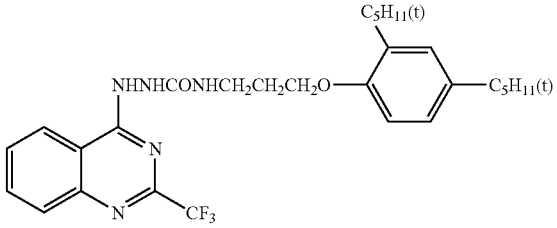

(A-3)

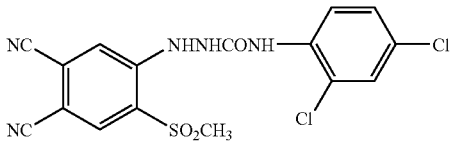

(A-4)

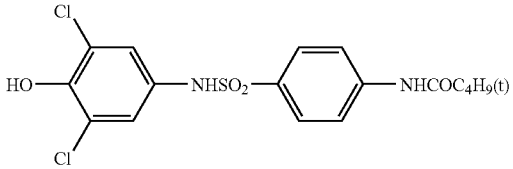

(A-5)

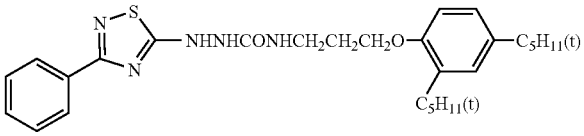

(A-6)

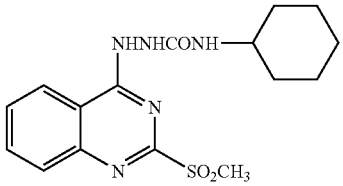

-continued (A-7)

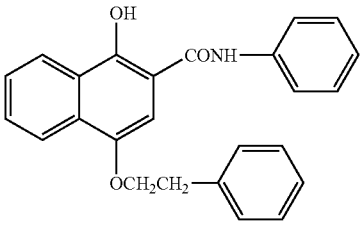

(A-8)

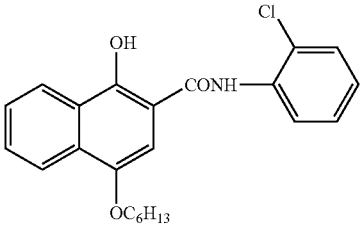

(A-9)

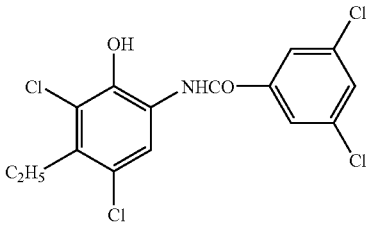

(A-10)

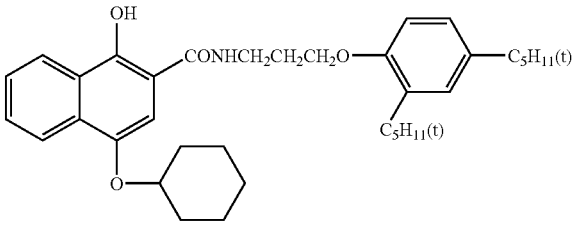

5. Thermal Solvent

The photothermographic material in the invention preferably, contains a thermal solvent. The thermal solvent is defined as a material capable of lowering the thermal development temperature by 1° C. or more with regard to the thermal solvent-containing photothermographic material, compared with the photothermographic material not containing the thermal solvent. Further preferably, this is the material capable of lowering the thermal development temperature by 2° C. or more and, particularly, capable of lowering the temperature by 3° C. or more. For the photothermographic material A containing the thermal solvent and the photothermographic material B not containing the thermal solvent, relative to the photothermographic material A, the material is defined as a thermal solvent when the thermal development temperature is 119° C. or lower for obtaining the density to be obtained by exposing the photothermographic material B and processing the same at a thermal development temperature of 120° C. for a thermal development time of 20 sec, by the photothermographic material A with the identical amount of exposure and thermal development time.

The thermal solvent of the invention has polar groups as substituent groups, and, though not limiting, those expressed by formula (S) are preferred.

Formula (S)

$(Y)_nZ$

In formula (S), Y represents an alkyl group, an alkenyl group, an alkynyl group, an aryl group, or a heterocyclic group; Z represents a group selected from a hydroxyl group, a carboxyl group, an amino group, an amido group, a sulfoamido group, a phosphoamido group, a cyano group, an imido, an ureido, a sulfoxide, a sulfone, a phosphine, a phosphineoxide, or an nitrogen-containing heterocyclic group; n represents an integer from 1 to 3, which is 1 in the case Z is a monovalent group, and is the same as the valence of Z in the case Z is a divalent group or a group with higher valence. In the case n is a numeral 2 or higher, plural Y's may be the same or different.

Y may further contain a substituent group, and may have a group expressed by Z as the substituent group.

Y is explained in further detail below. In formula (S), Y may be a straight chain, a branched, or a cyclic alkyl group (preferably having 1 to 40 carbons, more preferably 1 to 30 carbons, and most preferably, 1 to 25 carbons; more specifically, there can be mentioned a methyl, an ethyl, an n-propyl, an iso-propyl, a sec-butyl, a t-butyl, a t-octyl, an n-amyl, a t-amyl, an n-dodecyl, an n-tridecyl, an octadecyl, an icosyl, a docosyl, a cyclopentyl, a cyclohexyl, and the like), an alkenyl group (preferably having 2 to 40 carbons, more preferably 2 to 30 carbons, and most preferably, 2 to 25 carbons; more specifically, there can be mentioned a vinyl, an allyl, a 2-butenyl, a 3-pentenyl, and the like), an aryl group (preferably having 6 to 40 carbons, more preferably 6 to 30 carbons, and most preferably, 6 to 25 carbons; more specifically, there can be mentioned a phenyl, a p-metylphenyl, a naphthyl, and the like), and a heterocyclic group (preferably having 2 to 20 carbons, more preferably 2 to 16 carbons, and most preferably, 2 to 12 carbons; more specifically, there can be mentioned a pyridyl, a pyradyl, an imidazoyl, a pyrrolisyl, and the like). These substituents may be further substituted by other substituents. Furthermore, these substituents may be combined with each other to form a ring.

Y may further contain substituents, and as examples of the substituents, there can be mentioned a halogen atom (a fluorine atom, a chlorine atom, a bromine atom, or an iodine atom), an alkyl group (a straight chain, a branched, or a cyclic alkyl group, inclusive of bicycloalkyl group and an active methine group), an alkenyl group, an alkynyl group, an aryl group, or a heterocyclic group (irrespective of the position of substitution), an acyl group, an alcoxylcarbonyl group, an aryloxycarbonyl group, a heterocyclic oxycarbonyl group, a carbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxy group or a salt thereof, an oxaryl group, an oxamoyl group, a cyano group, a carbonimidoyl group, a formyl group, a hydroxyl group, an alkoxy group (inclusive of a group containing a repetition of ethyleneoxy group or propyleneoxy group), an aryloxy group, a heterocyclic oxy group, an acyloxy group, (an alkoxy or aryloxy) carbonyloxy group, a carbamoyloxy group, a sulfonyloxy group, an amino group, (an alkyl, an aryl, or a heterocyclic) amino group, an acylamino group, a sulfonamido group, an ureido group, a thioureido group, an imido group, (an alkoxyl or an aryloxy) carbonylamino group, a sulfamoylamino group, a semicarbazido group, a thiosemicarbazido group, an ammonio group, an oxamoylamino group, an N-(alkyl or aryl) sulfonylureido group, an N-acylureido group, an N-acylsulfamoyl group, a nitro group, a heterocyclic group containing a tertialized nitrogen atom (for instance, a pyridinio group, an imidazolio group, a quinolinio group, an isoquinolinio group), an isocyano group, an imino group, a mercapto group, (an alkyl, an aryl, or a heterocyclic) thio group, (an alkyl, an aryl, or a heterocyclic) dithio group, (an alkyl or an aryl) sulfonyl group, (an alkyl or an aryl) sulfinyl group, a sulfo group or a salt thereof, a sulfamoyl group, an N-acylsulfamoyl group, an N-sulfonylsulfamoyl group or a salt thereof, a phosphino group, a phosphinyl group, a phosphinyloxy group, a phosphinylamino group, a silyl group, and the like. An active methine group herein signifies a methine group substituted by two electron-attracting groups, and an electron-attracting group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, or a carbonimidoyl group. The two electron-attracting groups may combine with each other to form a ring structure. A salt as referred herein signifies a cation such as that of an alkali metal, an alkaline earth metal, a heavy metal, and the like, or an organic cation such as an ammonium ion, phosphonium ion, and the like. These substituents may further be substituted by the substituents enumerated above. Y may further contain a group expressed by Z as a substituent.

As the reason why the thermal solvent shows the effect of the invention, it is believed that the thermal solvent melts at a temperature in the vicinity of the development temperature to show compatibility with the substance related with the development, and that it enables reaction at a temperature lower than the case no thermal solvent is added to the system. Thermal development is a reduction reaction in which carboxylic acids and silver ion carriers having relatively high polarity contribute to the reaction. Thus, it is preferred to incorporate a thermal solvent having polar groups to form a reaction field having an appropriate degree of polarity.

The melting point of the thermal solvent of the invention is in a range not lower than 50° C. but not higher than 200° C., but is preferably in a range not lower than 60° C. but not higher than 150° C. In the case of a photothermographic material in which stability of image storage and the like with respect to external environment is stressed, in particular, thermal solvent having a melting point in a range not lower than 100° C. but not higher than 150° C. is preferred.

Specific examples of thermal solvents of the invention are given below, but it should be understood that the invention is not limited thereto. Melting point of the solvent is given in parenthesis.

N-methyl-N-nitroso-p-toluenesulfonamide (61° C.), 1,8-octanediol (62° C.), phenyl benzoate (67° C.-71° C.), hydroquinone diethyl ether (67° C.-73° C.), ε-caprolactam (68° C.-70° C.), diphenyl phosphate (68° C.-70° C.), (±)-2-hydroxyoctanoic acid (68° C.-71° C.), (±)-3-hydroxydodecanoic acid (68° C.-71° C.), 5-chloro-2-methylbenzothiazole (68° C.-71° C.), β-naphthyl acetate (68° C.-71° C.), butyl alcohol (68° C.-73° C.), (±)-2-hydroxydecanoic acid (69° C.-72° C.), 2,2,2-trifluoroacetamide (69-72° C.), pyrazole (69° C.), (±)-2-hydroxyundecanoic acid (70° C.-73° C.), N,N-diphenyl formamide (71° C.-72° C.), dibenzyldisulfide (71° C.-72° C.), (±)-3-hydroxyundecanoic acid (71° C.-74° C.), 2,2'-dihydroxy-4-methoxybenzophenone (71° C.), 2,4-dinitrotoluene (71° C.), 2,4-dimethoxybenzaldehyde (71° C.), 2,6-di-t-butyl-4-methylphenol (71° C.), 2,6-dichlorobenzaldehyde (71° C.), diphenylsulfoxide (71° c.), stearic acid (71° C.), 2,5-dimethoxynitrobenzene (72° C.-73° C.), 1,10-decanediol (72° C.-74° C.), (R)-(−)-3-hydroxytetradecanoic acid (72° C.-75° C.), 2-tetradecylhexadecanoic acid (72° C.-75° C.), 2-methoxynaphthalene (72° C.-75° C.), methyl 3-hydroxy-2-naphthoate (72° C.-76° C.), tristearin (73.5° C.), dotriacontane (74° C.-75° C.), flavanone (74° C.-78° C.), 2,5-diphenyloxazole (74° C.), 8-quinolinol (74° C.), o-chlorobenzyl alcohol (74° C.), oleic acid amide (75° C.-76° C.), (±)-2-hydroxydodecanoic acid (75° C.-78° C.) n-hexatriacontane (75° C.-79° C.), iminodiacetonitrile (75° C.-79° C.), p-chlorobenzyl alcohol (75° C.), diphenyl diphthalate (75° C.), N-methylbenzamide (76° C.-78° C.), (±)-2-hydroxytridecanoic acid (76° C.-79° C.), 1,3-diphenyl-1,3-propanedione (76° C.-79° C.), N-methyl-p-toluenesulfonamide (76° C.-79° C.), 3'-nitroacetophenone (76° C.-80° C.), 4-phenylcyclohexanone (76° C.-80° C.), eicosanic acid (76° C.), 4-chlorobenzophenone (77° C.-78° C.), (±)-3-hydroxytetradecanoic acid (77° C.-80° C.), 2-hexadecyloctadecanoic acid (77° C.-80° C.), p-nitrophenyl acetate (77° C.-80° C.), 4'-nitroacetophenone (77° C.-81° C.), 12-hydroxystearic acid (77° C.), α,α'-dibromo-m-xylene (77° C.), 9-methylanthracene (78° C.-81° C.), 1,4-cyclohexanedione (78° C.), m-diethylaminophenol (78° C.), methyl m-nitrobenzoate (78° C.), (±)-2-hydroxytetradecanoic acid (79° C.-82° C.), 1-(phenylsulfonyl)indole (79° C.), di-p-tolylmethane (79° C.), propioneamide (79° C.), (±)-3-hydroxytridecanoic acid (80° C.-83° C.), guaiacol glycerin ether (80° C.-85° C.), octanoyl-N-methylglucamide (80° C.-90° C.), o-fluoroacetanilide (80° C.), acetanilide (80° C.), docosanoic acid (81° C.-82° C.), p-bromobenzophenone (81° C.), triphenylphosphine (81° C.), dibenzofuran (82.8° C.), (±)-2-hydroxypentadecanoic acid (82° C.-85° C.), 2-octadecyleicosanic acid (82° C.-85° C.), 1,12-dodecanediol (82° C.), methyl 3,4,5-trimethoxybenzoate (83° C.), p-chloronitrobenzene (83° C.), (±)-3-hydroxyhexadecanoic acid (84-85° C.), o-hydroxybenzyl alcohol (84° C.-86° C.), 1-triacontanol (84° C.-88° C.), o-aminobenzyl alcohol (84° C.), 4-methoxybenzyl acetate (84° C.), (±)-2-hydroxyhexadecanoic acid (85° C.-88° C.), m-dimethylaminophenol (85° C.), p-dibromobenzene (86° C.-87° C.), methyl 2,5-dihydroxybenzoate (86-88° C.), (±)-3-hydroxypentadecanoic acid (86-89° C.), 4-benzylbiphenyl (86° C.), p-fluorophenylacetic acid (86° C.), 1,14-tetradecanediol (87° C.-89° C.), 2,5-dimethyl-2,5-hexanediol (87° C.-90° C.), p-pentylbenzoic acid (87° C.-91° C.), α-(trichloromethyl)benzyl acetate (88° C.-89° C.), 4,4'-dimethylbenzoin (88° C.), diphenyl carbonate (88° C.), m-dinitrobenzene (89.57° C.), (3R,5R)-(+)-2,6-dimethyl-3,5-heptanediol (90° C.-93° C.), (3S,5S)-(−)-2,6-dimethyl-3,5-heptanediol (90° C.-93° C.), cyclohexanoneoxime (90° C.), p-bromoiodobenzene (91° C.-92° C.), 4,4'-dimethylbenzophenone (92° C.-95° C.), triphenylmethane (92° C.-95° C.), stearic acid anilide (92° C.-96° C.), p-hydroxyphenyl ethanol (92° C.), monoethylurea (92° C.), acenaphthylene (93.5° C.-94.5° C.), m-hydroxyacetophenone (93° C.-97° C.), xylitol (93° C.-97° C.), p-iodophenol (93° C.), methyl p-nitrobenzoate (94° C.-98° C.) p-nitrobenzyl alcohol (94° C.), 1,2,4-triacetoxybenzene (95° C.-100° C.), 3-acetylbenzonitrile (95° C.-103° C.), ethyl 2-cyano-3,3-diphenylacrylate (95° C.-97° C.), 16-hydroxyhexadecanoic acid (95° C.-99° C.), D(−)-ribose (95° C.), o-benzoylbenzoic acid (95° C.), α,α'-dibromo-o-xylene (95° C.), benzyl (95° C.), iodoacetamide (95° C.), n-propyl p-hydroxylbenzoate (96° C.-97° C.), flavone (96° C.-97° C.), 2-deoxy-D-ribose (96° C.-98° C.), lauryl gallate (96° C.-99° C.), 1-naphthol (96° C.), 2,7-dimethylnaphthalene (96° C.), 2-chlorophenylacetic acid (96° C.), acenaphthene (96° C.), dibenzyl terephthalate (96° C.), fumaronitrile (96° C.), 4'-amino-2',5'-diethoxybenzanilide (97° C.-100° C.), phenoxyacetic acid (97° C.-100° C.), 2,5-dimethyl-3-hexyne-2,5-diol (97° C.), D-sorbitol (97° C.), m-aminobenzyl alcohol (97° C.), diethyl acetamidomalonate (97° C.), 1,10-phenanthroline monohydrate (98° C.-100° C.), 2-hydroxy-4-methoxy-4'-methylbenzophenone (98-100° C.), 2-bromo-4'-chloroacetophenone (98° C.), methylurea (98° C.), 4-phenoxyphthalonitrile (99° C.-100° C.), o-methoxybenzoic acid (99° C.-100° C.), p-butylbenzoic acid (99° C. 100° C.) xanthene (99° C.-100° C.), pentafluorobenzoic acid (99° C.-101° C.), phenanthrene (99° C.), p-t-butylphenol (100.4° C.), 9-fluorenylmethanol (100° C.-101° C.), 1,3-dimethylurea (100° C.-102° C.), 4-acetoxyindole (100° C.-102° C.), 1,3-cyclohexanedione (100° C.), stearic acid amide (100° C.), tri-m-tolylphosphine (100° C.), 4-biphenylmethanol (101-102° C.), 1,4-cyclohexanediol (mixture of cis- and trans-) (101° C.), α,α'-dichloro-p-xylene (101° C.), 2-t-butylanthraquinone (102° C.), dimethylfumaric acid (102° C.), 3,3-dimethylglutaric acid (103° C.-104° C.), 2-hydroxy-3-methyl-2-cyclopenten-1-one (103° C.), 4-chloro-3-nitroaniline (103° C.), N,N-diphenylacetamide (103° C.), 3(2)-t-butyl-4-hydroxyanisole (104° C.-105° C.), 4,4'-dimethylbenzyl (104° C.-105° C.), 2,2-bis(hydroxymethyl)-2,2',2"-nitrilotriethanol (104° C.), m-trifluoromethylbenzoic acid (104° C.), 3-pentanol (105° C.-108° C.), 2-methyl-1,4-naphthoquinone (105° C.), α,α,α',α'-tetrabromo-m-xylene (105° C.), 4-chlorophenylacetic acid (106° C.), 4,4'-difluorobenzophenone (107.5° C.-108.5° C.), 2,4-dichloro-1-naphthol (107° C.-108° C.), L-ascorbic acid palmitic acid ester (107° C.-117° C.), 2,4-dimethoxybenzoic acid (108° C.-109° C.), o-trifluoromethylbenzoic acid (108° C.-109° C.), p-hydroxyacetophenone (109° C.), dimethylsulfone (109° C.), 2,6-dimethylnaphthalene (110° C.-111° C.), 2,3,5,6-tetramethyl-1,4-benzoquinone (110° C.), tridecane diacid (110° C.), triphenylchloromethane (110° C.), fluoranthene (110° C.), laurylamide (110° C.), 1,4-benzoquinone (111° C.), 3-benzylindole (111° C.), resorcinol (111° C.), 1-bromomethane (112.3° C.), 2,2-bis(bromomethyl)-1,3-propanediol (112-114° C.), p-ethylbenzoic acid (113.5° C.), 1,4-diacetoxy-2-methylnaphthalene (113° C.), 1-ethyl-2,3-piperadinedione (113° C.), 4-methyl-2-nitroaniline (113° C.), L-ascorbic acid dipalmitic acid ester (113° C.), o-phenoxybenzoic acid (113° C.), p-nitrophenol (113° C.), methyl (diphenyl)phosphine oxide (113° C.), cholesterol acetate (114° C.-115° C.), 2,6-dimethylbenzoic acid (114° C.-116° C.), 3-nitrobenzonitrile (114° C.), m-nitroaniline (114° C.), ethyl (α-D-glucoside (114° C.), acetanilide (115° C.-116° C.), (±)-2-phenoxypropionic acid (115° C.), 4-chloro-1-naphthol (116° C.-117° C.), p-nitrophenylacetonitrile (116° C.-117° C.), ethyl p-hydroxybenzoate (116° C.), p-isopropylbenzoic acid (117° C.-118° C.), D(+)-galactose (118° C.-120° C.), o-dinitrobenzene (118° C.), benzyl p-benzyloxybenzoate (118° C.), 1,3,5-tribromobenzene (119° C.), 2,3-dimethoxybenzoic acid (120° C.-122° C.), 4-chloro-2-methylphenoxyacetic acid (120° C.), meso-erythritol (121.5° C.), 9,10-dimethyl-1,2-benzanthracene (122° C.-123° C.), 2-naphthol (122° C.), N-phenylglycine (122° C.), bis(4-hydroxy-3-methylphenyl) sulfide (122° C.), p-hydroxybenzyl alcohol (124.5° C.-125.5° C.), 2',4'-dihydroxy-3'-propylacetophenone (124° C.-127° C.), 1,1-bis(4-hydroxyphenyl)ethane (124° C.), m-fluorobenzoic acid (124° C.) diphenylsulfone (124° C.), 2,2-dimethyl-3-hydroxypropionic acid (125° C.), 3,4,5-trimethoxycinnamic acid (125° C.), o-fluorobenzoic acid (126.5° C.), isonitrosoacetophenone (126-128° C.), 5-methyl-1,3-cyclohexanedione (126° C.), 4-benzoylbutyric acid (127° C.), methyl p-hydroxybenzoate (127° C.), p-bromonitrobenzene (127° C.), 3,4-dihydrocyphenylacetic acid (128° C.-130° C.), 5α-cholestane-3-one (128° C.-130° C.), 6-bromo-2-naphthol (128° C.), isobutylamide (128° C.), 1-naphthylacetic acid (129° C.), 2,2-dimethyl-1,3-propanediol (129° C.), p-diiodobenzene (129° C.), dodecane diacid (129° C.), 4,4'-dimethoxybenzyl (131° C.-133° C.), dimethylolurea (132.5° C.), o-ethoxybenzamide (132° C.-134° C.), cebacic acid (132° C.), p-toluenesulfonamide (134° C.), salicylanilide (135° C.), β-cytosterol (136-137° C.), 1,2,4,5-tetrachlorobenzene (136° C.), 1,3-bis(1-hydroxy-1-methylethyl)benzene (137° C.), phthalonitrile (138° C.), 4-n-propylbenzoic acid (139° C.), 2,4-dichlorophenoxyacetic acid (140.5° C.), 2-naphthylacetic acid (140° C.), methyl terephthalate (140° C.), 2,2-dimethylsuccinic acid (141° C.), 2,6-dichlorobenzonitrile (142.5° C.-143.5° C.), o-chlorobenzoic acid (142° C.), 1,2-bis(diphenylphosphino)ethane (143° C.-144° C.), α,α,α-tribromomethylphenylsulfone (143° C.), D(+)-xylose (144° C.-145° C.), phenylurea (146° C.), n-propyl gallate (146° C.), 4,4'-dichlorobenzophenone (147° C.-148° C.), 2',4'-dihydroxyacetophenone (147° C.), cholesterol (148.5° C.), 2-methyl-1-pentanol (148° C.), 4,4'-dichlorodiphenylsulfone (148° C.), diglycolic acid (148° C.), adipic acid (149° C.-150° C.), 2-deoxy-D-glucose (149° C.), diphenylacetic acid (149° C.), and o-bromobenzoic acid (150° C.).

In the invention, the thermal solvent is preferably added in a range of from 0.01 g/m$^2$ to 5.0 g/m$^2$, more preferably from 0.05 g/m$^2$ to 2.5 g/m$^2$, and most preferably, from 0.1 g/m$^2$ to 1.5 g/m$^2$. Preferably, the thermal solvent is incorporated in the image forming layer.

The thermal solvent may be used alone, but two or more types thereof may be added in combination.

In the invention, the thermal solvent may be incorporated into photosensitive material by being added into the coating solution, such as in the form of a solution, an emulsion dispersion, a solid particle dispersion, and the like.

As a well known emulsion dispersion method, there can be mentioned a method comprising dissolving the thermal solvent in an auxiliary solvent such as oil, for instance, dibutyl phthalate, tricresyl phosphate, glyceryl triacetate, diethyl phthalate, and the like, as well as ethyl acetate, cyclohexanone, and the like; from which an emulsion dispersion is mechanically produced.

As solid particle dispersion method, there can be mentioned a method comprising dispersing the powder of the thermal solvent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surface active agent (for instance, an anionic surface active agent such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in a range of from 1 ppm to 1000 ppm. It is practically acceptable so long as Zr is incorporated in an amount of 0.5 mg or less with respect to 1 g of silver.

Preferably, a preservative (for instance, sodium benzoisothiazolinone salt) is added in the water dispersion. In the invention, furthermore, the thermal solvent is preferably used as solid dispersion.

6. Antifogging Agent

As the antifogging agent, stabilizing agent, and stabilizing agent precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, in U.S. Pat. No. 6,083,681, and in EP-A No. 1048975. Furthermore, the antifogging agent preferably used in the invention is an organic halogen compound, and those disclosed in paragraph Nos. 0111 to 0112 of JP-A No. 11-65021 can be enumerated as examples thereof. In particular, the organic halogen compound expressed by formula (P) in JP-A No. 2000-284399, the organic polyhalogen compound expressed by formula (II) in JP-A No. 10-339934, and organic polyhalogen compounds described in JP-A Nos. 2001-31644 and 2001-33911 are preferred.

1) Organic Polyhalogen Compound

Organic polyhalogen compounds preferably used in the invention are specifically described below. In the invention, preferred polyhalogen compounds are the compounds expressed by general formula (H) below:

General formula (H)

$$Q\text{-}(Y)_n\text{—}C(Z_1)(Z_2)X$$

In general formula (H), Q represents an alkyl group, an aryl group, or a heterocyclic group; Y represents a divalent connecting group; n represents 0 or 1; $Z_1$ and $Z_2$ represent a halogen atom; and X represents hydrogen atom or an electron attracting group.

In general formula (H), Q is preferably an aryl group or a heterocyclic group.

In the case Q is a heterocyclic group in general formula (H), it preferably is a nitrogen-containing heterocyclic group having 1 or 2 nitrogen atoms, and particularly preferred are 2-pyridyl group and 2-quinolyl group.

In the case Q is an aryl group in general formula (H), Q preferably is a phenyl group substituted by an electron-attracting group whose Hammett substitution coefficient σp yields a positive value. For the details of Hammett substitution coefficient, reference can be made to Journal of Medicinal Chemistry, Vol. 16, No. 11 (1973), pp. 1207 to 1216, and the like. As such electron-attracting groups, examples include, halogen atoms (fluorine atom (σp value: 0.06), chlorine atom (σp value: 0.23), bromine atom (σp value: 0.23), iodine atom (σp value: 0.18)), trihalomethyl groups (tribromomethyl (σp value: 0.29), trichloromethyl (σp value: 0.33), trifluoromethyl (σp value: 0.54)), a cyano group (σp value: 0.66), a nitro group (σp value: 0.78), an aliphatic aryl or heterocyclic sulfonyl group (for example, methanesulfonyl (σp value: 0.72)), an aliphatic aryl or heterocyclic acyl group (for example, acetyl (σp value: 0.50) and benzoyl (σp value: 0.43)), an alkinyl (e.g., C≡CH (σp value: 0.23)), an aliphatic aryl or heterocyclic oxycarbonyl group (e.g., methoxycarbonyl (σp value: 0.45) and phenoxycarbonyl (σp value: 0.44)), a carbamoyl group (σp value: 0.36), sulfamoyl group (σp value: 0.57), sulfoxido group, heterocyclic group, and phosphoryl group. Preferred range of the σp value is from 0.2 to 2.0, and more preferably, from 0.4 to 1.0. Preferred as the electron-attracting groups are carbamoyl group, an alkoxycarbonyl group, an alkylsulfonyl group, and an alkylphosphoryl group, and particularly preferred among them is carbamoyl group.

X preferably is an electron-attracting group, more preferably, a halogen atom, an aliphatic aryl or heterocyclic sulfonyl group, an aliphatic aryl or heterocyclic acyl group, an aliphatic aryl or heterocyclic oxycarbonyl group, carbamoyl group, or sulfamoyl group; particularly preferred among them is a halogen atom. Among halogen atoms, preferred are chlorine atom, bromine atom, and iodine atom; more preferred are chlorine atom and bromine atom; and particularly preferred is bromine atom.

Y preferably represents —C(═O)—, —SO—, or —$SO_2$—; more preferably, —C(═O)— or —$SO_2$—; and particularly preferred is —$SO_2$—. n represents 0 or 1, and preferred is 1.

In the invention, particularly preferred organic polyhalogen compound is such whose Q is a heterocyclic group. In particular, Q preferably is a nitrogen-containing heterocyclic group having 1 to 3 nitrogen atoms, and particularly preferred are 2-pyridyl group and 2-quinolyl group.

Specific examples of the compounds expressed by general formula (H) of the invention are shown below.

(H-1)

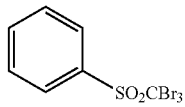

(H-2)

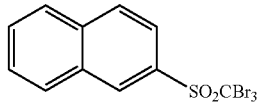

(H-3)

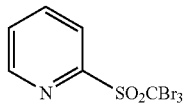

(H-4)

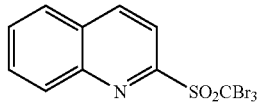

(H-5)

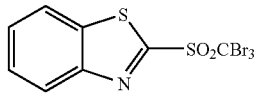

(H-6)

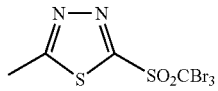

(H-7)

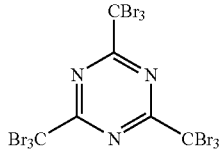

(H-8)

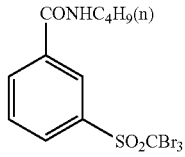

(H-9)

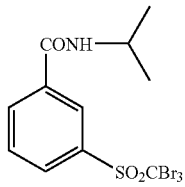

-continued (H-10)

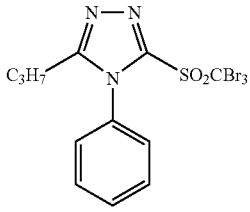

(H-11)

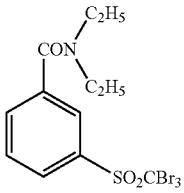

(H-12)

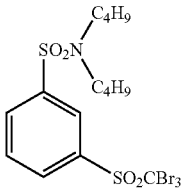

(H-13)

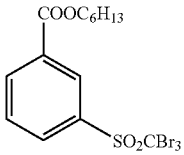

(H-14)

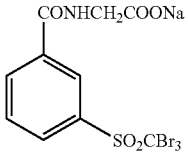

(H-15)

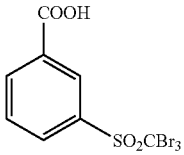

(H-16)

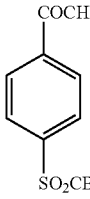

(H-17)

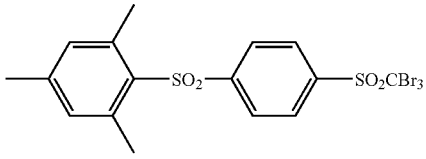

-continued (H-18)

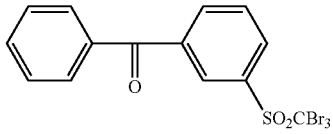

(H-19)

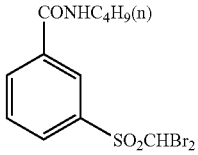

(H-20)

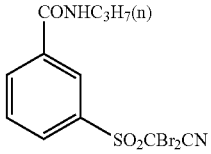

(H-21)

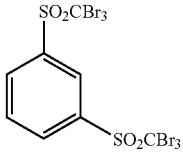

(H-22)

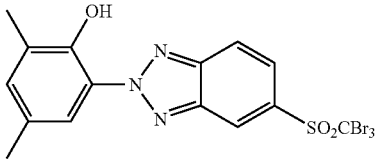

(H-23)

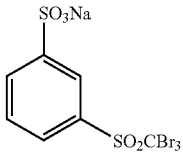

(H-24)

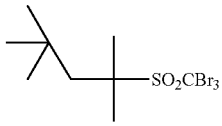

As preferred polyhalogen compounds of the invention other than those above, there can be mentioned compounds disclosed in JP-A Nos. 2001-31644, 2001-56526, and 2001-209145.

The compounds expressed by general formula (H) of the invention are preferably used in an amount of from $10^{-4}$ to 1 mol, more preferably, $10^{-3}$ mol to 0.5 mol, and most preferably, $1\times10^{-2}$ mol to 0.2 mol, per one mol of non-photosensitive silver salt incorporated in the image forming layer.

In the invention, usable methods for incorporating the antifogging agent into the photosensitive material are those described above in the method for incorporating the reducing agent; similarly, for the organic polyhalogen compound, it is preferably added in the form of a solid particle dispersion.

2) Other Antifogging Agents

As other antifogging agents, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by general formula (S) in JP-A No. 2000-221634, a triazine compound related to claim 9 of JP-A No. 11-352624, a compound expressed by general formula (III), 4-hydroxy-6-methyl-1,3,3a, 7-tetrazaindene and the like, as described in JP-A No. 6-11791.

The photothermographic material of the invention may further contain an azolium salt in order to prevent fogging. As azolium salts, there can be mentioned a compound expressed by general formula (XI) as described in JP-A No. 59-193447, a compound described in JP-B No. 55-12581, and a compound expressed by general formula (II) in JP-A No. 60-153039. The azolium salt may be added to any part of the photosensitive material, but as the addition layer, preferred is to select a layer on the side having thereon the photosensitive layer, and more preferred is to select a layer containing organic silver salt. The azolium salt may be added at any time of the process of preparing the coating solution; in the case the azolium salt is added into the layer containing the organic silver salt, any time of the process may be selected, from the preparation of the organic silver salt to the preparation of the coating solution, but preferred is to add the salt after preparing the organic silver salt and just before the coating. As the method for adding the azolium salt, any method using a powder, a solution, a fine-particle dispersion, and the like, may be used. Furthermore, it may be added as a solution having mixed therein other additives such as sensitizing agents, reducing agents, tone adjusting agents, and the like. In the invention, the azolium salt may be added at any amount, but preferably, it is added in a range of from $1\times10^{-6}$ mol to 2 mol, and more preferably, from $1\times10^{-3}$ mol to 0.5 mol per one mol of silver.

7. Hydrogen Bonding Compound

In the invention, it is preferred to use in combination, a non-reducing compound having a group capable of reacting with an aromatic hydroxyl group (—OH) of the reducing agent group, and that is also capable of forming a hydrogen bond therewith. As a group forming a hydrogen bond with a hydroxyl groups, there can be mentioned a phosphoryl group, a sulfoxido group, a sulfonyl group, a carbonyl group, an amido group, an ester group, an urethane group, an ureido group, a tertiary amino group, a nitrogen-containing aromatic group, and the like. Particularly preferred among them is phosphoryl group, sulfoxido group, amido group (not having >N—H moiety but being blocked in the form of >N—Ra (where, Ra represents a substituent other than H)), urethane group (not having >N—H moiety but being blocked in the form of >N—Ra (where, Ra represents a substituent other than H)), and ureido group (not having >N—H moiety but being blocked in the form of >N—Ra (where, Ra represents a substituent other than H)).

In the invention, particularly preferred as the hydrogen-bonding compound is the compound expressed by general formula (D) shown below.

General formula (D)

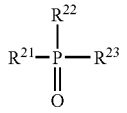

In general formula (D), $R^{21}$ to $R^{23}$ each independently represent an alkyl group, an aryl group, an alkoxy group, an aryloxy group, an amino group, or a heterocyclic group, which may be substituted or not substituted. In the case $R^{21}$ to $R^{23}$ contain a substituent, examples of the substituents include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, t-butyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, 2-phenoxypropyl group, and the like. As aryl groups, there can be mentioned phenyl group, cresyl group, xylyl group, naphthyl group, 4-t-butylphenyl group, 4-t-octylphenyl group, 4-anisidyl group, 3,5-dichlorophenyl group, and the like. As alkoxyl groups, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like. As aryloxy groups, there can be mentioned phenoxy group, cresyloxy group, isopropylphenoxy group, 4-t-butylphenoxy group, naphthoxy group, biphenyloxy group, and the like. As amino groups, there can be mentioned are dimethylamino group, diethylamino group, dibutylamino group, dioctylamino group, N-methyl-N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by general formula (D) of the invention and others are shown below, but it should be understood that the invention is not limited thereto.

(D-1)

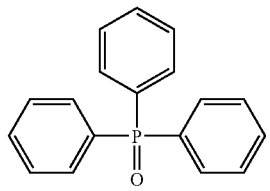

-continued
(D-2)
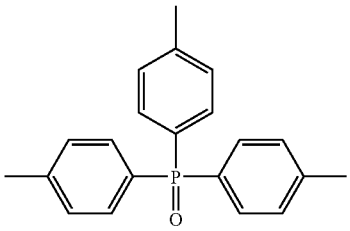
(D-3)
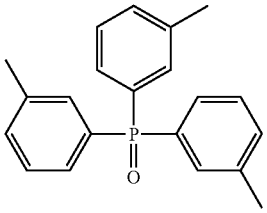
(D-4)
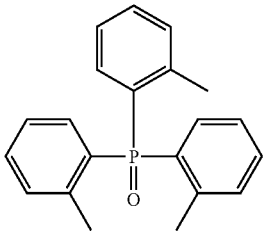
(D-5)
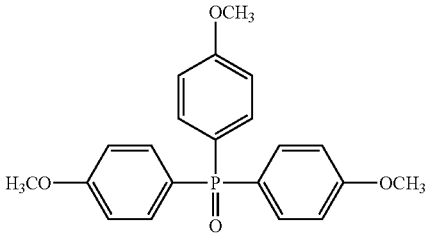
(D-6)
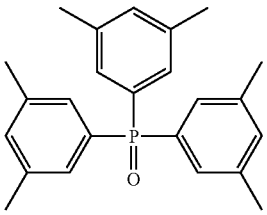
(D-7)
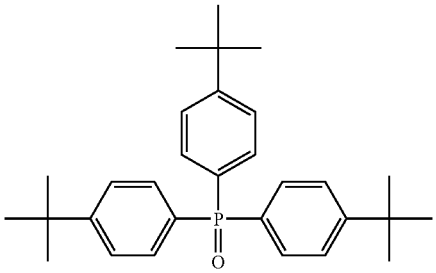
-continued
(D-8)
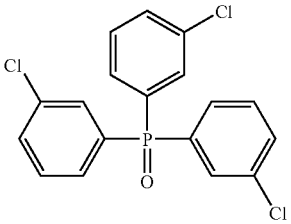
(D-9)
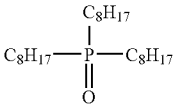
(D-10)
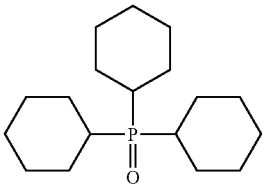
(D-11)
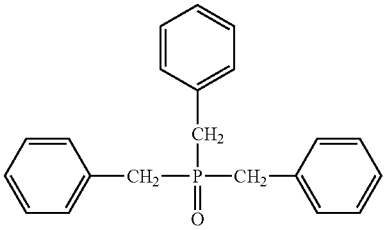
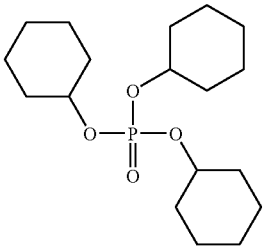
(D-13)
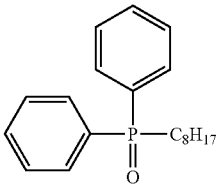
(D-14)
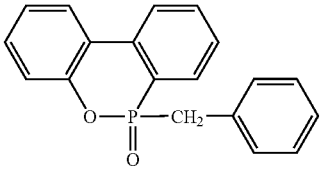
(D-15)
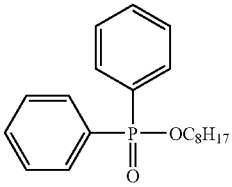

-continued (D-16)

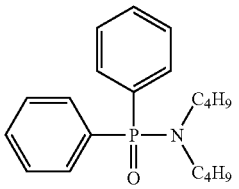

(D-17)

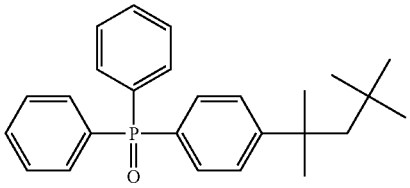

(D-18)

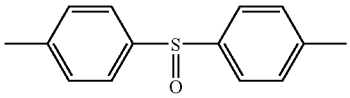

(D-19)

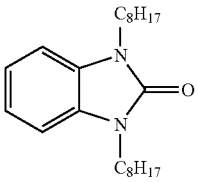

(D-20)

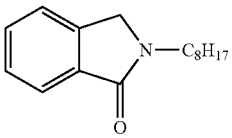

(D-21)

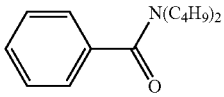

Specific examples of hydrogen bonding compounds other than those enumerated above can be found in those described in EP-A No. 1096310 and in Japanese Patent Application Nos. 2000-270498 and 2001-124796.

The compound expressed by general formula (D) used in the invention can be used in the photosensitive material by being incorporated into the coating solution in the form of solution, emulsion dispersion, or solid-dispersed fine particle dispersion similar to the case of reducing agent, however, it is preferred to be used after it is prepared in the form of solution. In the solution, the compound expressed by general formula (D) forms a hydrogen-bonded complex with a compound having a phenolic hydroxyl group, and can be isolated as a complex in crystalline state depending on the combination of the reducing agent and the compound expressed by general formula (D). It is particularly preferred to use the crystal powder thus isolated in the form of a solution by dissolving it into a coating solvent, because it provides stable performance.

The compound expressed by general formula (D) is preferably used in a range of from 1 to 200 mol %, more preferably from 10 to 150 mol %, and most preferably, from 20 to 100 mol %, with respect to the reducing agent.

8. Binder

Any type of polymer may be used as the binder for the image forming layer in the photosensitive material of the invention. Suitable as the binder are those that are transparent or translucent, and that are generally colorless, such as natural resin or polymer and their copolymers; synthetic resin or polymer and their copolymer; or media forming a film; for example, included are gelatin, rubber, poly(vinyl alcohol), hydroxyethyl cellulose, cellulose acetate, cellulose acetate butyrate, poly(vinyl pyrrolidone), casein, starch, poly(acrylic acid), poly(methylmethacrylic acid), poly(vinyl chloride), poly(methacrylic acid), styrene-maleic anhydride copolymers, styrene-acrylonitrile copolymers, styrene-butadiene copolymers, poly(vinyl acetal) (e.g., poly(vinyl formal) and poly(vinyl butyral)), poly(ester), poly(urethane), phenoxy resin, poly(vinylidene chloride), poly(epoxide), poly(carbonate), poly(vinyl acetate), poly(olefin), cellulose esters, and poly(amide).

If necessary, two or more binders may be used. In such a case, two types or more of polymers differing in glass transition temperature (which is denoted Tg hereinafter) may be blended for use.

In the specification, Tg was calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n. Values for the glass transition temperature (Tgi) of the homopolymers derived from each of the monomers were obtained from J. Brandrup and E. H. Immergut, Polymer Handbook (3rd Edition)(Wiley-Interscience, 1989).

1) Binder For Organic Solvents

In the case the binder is applied by using the following organic solvents, any of those below can be selected: polyvinyl acetal, polyvinyl chloride, polyvinyl acetate, cellulose acetate, polyolefin, polyester, polystyrene, polyacrylonitrile, polycarbonate, polyvinyl butyral, butylethyl cellulose, metacrylate copolymer, maleic anhydride ester copolymers, polystyrene and butadiene-styrene copolymers, and the like. Among them, preferred as the binder are polyvinyl butyral, cellulose acetate, cellulose butyrate, or the derivatives thereof. As a matter of course, copolymers and terpolymers are also included. Specific examples are given below, but it should be understood that the invention is not limited thereto.

1. Polyvinyl butyral
2. Polyvinyl butyral carboxyl group derivative (monomer: carboxyl group=1:1)
3. Polyvinyl butyral carboxyl group derivative (monomer: carboxyl group=1:2)
4. Polyvinyl butyral amino group derivative (monomer: amino group=1:1)
5. Polyvinyl butyral amino group derivative (monomer: amino group=1:2)
6. Polyvinyl butyral carboxyl group, amino group derivative (monomer:carboxyl group:amino group=1:1:1)
7. Polystyrene amino group derivative (monomer:amino group=1:1)
8. Polystyrene amino group derivative (monomer:amino group=1:2)
9. Polystyrene carboxyl group, amino group derivative (monomer:carboxyl group:amino group=1:1:1)
10. Cellulose acetate
11. Cellulose acetate carboxyl group derivative (monomer:carboxyl group=1:1)

12. Cellulose acetate carboxyl group derivative (monomer:carboxyl group=1:2)
13. Cellulose acetate amino group derivative (monomer: amino group=1:1)
14. Cellulose acetate amino group derivative (monomer: amino group=1:2)
15. Cellulose acetate carboxyl group, amino group derivative (monomer:carboxyl group:amino group=1:1:1)
16. Cellulose butyrate
17. Cellulose butyrate carboxyl group derivative (monomer:carboxyl group=1:1)
18. Cellulose butyrate carboxyl group derivative (monomer:carboxyl group=1:2)
19. Cellulose butyrate amino group derivative (monomer: amino group=1:1)
20. Cellulose butyrate amino group derivative (monomer: amino group=1:2)
21. Cellulose butyrate carboxyl group, amino group derivative (monomer:carboxyl group:amino group=1:1:1)

In the image forming layer, in particular, polyvinyl butyral is preferably incorporated as the binder. More specifically, polyvinyl butyral is added as a binder to account for 50% by weight or more with respect to the total composition of the binder for the image forming layer. As a matter of fact, copolymers and terpolymers are also included. The preferred total content of polyvinyl butyral is in a range of 50% by weight to 100% by weight, more preferably, is in a range of 70% by weight to 100% by weight, with respect to the total composition of the binder incorporated in the image forming layer. The Tg of the binder is preferably in a range of from 40 to 90° C., and more preferably, from 50 to 80° C. In the case two types or more of polymers differing in Tg are used in blends, the weight average Tg preferably falls in the above range.

The total amount of the binders is such that, for instance, the component of the image forming layer can be sufficiently maintained within the layer. That is, the binders are used in an amount effective to function as binder. The effective range can be properly determined by those skilled in the art. In the case of holding at least an organic silver salt, the suitable ratio of binders to an orgagnic silver salts is from 15:1 to 1:3, particularly preferably, from 8:1 to 1:2 by weight.

Specific examples of solvents can be found in Solvent Pocket Book (new edition) (Ohm Publishing, 1994), but the invention is not limited thereto. Furthermore, the boiling point of the solvents used in the invention is preferably in a range of 40° C. to 180° C. As examples of the solvents, specifically mentioned are hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, metyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine, water, and the like. Among them, methyl ethyl ketone is preferably used, because it has favorable boiling point and is capable of providing uniform coated film plane with less load of drying and with less solvent residues.

After coating and drying, it is preferred that the solvent used for the coating remains less in the film. In general, residual solvent volatilizes into the environment on exposing or thermal developing the photothermographic material, which not only makes people uncomfortable but also is harmful to the health.

In the case of using MEK in the invention, the residual amount of MEK is preferably in a range of from 0.1 $mg/m^2$ to 150 $mg/m^2$, more preferably, from 0.1 $mg/m^2$ to 80 $mg/m^2$, and most preferably, from 0.1 $mg/m^2$ to 40 $mg/m^2$.

In the invention, it is preferred to prepare a coating solution using the organic solvents above, but it is also possible to prepare a coating solution by using water solvent as described below.

2) Binder For Water Solvent

In the case the layer containing organic silver salt is formed by first applying a coating solution containing 30% by weight or more of water in the solvent and by then drying, and furthermore, in the case the binder of the layer containing organic silver salt is soluble or dispersible in an aqueous solvent (water solvent), the performance can be ameliorated particularly in the case a polymer latex having an equilibrium water content of 2% by weight or lower under 25° C. and 60% RH is used. Most preferred embodiment is such prepared to yield an ion conductivity of 2.5 mS/cm or lower, and as such a preparation method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent. As water-admixing organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term aqueous solvent is also used in the case the polymer is not thermodynamically dissolved, but is present in a so-called dispersed state.

The term "equilibrium water content under 25° C. and 60% RH" as referred herein can be expressed as follows:

Equilibrium water content under 25° C. and 60% RH= $[(W1-W0)/W0]\times 100$ (% by weight)

where, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, 0.01% by weight to 1.5% by weight, and is most preferably, 0.02% by weight to 1% by weight.

Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle size of the dispersed particles is in a range of from 1 to 50,000 nm, preferably 5 nm to 1,000 nm, more preferably, 10 nm to 500 nm, and most preferably, 50 nm to 200 nm. There is no particular limitations concerning particle size distribution of the dispersed particles, and may be widely distributed or may exhibit a monodisperse particle size distribution. From the viewpoint of controlling the physical properties of the coating solution, preferred mode of usage includes mixing two or more types of particles each having monodisperse particle distribution.

In the invention, preferred embodiment of the polymers capable of being dispersed in aqueous solvent includes hydrophobic polymers such as acrylic polymers, poly(ester), rubber (e.g., SBR resin), poly(urethane), poly(vinyl chloride), poly(vinyl acetate), poly(vinylidene chloride), poly (olefin), and the like. As the polymers above, usable are straight chain polymers, branched polymers, or crosslinked polymers; also usable are the so-called homopolymers in which single monomer is polymerized, or copolymers in which two or more types of monomers are polymerized. In the case of a copolymer, it may be a random copolymer or a block copolymer. The molecular weight of these polymers is, in number average molecular weight, in a range of from 5,000 to 1000,000, preferably from 10,000 to 200,000. Those having too small molecular weight exhibit insufficient mechanical strength on forming the image forming layer, and those having too large molecular weight are also not preferred because the filming properties result poor. Further, crosslinking polymer latexes are particularly preferred for use.

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)- (molecular weight 40000, Tg 59° C.)

P-3; Latex of -St(50)-Bu(47)-MAA(3)-(crosslinking, Tg −17° C.)

P-4; Latex of -St(68)-Bu(29)-AA(3)-(crosslinking, Tg 17° C.)

P-5; Latex of -St(71)-Bu(26)-AA(3)-(crosslinking, Tg 24° C.)

P-6; Latex of -St(70)-Bu(27)-IA(3)-(crosslinking)

P-7; Latex of -St(75)-Bu(24)-AA(1)-(crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)-(crosslinking)

P-10; Latex of -VC(50)-MMA(20)-EA(20)-AN(5)-AA(5)-(molecular weight 80000)

P-11; Latex of -VDC(85)-MMA(5)-EA(5)-MAA(5)-(molecular weight 67000)

P-12; Latex of -Et(90)-MAA(10)-(molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)-AA(3)-(crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of poly(ester), there can be mentioned FINETEX ES650, 611, 675, and 850 (all manufactured by Dainippon Ink and Chemicals, Inc.), WD-size and WMS (all manufactured by Eastman Chemical Co.), and the like; as examples of poly (urethane), there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latexes above may be used alone, or may be used by blending two types or more depending on needs.

Particularly preferred as the polymer latex for use in the invention is that of styrene-butadiene copolymer. The weight ratio of monomer unit for styrene to that of butadiene constituting the styrene-butadiene copolymer is preferably in a range of from 40:60 to 95:5. Further, the monomer unit of styrene and that of butadiene preferably accounts for 60 to 99% by weight with respect to the copolymer. Moreover, the polymer latex of the invention contains acrylic acid or methacrylic acid, preferably, for 1 to 6% by weight, and more preferably, for 2 to 5% by weight, with respect to the total mass of the monomer unit of styrene and that of butadiene. The polymer latex of the invention preferably contains acrylic acid. The preferred range of the molecular weight is the same as that described above.

As the latex of styrene-butadiene copolymer preferably used in the invention, there can be mentioned P-3 to P-8 and P-15, or commercially available LACSTAR-3307B, 7132C, Nipol Lx416, and the like.

In the layer containing organic silver salt of the photosensitive material according to the invention, if necessary, there can be added hydrophilic polymers such as gelatin, polyvinyl alcohol, methyl cellulose, hydroxypropyl cellulose, carboxymethyl cellulose, and the like. The hydrophilic polymers above are added at an amount of 30% by weight or less, preferably 20% by weight or less, with respect to the total weight of the binder incorporated in the layer containing organic silver salt.

The layer containing organic silver salt is, in general, a photosensitive layer (image forming layer) containing a photosensitive silver halide, i.e., the photosensitive silver salt; in such a case, the weight ratio for total binder to silver halide is in a range of from 400 to 5, more preferably, from 200 to 10.

In the case water solvent is used for the preparation, the total binder content in the image forming layer is preferably in a range of from 0.2 g/m$^2$ to 30 g/m$^2$, more preferably from 1 g/m$^2$ to 15 g/m$^2$, and most preferably, from 2 g/m$^2$ to 10 g/m$^2$. In the image forming layer of the invention, there may be added a crosslinking agent for crosslinking, or a surface active agent and the like to improve coating properties.

9. Surface Active Agent

As the surface active agent, the solvent, the support, antistatic agent or the electrically conductive layer, and the method for obtaining color images applicable in the invention, there can be mentioned those disclosed in paragraph Nos. 0132, 0133, 0134, 0135, and 0136, respectively, of JP-A No. 11-65021. The lubricant is described in paragraph Nos. 0061 to 0064 of JP-A No. 11-84573 and in paragraph Nos. 0049 to 0062 of Japanese Patent Application No. 11-106881.

In the invention, preferably used are fluorocarbon surface active agent. Explanation on the fluorocarbon compound preferably used in the invention is given below.

The photosensitive material of the invention preferably contains a fluorocarbon compound having at least one fluoroalkyl group having two or more carbon atoms and 13 or less fluorine atoms, and having at least either one of anionic or nonionic hydrophilic groups.

The fluorocarbon compound favorably used in the invention may be of any structure, so long as it contains one or more fluoroalkyl group above, and either of an anionic hydrophilic group or a nonionic hydrophilic group.

The fluoroalkyl group contains 13 or less fluorine atoms, but it preferably contains 3 to 12, more preferably, 5 to 9 fluorine atoms. It has two or more carbon atoms, but preferably it has 4 to 16, more preferably 5 to 12, and most preferably, 6 to 10 carbon atoms.

As specific examples of the fluoroalkyl groups, there can be mentioned those below.

—$C_2F_5$ group, —$C_3F_7$ group, —$C_4F_9$ group, —$C_5F_{11}$ group, —$CH_2$—$C_4F_9$ group, —$C_4F_8$—H group, —$C_2H_4$—$C_4F_9$ group, —$C_4H_8$—$C_4F_9$ group, —$C_6H_{12}$—$C_4F_9$ group, —$C_8H_{16}$—$C_4F_9$ group, —$C_4H_8$—$C_2F_5$ group, —$C_4H_8$-$C_3F_7$ group, —$C_4H_8$—$C_5F_{11}$ group, —$C_8H_{16}$—$C_2F_5$ group, —$C_2H_4$—group, —$C_2H_4$—$C_4F_8$—H group, —$C_4H_8$—$C_4F_8$—H group, —$C_6H_{12}$—$C_4F_8$—H group, —$C_6H_{12}$—$C_2F_4$—H group, —$C_8H_{16}$—$C_2F_4$—H group, —$C_6H_{12}$—$C_4F_8$—$CH_3$ group, —$C_2H_4$—$C_3F_7$ group, —$C_2H_4$—$C_5F_{11}$ group, —$C_4H_8$—$CF(CF_3)_2$ group, —$CH_8CF_2$ group, —$C_4H_8$—$CH(C_2F_5)_2$ group, —$C_4H_8$—$CH(CF_3)_2$ group, —$C_4H_8$—$C(CF_3)_3$ group, —$CH_2$—$C_4F_8$—H group, —$CH_2$—$C_6F_{12}$—H group, and —$CH_2$—$CH_2$—$C_6F_{13}$ group.

The fluorocarbon compound for use in the photosensitive material of the invention preferably contains two or more fluoroalkyl groups having two or more carbon atoms and 13 or less fluorine atoms. From the viewpoint of ease in synthesis, the two or more fluoroalkyl groups are preferably the same.

The fluorocarbon compound more preferred in the invention is expressed by the general formula (F) below.

General formula (F)

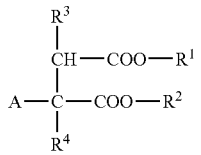

In general formula (F), $R^1$ and $R^2$ each independently represent an alkyl group, but at least one of them represents a fluoroalkyl group having two or more carbon atoms and 13 or less fluorine atoms. In the case $R^1$ and $R^2$ represent an alkyl group other than fluoroalkyl group, the alkyl group preferably has 2 to 18 carbon atoms, more preferably, 4 to 12 carbon atoms. $R^3$ and $R^4$ each independently represent a hydrogen atom or a substituted or a non-substituted alkyl group.

Specific examples of the fluoroalkyl group expressed by $R^1$ and $R^2$ are those enumerated above, and similarly, preferred structure is expressed by general formula (1) above. Among them, the preferred structure is the same as that described in the case of fluoroalkyl group. Preferably, both of the alkyl groups expressed by $R^1$ and $R^2$ are the fluoroalkyl groups described above.

The substituted or non-substituted alkyl groups expressed by $R^3$ and $R^4$ may be in the form of straight chain, branched chain, or ring structure. Any type of substituent is suitable for the substituent above, but preferred are alkenyl group, aryl group, alkoxy group, halogen atoms (preferably Cl), carboxylate group, carbonamide group, carbamoyl group, oxycarbonyl group, phosphate group, and the like.

One of A and B represents a hydrogen atom, and the other represents -$L_b$-$SO_3M$, wherein M represents a hydrogen atom, a metallic element, or an ammonio group. As examples of preferred metallic element or ammonio group expressed by M, for instance, there can be mentioned an alkali metal element (lithium, sodium, potassium, and the like), an alkaline earth metal element (barium, calcium, and the like), an ammonio group, and the like. Among them, more preferred are lithium, sodium, potassium, or ammonio group; most preferred are lithium, sodium, or potassium, which may be properly selected depending on the total number of carbon atoms or substituents, or the branching degree of alkyl groups of the compound expressed by the general formula (F). In the case the total number of carbon atoms of $R^1$, $R^2$, $R^3$, and $R^4$ is 16 or more, lithium is most suited from the viewpoint of solubility (particularly with respect to water), and of achieving both antistatic function and formation of uniform coating.

$L_b$ represents a single bond, or a substituted or non-substituted alkylene group. As the substituents, those enumerated for $R^3$ are preferred. In the case $L_b$ represents an alkylene group, the number of carbon atoms is preferably 2 or less. $L_b$ is preferably a single bond or a —$CH_2$— group, and most preferably, is a —$CH_2$— group.

In general formula (F), more preferred is to combine each of the preferred embodiments above.

Specific examples of the fluorocarbon compounds of the invention are shown below, but the invention is by no means limited thereby.

In the structures of the exemplified compounds below, alkyl group and perfluoroalkyl group have the straight chain structure unless otherwise stated.

(F-1)

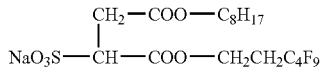

(F-2)

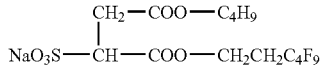

(F-3)

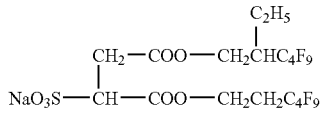

-continued (F-4)

$NaO_3S-CH(CH_2-COO-C_{12}H_{25})-COO-CH_2CH_2C_4F_9$ (F-5)

$NaO_3S-CH(CH_2-COO-C_8H_{17})-COO-CH_2(CF_2CF_2)_2H$ (F-6)

$NaO_3S-CH(CH_2-COO-C_8H_{17})-COO-CH_2(CF_2CF_2)_3H$ (F-7)

$NaO_3S-CH(CH_2-COO-CH_2CH_2C_4F_9)-COO-C_6H_{13}$ (F-8)

$NaO_3S-CH(CH_2-COO-CH_2(CF_2CF_2)_2H)-COO-CH_2CH(C_2H_5)C_4H_9$ (F-9)

$NaO_3S-CH(CH_2-COO-C_8H_{17})-COO-CH_2C_5F_{11}$ (F-10)

$NaO_3S-CH(CH_2-COO-C_4H_9)-COO-CH_2CH_2(CF_2CF_2)_3H$ (F-11)

$NaO_3S-CH(CH_2-COO-C_{10}H_{21})-COO-C_4F_9$ (F-12)

n = 5 ~ 15

$NaO_3S-CH(CH_2-COO-(CH_2CH_2O)-C_4H_9)-COO-CH_2CH_2C_4F_9$ (F-13)

$NaO_3SCH_2-CH(CH_2-COO-C_8H_{17})-COO-CH_2CH_2C_4F_9$ (F-14)

$NaO_3SCH_2-CH(CH_2-COO-CH_2CH_2C_4F_9)-COO-C_{12}H_{25}$ (F-15)

$NaO_3SCH_2-CH(CH_2-COO-C_8H_{17})-COO-CH_2(CF_2CF_2)_2H$ (F-16)

$NaO_3SCH_2-CH(CH_2-COO-CH_2(CF_2CF_2)_3H)-COO-CH_2CH(C_2H_5)C_4H_9$ (F-17)

$NaO_3S-CH(CH_2-COO-CH_2CH_2C_4F_9)-COO-CH_2CH_2C_4F_9$ (F-18)

$NaO_3S-CH(CH_2-COO-CH_2CH_2C_3F_7)-COO-CH_2CH_2C_3F_7$ (F-19)

$NaO_3S-CH(CH_2-COO-CH_2CH_2C_5F_{11})-COO-CH_2CH_2C_5F_{11}$ (F-20)

$NaO_3S-CH(CH_2-COO-CH_2C_4F_9)-COO-CH_2C_4F_9$ (F-21)

$NaO_3S-CH(CH_2-COO-C_4F_9)-COO-C_4F_9$

-continued (F-22)

$NaO_3S-CH(CH_2-COO-C_4F_9)-COO-CH_2CH_2C_4F_9$ (F-23)

$NaO_3S-CH(CH_2-COO-CH_2CH_2CF(CF_3)_2)-COO-CH_2CH_2CF(CF_3)_2$ (F-24)

$NaO_3S-CH(CH_2-COO-CH_2CH_2C_2F_5)-COO-CH_2CH_2C_4F_9$ (F-25)

$NaO_3S-CH(CH_2-COO-CH_2(CF_2CF_2)_2H)-COO-CH_2(CF_2CF_2)_2H$ (F-26)

$NaO_3S-CH(CH_2-COO-CH_2(CF_2CF_2)_3H)-COO-CH_2(CF_2CF_2)_3H$ (F-27)

$NaO_3S-CH(CH_2-COO-CH_2CF_2CF_2H)-COO-CH_2(CF_2CF_2)_3H$ (F-28)

n = 5 ~ 15

$NaO_3S-CH(CH_2-COO-(CH_2CH_2O)_nC_4H_9)-COO-(CH_2CH_2O)_nC_4H_9$ (F-29)

$NaO_3SCH_2-CH(CH_2-COO-CH_2CH_2C_4F_9)-COO-CH_2CH_2C_4F_9$ (F-30)

$NaO_3SCH_2-CH(CH_2-COO-CH_2CH_2C_3F_7)-COO-CH_2CH_2C_3F_7$ (F-31)

$NaO_3SCH_2-CH(CH_2-COO-CH_2CH_2C_5F_{11})-COO-CH_2CH_2C_5F_{11}$ (F-32)

$NaO_3SCH_2-CH(CH_2-COO-CH_2CH_2C_6F_{13})-COO-CH_2CH_2C_6F_{13}$ (F-33)

$NaO_3SCH_2-CH(CH_2-COO-CH_2(CF_2CF_2)_2H)-COO-CH_2(CF_2CF_2)_2H$ (F-34)

$NaO_3SCH_2-CH(CH_2-COO-CH_2(CF_2CF_2)_3H)-COO-CH_2(CF_2CF_2)_3H$ (F-35)

$NaO_3SCH_2-CH(CH_2-COO-CH_2CF_2CF_2H)-COO-CH_2(CF_2CF_2)_3H$ (F-36)

$NaO_3SCH_2-CH(CH_2-COO-CH_2CH_2CF(CF_3)_2)-COO-CH_2CH_2CF(CF_3)_2$ (F-37)

$NaO_3SCH_2-CH(CH_2-COO-CH_2CH(C_2F_5)_2)-COO-CH_2CH(C_2F_5)_2$ (F-38)

$NaO_3S-CH(CH_3)-CH(COO-CH_2CH_2C_4F_9)-COO-CH_2CH_2C_4F_9$

-continued (F-39)

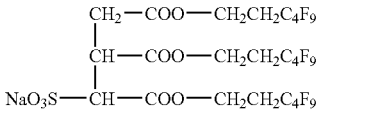

(F-40)

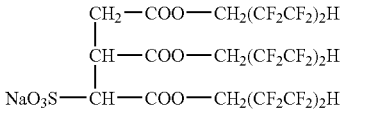

(F-41)

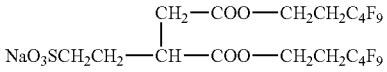

(F-42)

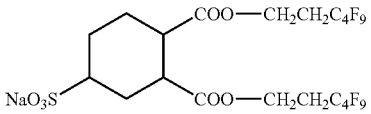

(F-43)

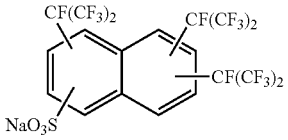

(F-44)

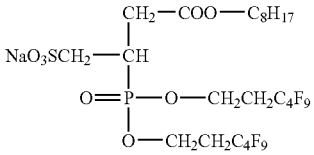

(F-45)

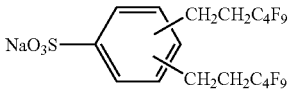

(F-46)

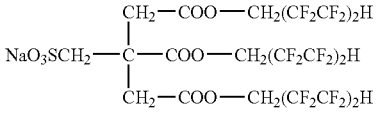

(F-47)

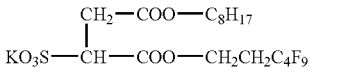

(F-48)

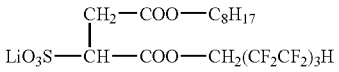

(F-49)

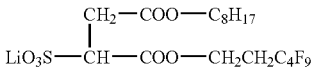

(F-50)

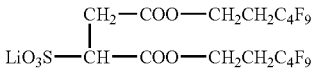

(F-51)

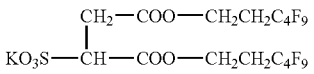

(F-52)

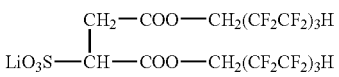

(F-53)

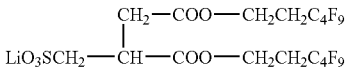

-continued (F-54)

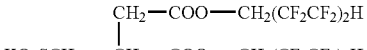

(F-55)

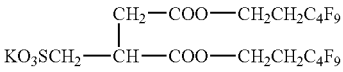

(F-56)

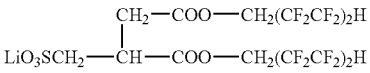

The compound having a fluoroalkyl group favorably used in the photothermographic material according to the invention can be preferably utilized as the surface active agent of the coating composition for forming the layers (in particular, the protective layer, undercoating layer, back layer, and the like) constituting the silver halide photosensitive material. In the case the compound is used for the formation of the hydrophilic colloid layer of the uppermost layer of the photographic photosensitive material, it is particularly preferred from the viewpoint of achieving effective antistatic function and of obtaining uniform coating. The fluorocarbon compound for use in the invention is useful from the viewpoint of showing similar effect, but by realizing the structure above, it has been found further that it is effective for improving storage stability as well as dependency on the using environment, which are the object of the invention. In order to obtain the effect, the fluorocarbon compound used in the invention is preferably contained in the layers same side as a image forming layer and/or the outermosut layer of the back side. Simlar effect can be achieved by employing it in the support undercoat layer.

The coating composition containing fluorocarbon compound for use in the invention is explained below.

The aqueous coating composition containing the fluorocarbon compound for use in the invention contains a medium for dissolving and/or dispersing the fluorocarbon compound. It can also contain surface active agents other than the ones according to the invention if required. In addition, it can appropriately contain other components according to a purpose. As the medium for use in the aqueous coating composition of the invention, preferred is an aqueous medium. Aqueous medium includes water and a mixed solvent of organic solvents other than water (for instance, methanol, ethanol, isopropyl alcohol, n-butanol, methyl cellosolve, dimethylformamide, acetone, and the like) mixed with water.

In the invention, one type of the fluorocarbon compound above may be used alone, or two or more types thereof may be used as a mixture. Other surface active agents may be used together with the fluorocarbon compound for use in the invention. As surface active agents usable in combination, there can be mentioned various types of anionic, cationic, and nonionic surface active agents. The surface active agent for use in combination may be polymer surface active agent, or may be a fluorine-based surface active agent other than the fluorocarbon surface active agent. As the surface active agent for use in combination, more preferred are the anionic or nonionic active agents. Examples of usable surface active agent for use in combination include those described in JP-A No. 62-215272 (pages 649-706), Research Disclosure (RD) Items 17643 (pages 26-27, December 1978), 18716 (page 650, November 1979), 307105 (pages 875-876, November 1989), and the like.

As other components usable in combination, polymer compounds may be mentioned as representative examples. The polymer compounds may be a polymer soluble in an aqueous medium (which is referred to hereinafter as "soluble polymer"), or polymer dispersed in water (i.e., a so-called polymer latex). There is no particular restriction for soluble polymers, and examples include gelatin, polyvinyl alcohol, casein, agar, gum arabic, hydroxyethyl cellulose, methyl cellulose, carboxymethyl cellulose, and the like; examples of polymer latexes include various types of vinyl monomers [for instance, an acrylate derivative, a methacrylate derivative, an acrylamide derivative, a methacrylamide derivative, a styrene derivative, a conjugate diene derivative, an N-vinyl compound, an O-vinyl compound, vinyl nitrile, homo- or co-polymers of other vinyl compounds (e.g., ethylene, vinylidene chloride, and the like)], and a dispersion of condensation polymers (e.g., polyester, polyurethane, polycarbonate, polyamide, and the like). Specific examples of those types of polymer compounds can be found in JP-A No. 62-215272 (pages 707-763), Research Disclosure (RD) Items 17643 (page 651, December 1978), 18716 (page 650, November 1979), 307105 (pages 873-874, November 1989), and the like.

The aqueous coating composition containing fluorocarbon compound for use in the invention may contain other types of compounds depending on which layer it is incorporated in the photosensitive material, and the compounds may be dissolved or dispersed in a medium. For instance, the compounds include various types of couplers, UV absorbers, interimage confusion preventives, anti-static agents, scavengers, antifogging agents, hardeners, dyes, fungicides, and the like. As described above, the aqueous coating composition containing the fluorocarbon compound is preferably used for the formation of the uppermost hydrophilic colloid layer of the photographic photosensitive material, but in such a case, the coating composition may contain, in addition to the hydrophilic colloid (e.g., gelatin) and fluorocarbon compound above, other surface active agents, matting agent, slipping agent, colloidal silica, gelatin plasticizer, and the like.

There is no particular limitation concerning the amount of usage of the fluorocarbon compound of the invention; the amount of usage may be determined arbitrarily depending on, for instance, the structure of the compound to be used and the part to be incorporated, types and amounts of other materials incorporated in the composition. For instance, in the case it is used as the coating solution for the hydrophilic colloid (gelatin) layer in the uppermost layer of the photothermographic material, the concentration of the fluorocarbon compound in the coating composition is preferably in a range of from 0.003 to 0.5% by weight, and it preferably accounts for 0.03 to 5% by weight with respect to the solid gelatin content.

10. Antistatic Agent

The photothermographic material of the invention preferably contains an antistatic agent.

As antistatic agents for use in the invention, there can be mentioned an electrically conductive polymers, ionic or nonionic surface active agents, colloidal silica, metal oxides, or the complex oxides thereof. Examples of electrically conductive polymers include those described in JP-A No. 48-22017, JP-B No. 46-24159, JP-A No. 51-30725, JP-A No. 51-129216, JP-A No. 55-95942, JP-A No. 49-3972, JP-A No. 49-121523, JP-A No. 48-91165, JP-B No. 49-24582, JP-A No. 56-117234, and the like. Examples of surface active agents include the compounds described in JP-A No. 49-85826, JP-A No. 49-33630, U.S. Pat. Nos. 2,992,108 and 3,206,312, JP-A No. 48-87826, JP-B No. 49-11567, JP-B No. 49-11568, JP-A No. 55-70837, and the like. Examples also include colloidal silica described in U.S. Pat. No. 3,525,621, alumina sol described in JP-A No. 58-58541, and metal oxides or complex oxides described in JP-A Nos. 56-143430, 56-143431, 57-104931, and 57-118242, and the like.

Particularly preferred as antistatic agents are metal oxides or complex oxides thereof, and specific examples include particles 0.05 to 0.5 μm in average particle size, of at least one type of crystalline metal oxides selected from ZnO, $Tio_2$. $SnO_2$, $Al_2O_3$, $In_2O_3$, MgO, BaO, $MoO_3$, $SiO_2$, and $ZrO_2$, or complex oxides thereof, which contain small amount of different types of atoms. As the combination of different types of atoms, preferred are ZnO combined with Al, In, and the like; $TiO_2$ with Nb, Ta, and the like; $SnO_2$ with Sb, Nb, halogen atoms, and the like. The amount of adding different types of atoms is preferably in a range of from 0.01 to 30 mol %, and particularly preferably, in a range of from 0.1 to 10 mol %. In the case the amount of addition is less than 0.01 mol %, it is not possible to impart sufficient electric conductivity to the oxide or the complex oxide, and in the case the amount is over than 30 mol %, the optical density by the particles increases to blacken the electrically conductive layer, thereby unfeasible for use in photography.

In particular, metal oxides having fibrous crystal morphology disclosed in JP-A No. 4-29134 and metal oxides having acicular crystal morphology disclosed in U.S. Pat. Nos. 5,575,957 and 5,719,016 are preferred because they impart high electric conductivity with small amounts, and hence the vacuum layer is not blackened. Most preferred are cases in which the electrically conductive metal oxide is tin oxide, zinc oxide, titanium oxide, or vanadium pentaoxide. The antistatic agent is used in a range of from 1 $mg/m^2$ to 1 $g/m^2$, preferably in a range of from 50 $mg/m^2$ to 500 $g/m^2$.

11. Dyes

The photothermographic material according to the invention preferably contains dye compounds expressed by general formula (1) below. In general formula (1), $R_a$ and $R_b$ each represent a monovalent substituent. Although there is no particular limitations in monovalent substituent, preferred is an alkyl group (e.g., methyl, ethyl, isopropyl, tert-butyl, methoxyethyl, methoxyethoxyethyl, 2-ethylhexyl, 2-hexyldecyl, benzyl, and the like) or an aryl group (e.g., phenyl, 4-chlorophenyl, 2,6-dimethylphenyl, and the like), but more preferred is that it is an alkyl group, and most preferred is that it is tert-butyl group. $R_a$ and $R_b$ may be combined to form a ring. m and n each represent an integer of 0 to 4, and are preferably 2 or smaller.

General formula (1)

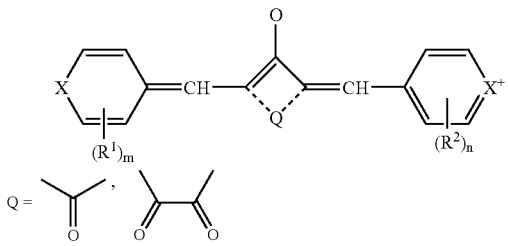

Specific examples of the dyes expressed by general formula (1) for use in the invention are shown below, but it should be understood that the invention is not limited thereto.
1-1
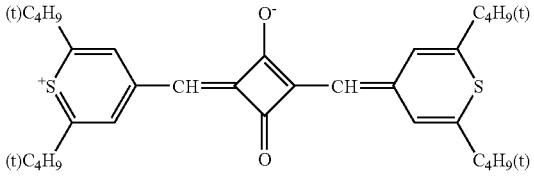
1-2
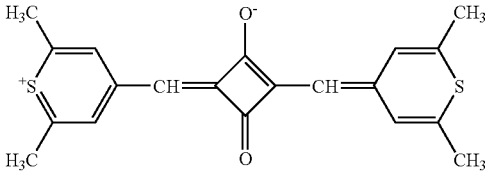
1-3
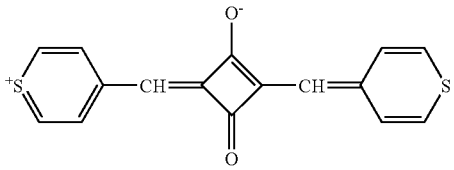
1-4
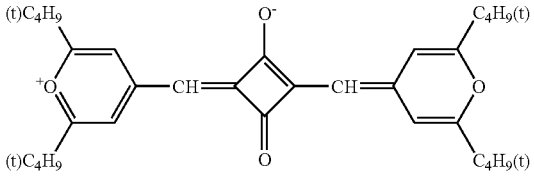
1-5
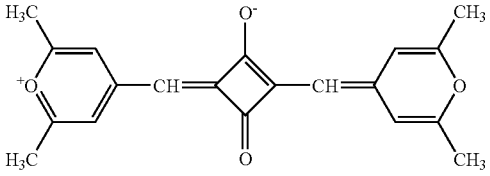
1-6
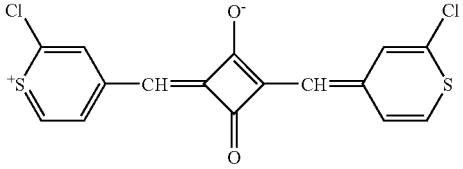
1-7
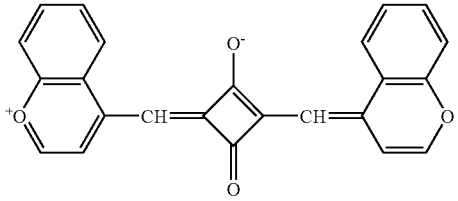
-continued
1-8
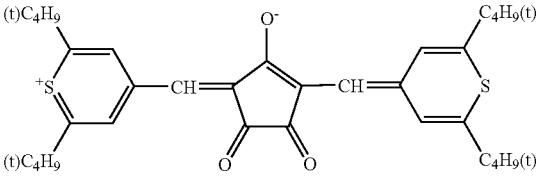
1-9
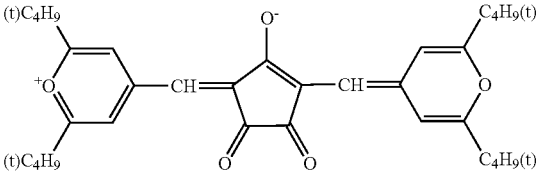
1-10
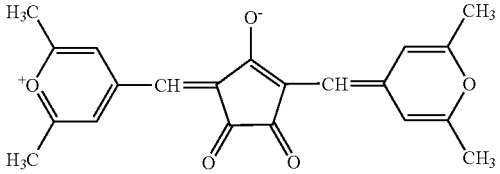
1-11
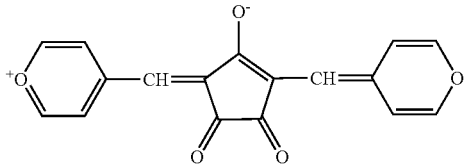
1-12
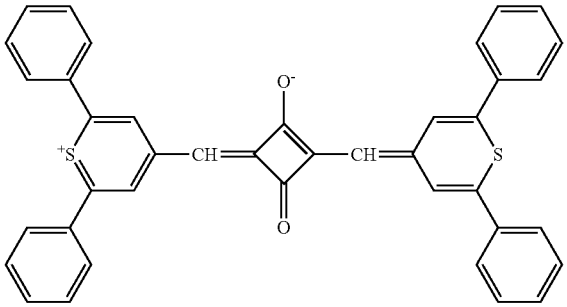
1-13
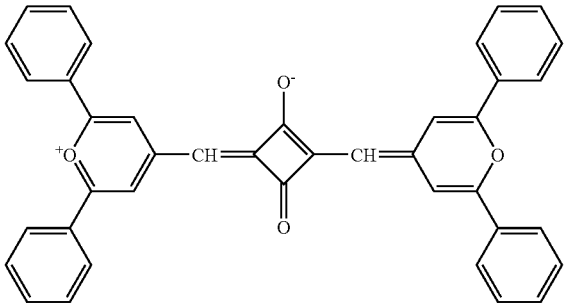
The dyes expressed by general formula (1) for use in the invention may be used alone or in a combination of two or more types. The amount of usage of the dyes of the invention is preferably from 1 μg to $1\times10^6$ μg, and more preferably, from 10 μg to $1\times10^5$ μg.

The dyes expressed by general formula (1) for use in the invention can be synthesized, for example, by a method described in U.S. Pat. No. 4,508,811.

Furthermore, in general, the dyes expressed by general formula (1) for use in the invention can be added in the photothermographic material in the form of a solution by dissolving it in a solvent, however, it can be dispersed on fine particles and added by a so-called solid dispersion method. When the dyes are incorporated in the image forming layer, the effect of suppressing light scattering is the largest, so that a great improvement in sharpness can be achieved. Especially, when the dyes are incorporated in the image forming layer that is spectrally synthesized in such a manner that the maximum spectral sensitization wavelength falls in the infrared region from 780 to 830 nm in wavelength, a greater improvement in sharpness can be achieved.

In the case of using the dyes in the form of a solution in the invention, the solvent of high boiling point is preferable. The solvents of high boiling point are such having boiling points in the temperature not lower than 100° C., preferably not lower than 120° C., and most preferably, not lower than 140° C. There is no particular restriction on the dispersion medium, but as specific examples, there can be mentioned water, gelatin, polymers such as polyvinyl pyrrolidone, the mixtures thereof, and the like.

The dyes above are preferably applied to a photothermographice material spectrally sensitized to near infrared region, and more preferably, they are applied to near-infrared photosensitive photothermographic material having the maximum spectral sensitization wavelength in the region from 780 to 830 nm.

12. Other Additives

1) Mercapto Compounds, Disulfides And Thiones

In the invention, mercapto compounds, disulfide compounds, and thione compounds may be added in order to control the development by suppressing or enhancing development, to improve spectral sensitization efficiency, or to improve storage properties before and after development. Descriptions can be found in paragraph Nos. 0067 to 0069 of JP-A No. 10-62899, a compound expressed by general formula (I) of JP-A No. 10-186572 and specific examples thereof shown in paragraph Nos. 0033 to 0052, and in lines 36 to 56 in page 20 of EP No. 0803764A1. Among them, mercapto-substituted heterocyclic aromatic compound described in JP-A Nos. 9-297367, 9-304875, and 2001-100358, as well as in Japanese Patent Application Nos. 2001-104213 and 2001-104214, and the like, are particularly preferred.

In the case of using mercapto compounds in the invention, they may have any structure, but preferred are those expressed by Ar—SM or Ar—S—S—Ar. In the formula, M represents a hydrogen atom or an alkali metal atom; Ar represents an aromatic ring, a condensed aromatic ring, a heteroaromatic or condensed heteroaromatic ring, having one or more nitrogen, sulfur, oxygen, selenium, or tellurium atom.

Preferably, the heteroaromatic ring is benzimidazole ring, naphthoimidazole ring, benzthiazole ring, naphthothiazole ring, benzoxazole ring, naphthoxazole ring, benzselenazole ring, benztellurazole, imidazole ring, oxazole ring, pyrrazole ring, triazole ring, thiadiazole ring, tetrazole ring, triazine ring, pyrimidine ring, pyridazine ring, pyrazine ring, pyridine ring, purine ring, quinoline ring, or quinazolinone ring.

The heteroaromatic ring may have a substituent selected from, for example, a halogen (e.g., Br and Cl), a hydroxyl group, an amino group, a carboxy group, an alkyl group (e.g., such having 1 or more carbon atom, preferably, such having 1 to 4 carbon atoms), and an alkoxy group (e.g., such having 1 or more carbon atom, preferably, such having 1 to 4 carbon atoms).

As mercapto-substituted heteroaromatic compounds, there can be mentioned 2-mercaptobenzimidazole, 2-mercaptobenzoxazole, 2-mercaptobenzothiazole, 2-mercapto-5-methylbenzimidazole, 6-ethoxy-2-mercaptobenzimidazole, 2,2'-dithiobis-(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 2-mercapto-4-phenyloxazole, and the like, but the invention is not limited thereto.

The amount of adding the mercapto compounds is preferably in a range of from 0.001 to 1.0 mol per 1 mol of silver in the photosensitive layer, and more preferably, 0.01 to 0.3 mol per 1 mole of silver.

2) Toner

In the photothermographic material of the invention, the addition of a toner is preferred, and the description of toners can be found in paragraph Nos. 0054 to 0055 of JP-A No. 10-62899, lines 23 to 48 in page 21 of EP-A No. 0803764A1, and in JP-A Nos. 2000-356317 and 2000-187298. In particular, preferred are phthalazinones (phthalazinone, phthalazinone derivatives or metal salts; for instance, 4-(1-naphthyl)phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (e.g., phthalazine, phthalazine derivatives or metal salts; for instance, 4-(1-naphthyl)phthalazine, 6-isopropylphthalazine, 6-t-butylphthalazine, 6-chlorophthalazine, 5,7-dimethoxyphthalazine, and 2,3-dihydrophthalazine); and combinations of phthalazines with phthalic acids. Particularly preferred among them are combinations of phthalazines with phthalic acids. Among them, particularly preferred combination is the combination of 6-isopropylphthalazine and phthalic acid or 4-methylphthalic acid.

Concerning output images for use in medical imaging, it is said that, for the observers of X-ray photography, image tone having blue-black tone on recorded image enables more accurate diagnostic observation results, wherein the image tone having colder tone signifies pure black or blue-black tone, and on the otherhand image tone having warmer tone signifies warm black tone with tannish black image.

The term related to a tone, i.e., "image tone having colder tone" and "image tone having warmer tone" can be determined by a hue angle (hab) specified in JIS Z 8729. The hue angle hab can be expressed by $hab=\tan^{-1}(b^*/a^*)$ using chromaticity coordinates a* and b* of L*a*b* chromatic system defined in JIS Z 8729, using XYZ chromatic system or tristimulus values X, Y, and Z or X10, Y10, and Z10, which are defined in JIS Z 8701.

In the invention, the hab angle is preferably in a range of 180°<hab<270°, and more preferably, 185°<hab<225°.

3) Benzoic Acids

The photothermographic material of the invention may contain benzoic acids in order to achieve higher sensitivity or to prevent fogging. The benzoic acids for use in the invention may be any type of benzoic acid derivatives, but as examples of preferred structures, mentioned are the compounds described in U.S. Pat. Nos. 4,784,939 and 4,152,160, JP-A Nos. 9-281637, 9-329864, and 9-329865.

The benzoic acids for use in the invention may be added to any part of the photosensitive material, but as the addition layer, preferred is to select a layer on the side having thereon the photosensitive layer, and more preferred is to select a layer containing organic silver salt. The benzoic acids may be added at any time of the process of preparing the coating solution; in the case the benzoic acids are added into the layer containing the organic silver salt, any time of the process may be selected, from the preparation of the organic silver salt to the preparation of the coating solution, but preferred is to be added after preparing the organic silver salt and just before the coating.

As a process for adding the benzoic acids, any process such as a powder addition, a solution addition, an addition by fine-particle dispersion, and the like, may be used. Furthermore, it may be added as a mixed solution with other additives such as sensitizers, reducing agents, toners, and the like.

In the invention, the benzoic acids may be added at any amount, but preferably, it is added in an amount of one micromole (μmol) to two mol, and more preferably, from one mill mole (mmol) to 0.5 mol, with respect to one mol of silver.

4) Dyes and Pigments

From the viewpoint of improving image tone, of preventing the generation of interference fringes and of preventing irradiation on laser exposure, various types of dyes and pigments (for instance, C.I. Pigment Blue 60, C.I. Pigment Blue 64, and C.I. Pigment Blue 15:6) may be used in the photosensitive layer of the invention. Detailed description can be found in WO No. 98/36322, JP-A Nos. 10-268465 and 11-338098, and the like.

The photosensitive layer of the invention preferably has an absorption of 0.1 to 0.6, and more preferably, 0.2 to 0.5, at the exposing wavelength. In the case absorption is large, Dmin increases to make images difficult to discriminate, and in the case absorption is low, sharpness becomes impaired.

Any methods may be employed to impart absorption to the photosensitive layer of the invention, but it is preferred to use a dye.

Usable as the dyes are any of those satisfying the absorption conditions above; for instance, there can be mentioned pyrazoloazole dyes, anthraquinone dyes, azo dyes, azomethine dyes, oxonol dyes, carbocyanine dyes, styryl dyes, triphenylmethane dyes, indoaniline dyes, indophenol dyes, squalilium dyes, and the like. As preferred dyes for use in the invention, there can be mentioned an anthraquinone dye (e.g., compounds 1 to 9 described in JP-A No. 5-341441, compounds 3-6 to 3-18 and 3-23 to 3-38 described in JP-A No. 5-165147, and the like), an azomethine dye (e.g., compounds 17 to 47 described in JP-A No. 5-341441), an indoaniline dye (e.g., compounds 11 to 19 described in JP-A No. 5-289227, compound 47 described in JP-A No. 5-341441, compounds 2-10 to 2-11 described in JP-A No. 5-165147), an azo dye (e.g., compounds 10 to 16 described in JP-A No. 5-341441), and squalilium dye (e.g., compounds 1 to 20 described in JP-A No. 10-104779, and compounds 1a to 3d disclosed in U.S. Pat. No. 5,380,635). These dyes can be added by any means, for instance, in the form of solution, emulsion, solid-dispersed fine particle dispersion, or mordanted by polymer mordant, and the like.

The amount of using these dyes or pigments is determined depending on the targeted absorption; in general, it is preferably used in an amount of 1 μg to 1 g per 1 $m^2$.

5) Ultra-High Contrast Promoting Agent

In order to form ultra-high contrast image suitable for use in graphic arts, it is preferred to add an ultra-high contrast promoting agent into the image forming layer. Details on the ultra-high contrast promoting agents, method of their addition and addition amount can be found in paragraph No. 0118, paragraph Nos. 0136 to 0193 of JP-A No. 11-223898, as compounds expressed by formulae (H), (1) to (3), (A), and (B) in Japanese Patent Application No. 11-87297, as compounds expressed by formulae (III) to (V) (specific compound: chemical No.21 to chemical No.24) in Japanese Patent Application No. 11-91652; as an ultra-high contrast accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide, at an amount of 5 mmol or less, preferably, one mmol or less per one mol of silver.

In the case of using an ultra-high contrast promoting agent in the photothermographic material of the invention, it is preferred to use an acid resulting from hydration of diphosphorus pentaoxide, or its salt in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The amount of usage of the acid obtained by hydration of diphoshorus pentaoxide or the salt thereof (i.e., the coverage per 1 $m^2$ of the photosensitive material) may be set as desired depending on the sensitivity and fogging, but preferred is an amount of 0.1 to 500 mg/$m^2$, and more preferably, of 0.5 to 100 mg/$m^2$.

The reducing agent, hydrogen bonding compound, development accelerating agent, and polyhalogen compounds according to the invention are preferably used as solid dispersions, and the method of preparing the solid dispersion is described in JP-A No. 2002-55405.

6) Plasticizer and Lubricant

Plasticizers and lubricants usable in the photothermographic material of the invention are described in paragraph No. 0117 of JP-A No. 11-65021. Lubricants are described in paragraph Nos. 0061 to 0064 of JP-A No. 11-84573 and in paragraph Nos. 0049 to 0062 of Japanese Patent Application No. 11-106881.

13. Layer Constitution and Other Constituting Components

The image forming layer of the invention is constructed on a support by one or more layers. In the case of constituting the layer by a single layer, it comprises an organic silver salt, photosensitive silver halide, a reducing agent, and a binder, which may further comprise additional materials as desired if necessary, such as a toner, a coating aid, and other auxiliary agents. In the case of constituting the image forming layer from two layers or more, the first image forming layer (in general, a layer placed adjacent to the support) contains an organic silver salt and a photosensitive silver halide, and some of the other components must be incorporated in the second image forming layer or in both of the layers. The constitution of a multicolor photothermographic material may include combinations of two layers for those for each of the colors, or may contain all the components in a single layer as described in U.S. Pat. No. 4,708,928.

In the case of multicolor photothermographic material, each of the image forming layers is maintained distinguished from each other by incorporating functional or non-functional barrier layer between each of the photosensitive layers as described in U.S. Pat. No. 4,460,681.

The photothermographic material according to he invention may have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer provided to the side opposite to the image forming layer.

Furthermore, a layer that functions as an optical filter may be provided as (a) or (b) above. An antihalation layer may be provided as (c) or (d) to the photosensitive material.

1) Surface Protective Layer

The photothermographic material of the invention may further comprise a surface protective layer with an object to prevent adhesion of the image forming layer. The surface protective layer may be a single layer, or plural layers. Description on the surface protective layer may be found in paragraph Nos. 0119 to 0120 of JP-A No. 11-65021 and in JP-A No. 2000-171936.

Preferred as the binder of the surface protective layer of the invention is gelatin, but polyvinyl alcohol (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105 and the partially saponified PVA-205 and PVA-335, as well as modified polyvinyl alcohol MP-203 (trade name of products from Kuraray Ltd.). The coverage of polyvinyl alcohol (per 1 $m^2$ of support) in the protective layer (per one layer) is preferably in a range of from 0.3 to 4.0 $g/m^2$, and more preferably, from 0.3 to 2.0 $g/m^2$.

The coverage of total binder (inclusive of water-soluble polymer and latex polymer) (per 1 $m^2$ of support) in the surface protective layer (per one layer) is preferably in a range of from 0.3 to 5.0 $g/m^2$, and more preferably, from 0.3 to 2.0 $g/m^2$.

2) Antihalation Layer

The photothermographic material of the present invention may comprise an antihalation layer provided to the side farther from the light source with respect to the photosensitive layer.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The amount of adding the thermal bleaching dye is determined depending on the usage of the dye. In general, it is used at an amount as such that the optical density (absorbance) exceeds 0.1 when measured at the desired wavelength. The optical density is preferably in a range of from 0.15 to 2, and more preferably, from 0.2 to 1. The usage of dyes to obtain optical density in the above range is generally from about 0.001 $g/m^2$ to 1 $g/m^2$.

By thermal bleaching the dye in such a manner, the optical density after thermal development can be lowered to 0.1 or lower. Two types or more of thermal bleaching dyes may be used in combination in a photothermographic material. Similarly, two types or more of base precursors may be used in combination.

In thermal bleaching process using such a thermal bleaching dye and a base precursor, preferred is to use a substance (for instance, diphenylsulfone, 4-chlorophenyl(phenyl)sulfone, and the like) as disclosed in JP-A No. 11-352626, as well as 2-naphthyl benzoate and the like, which is capable of lowering the melting point of a base precursor by 3° C. when mixed with a basic precursor from the viewpoint of thermal bleaching property or the like.

3) Back Layer

Back layers usable in the invention are described in paragraph Nos. 0128 to 0130 of JP-A No. 11-65021.

In the invention, coloring matters having maximum absorption in the wavelength range of from 300 to 450 nm may be added in order to improve a color tone of developed images and a deterioration of the images during aging.

Such coloring matters are described in, for example, JP-A Nos. 62-210458, 63-104046, 63-103235, 63-208846, 63-306436, 63-314535, 01-61745, 2001-100363, and the like.

Such coloring matters are generally added in the range of from 0.1 $mg/m^2$ to 1 $g/m^2$, preferably to the back layer provided to the side opposite to the photosensitive layer.

In order to control the basic color tone, it is preferred to use a dye having an absorption peak in the wavelength range of from 580 to 680 nm. As a dye satisfying this purpose, preferred are oil-soluble azomethine dyes described in JP-A Nos. 4-359967 and 4-359968, or water-soluble phthalocyanine dyes described in Japanese Patent Application No. 2002-96797, which have low absorption intensity on the short wavelength side. The dyes for this purpose may be added to any of the layers, but more preferred is to add them in the non-photosensitive layer on the emulsion plane side, or in the back plane side.

In the invention, preferred as the binders for the back layers are transparent or translucent, and are generally colorless. Examples include natural polymer, synthesized resin or polymer and their copolymers, as well as media capable of forming a film; for example, included are gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methylmethacrylic acid), poly(vinyl chrolide), poly(methacrylic acid), styrene-maleic anhydride copolymers, styrene-acrylonitrile copolymers, styrene-butadiene copolymers, poly (vinyl acetal) (e.g., poly(vinyl formal) and poly(vinyl butyral)), poly(ester), poly(urethane), phenoxy resin, poly (vinylidene chloride), poly(epoxide), poly(carbonate), poly (vinyl acetate), cellulose esters, and poly(amide). The binder may be formed by coating from water, an organic solvent, or an emulsion.

In the invention, a backside resistive heating layer as described in U.S. Pat. Nos. 4,460,681 and 4,374,921 may be formed as a back layer.

The photothermographic material of the invention is preferably a so-called one-side photosensitive material, which comprises at least one layer of a photosensitive layer containing silver halide emulsion on one side of the support, and a back layer on the other side.

4) Matting Agent

A matting agent may be added to the photothermographic material of the invention in order to improve transportability. Matting agent is generally composed of water-insoluble fine particles of an organic or an inorganic compound. The matting agent can be selected arbitrarily from those well known in the art, such as organic matting agents described in each of the specifications of, for example, U.S. Pat. Nos. 1,939,782, 2,701,245, 2,322,037, 3,262,782, 3,539,344, 3,767,448, and the like; and inorganic matting agents described in each of the specifications of, for example, U.S. Pat. Nos. 1,260,772, 2,192,241, 3,257,206, 3,370,951, 3,523,022, 3,769,020, and the like.

As specific examples of the organic compounds preferably usable as matting agents include, water-dispersive vinyl polymers, such as polymethyl acrylate, polymethyl methacrylate, polyacrylonitrile, acrylonitrile-α-methylstyrene copolymer, polystyrene, styrene-divinylbenzene copolymer, polyvinyl acetate, polyethylene carbonate, polytetrafluoroethylene, and the like; cellulose derivatives such as methyl cellulose, cellulose acetate, cellulose acetate propionate, and the like; starch derivatives such as carboxy starch, carboxynitrophenyl starch, urea-formaldehyde-starch reaction product, and the like; and gelatin hardened with a known hardener, as well as hardened gelatin produced in fine capsule hollow particles obtained by coacervation hardening.

As specific examples of the inorganic compounds preferably usable as matting agents include, silicon dioxide, titanium dioxide, magnesium dioxide, aluminum oxide, barium sulfate, calcium carbonate, silver halide and silver bromide each desensitized by known method, glass, diatomaceous earth, and the like.

The matting agents above may be used by mixing different types of substances depending on the need.

There is no particular restriction on the morphology of the matting agent, and those of arbitrary shape can be used. On practicing the invention, preferred is to use those having an average particle size in the range of from 1 to 30 μm, and more preferably, from 3 to 10 μm. Furthermore, the particle distribution of the matting agent is preferably set as such that the variation coefficient may become 50% or lower. Since the matting agent greatly influences the haze and surface luster of the photothermographic material, it is preferred to control, on preparing the matting agent or by mixing plural matting agents, the particle size, morphology, and the particle size distribution depending on the necessity.

In the invention, mentioned as the layers containing the matting agent are the outermost layers on the photosensitive layer plane and the back plane (which may be the photosensitive layer or the back layer), the protective layer, undercoat layer, and the like. Preferably, the matting agent is incorporated in the outermost surface layer or a layer functioning as the outermost surface layer, or a layer near to the outer surface, and a layer that functions as the so-called protective layer.

The matt degree of the back plane in the invention is preferably in a range of 250 seconds or less and 10 seconds or more; more preferably, 180 seconds or less and 50 seconds or more, as expressed by Beck smoothness.

5) Polymer Latex

In the case of the photothermographic material of the invention for graphic arts in which changing of dimension is critical, it is preferred to incorporate polymer latex in the surface protective layer and the back layer. As such polymer latexes, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Ouyou (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl methacrylate (25.4% by weight)/styrene (8.6% by weight)/2-hydroethyl methacrylate (5.1% by weight)/acrylic acid copolymer, a latex of methyl methacrylate (64.0% by weight)/styrene (9.0% by weight)/butyl acrylate (20.0% by weight)/2-hydroxyethyl methacrylate(5.0% by weight)/acrylic acid copolymer, and the like. Furthermore, as the binder for the surface protective layer, there can be applied a combination of polymer latex described in the specification of Japanese Patent Application No. 11-6872, the technology described in paragraph Nos. 0021 to 0025 of the specification of JP-A No. 2000-267226, the technology described in paragraph Nos. 0027 and 0028 of the specification of Japanese Patent Application No. 11-6872, and the technology described in paragraph Nos. 0023 to 0041 of the specification of JP-A No. 2000-19678. The polymer latex in the surface protective layer preferably is contained in an amount of 10% by weight to 90% by weight, particularly preferably, of 20% by weight to 80% by weight of the total weight of binder.

6) Surface pH

The surface pH of the photothermographic material according to the invention preferably yields a pH of 7.0 or lower, more preferably, 6.6 or lower, before thermal development treatment. Although there is no particular restriction concerning the lower limit, the pH value is about 3, and the most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Surface pAg

The preferred surface pAg value of the photothermographic material according to the invention is in a range of 1 to 7, and more preferably, 3 to 5. The surface pAg value can be obtained by dropping 300 μl of distilled water on one $cm^2$ area of the photothermographic material, and by then measuring the potential using an electrode.

8) Hardener

A hardener can be used in each of image forming layer, protective layer, back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone based compounds of JP-A No. 62-89048.

The hardener is added as a solution, and the solution is added to the coating solution for forming the protective layer 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Liquid Mixing Technology" (Nikkan Kogyo Shinbun, 1989), and the like.

9) Other Additives

Furthermore, antioxidant, stabilizing agent, plasticizer, UV absorbent, or a coating aid may be added to the photothermographic material. Each of the additives is added to either of the photosensitive layer or the non-photosensitive layer. Reference can be made to WO No. 98/36322, EP-A No. 803764A1, JP-A Nos. 10-186567 and 10-18568, and the like.

10) Support

The image forming layer according to the invention can be coated on various types of supports.

Typical support includes a polyester film, undercoated polyester film, poly(ethylene terephthalate) film, poly(ethylene naphthalate) film, cellulose nitrate film, cellulose ester film, poly(vinyl acetal) film, polycarbonate film, and related or resin-like material, as well as glass, paper, metal, and the like. Flexible base material, particularly such that are partially acetylized, or baryta coated and/or α-olefin polymer laminated supports are used; in particular, paper supports coated with α-olefin polymer having 2 to 10 carbon atoms such as polyethylene, polypropylene, ethylene-butene copolymer, and the like, are typically used. The support may be transparent or opaque, but preferred is transparent.

As the transparent support, favorably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684 and in paragraph Nos. 0063 to 0080 of Japanese Patent Application No. 11-106881, and the like.

11) Preparation Of Coating Solution

The temperature for preparing the coating solution for use in the image forming layer of the invention is preferably from 30° C. to 65° C., more preferably, from 35° C. to 60° C., and most preferably, from 35° C. to 55° C. Furthermore, the temperature of the coating solution for the image forming layer immediately after adding the polymer latex is preferably maintained in the temperature range from 30° C. to 65° C.

12) Coating Method

The photothermographic material of the invention may be coated by any method. More specifically, various types of coating operations inclusive of extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and most preferably used is slide coating. Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837,095. Particularly preferred in the invention is the method described in JP-A Nos. 2001-194748, 2002-153808, 2002-153803, and 2002-182333.

The coating solution for the layer containing organic silver salt in the invention is preferably a so-called thixotropic fluid. For the details of this technology, reference can be made to JP-A No. 11-52509. The viscosity of the coating solution for the layer containing organic silver salt in the invention at a shear velocity of 0.1 $S^{-1}$ is preferably from 400 mPa·s to 100,000 mPa·s, and more preferably, from 500 mPa·s to 20,000 mPa·s. At a shear velocity of 1000 $S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state. Preferred defoaming treatment method in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60 to 100° C. at the film surface, and heating time is preferably in a range of from 1 to 60 seconds. More preferably, heating is performed in a temperature range of from 70 to 90° C. at the film surface for a duration of from 2 to 10 seconds. A preferred method of heat treatment for the invention is described in JP-A No. 2002-107872.

Furthermore, the production methods described in JP-A Nos. 2002-156728 and 2002-182333 are favorably used in the invention in order to stably and continuously produce the photothermographic material of the invention.

The photothermographic material is preferably of mono-sheet type (i.e., a type which can form image on the photothermographic material without using other sheets such as an image-receiving material).

13) Wrapping Material

In order to suppress fluctuation from occurring on the photographic performance during a preservation of the photosensitive material of the invention before thermal development, or in order to improve curling or winding tendencies, it is preferred that a wrapping material having low oxygen transmittance and/or vapor transmittance is used. Preferably, oxygen transmittance is 50 ml/atm·$m^2$·day or lower at 25° C., more preferably, 10 ml/atm·$m^2$·day or lower, and most preferably, 1.0 ml/atm·$m^2$·day or lower. Preferably, vapor transmittance is 10 g/atm·$m^2$·day or lower, more preferably, 5 g/atm·$m^2$·day or lower, and most preferably, 1 g ml/atm·$m^2$·day or lower.

As specific examples of a wrapping material having low oxygen transmittance and/or vapor transmittance, reference can be made to, for instance, the wrapping material described in JP-A Nos.8-254793 and 2000-206653.

14) Other Applicable Techniques

Techniques which can be used for the photothermographic material of the invention also include those in EP803764A1, EP883022A1, WO98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, JP-A Nos. 2000-187298, 2000-10229, 2000-47345, 2000-206642, 2000-98530, 2000-98531, 2000-112059, 2000-112060, 2000-112104, 2000-112064 and 2000-171936.

15) Formation of Color Image

Constitution of the multi-color photothermographic material may include a combination of these two layers for each color. Alternatively, all ingredients may be included into a single layer as described in U.S. Pat. No. 4,708,928.

In instances of multi-color photothermographic materials, each photosensitive layer is in general, held distinctively each other by using a functional or nonfunctional barrier layer between each photosensitive layer as described in U.S. Pat. No. 4,460,681.

14. Image Forming Method

1) Exposure

Although the photosensitive material of the invention may be subjected to exposure by any methods, laser beam is preferred as an exposure light source, i.e., He—Ne laser of red through infrared emission, red semiconductor laser, or $Ar^+$, He—Ne, He—Cd laser of blue through green emission, blue semiconductor laser. Preferably, the exposure light source is red through infrared semiconductor laser. The peak wavelength of the laser beam is 600 nm to 900 nm, and preferably 620 nm to 850 nm.

Meanwhile, modules having SHG (Second Hermonic Generator) chip and semiconductor laser which are integrated, or blue semiconductor laser have been espcially developed recently, and thus laser output devices for short wavelength region have attracted the attention. Blue semiconductor laser has been expected as a light source with increasing demand hereafter because image recording with high definition is possible, and increased recording density, as well as stable output with longer operating life are enabled. Peak wavelength of the blue laser beam is 300 nm to 500 nm, and particularly preferably 400 nm to 500 nm.

Laser beam which oscillates in a longitudinal multiple modulation by a method such as high frequency superposition is also preferably employed. In comparison with scanning laser beam in a longitudinal single mode, such laser beam results in decreased deterioration of image qualities, for example, occurrence of unevenness like interference fringes.

For providing the longitudinal multiple modulation, methods such as wave coupling, utilization of return light, or high frequency superposition may be employed. Longitudinal multiple modulation means that the wavelength of the exposed light is not single, and in general, distribution of the exposed light may be 5 nm or greater, and preferably 10 nm or greater. Upper limit of the wavelength of the exposed light is not particularly limited, however, it is approximately 60 nm in general.

2) Thermal Development

Although the development of the photothermographic material of the invention is usually performed by elevating the temperature of the photothermographic material exposed imagewise, any method may be used for this thermal development process. The temperature for the development is preferably 80° C. to 250° C., preferably 100° C. to 140° C., and more preferably 110° C. to 130° C. Time period for the development is preferably 1 second to 30 seconds, more preferably 3 seconds to 20 seconds, and particularly preferably 3 seconds to 12 seconds.

In the image forming methods for the photothermographic material of the invention according to one preferred embodiment, time period from the time point of turning on the power of a thermal developing device until the leading end of the photothermographic material reaches to the thermal development region (herein referred to as "starting-up time") is within 15 minutes.

The "leading end of the photothermographic material" refers to a part of a photosensitive material which reaches to the heating part of a thermal developing apparatus first following the exposure and carrying of the photosensitive material comprising the photothermographic material. The "thermal development region" refers to a heating part of the thermal developing apparatus.

The starting-up time is preferably still shorter, and is more preferably 10 minutes or less.

In instances where the power of the thermal developing device had been disconnected overnight, the temperature of the thermal development region has become identical to the room temperature. Immediately after turning on the power, the temperature does not yet reach to the preferable development temperature, alternatively, the hunting width of the temperature is large. Accordingly, it is difficult to obtain a stable output image. Therefore, in order to bring the region to a state which provides the aforementioned preferable development condition, a time period is required for elevating the temperature of the thermal development region as well as stabilizing the temperature. It was revealed that stable images can be obtained by using the photothermographic material according to the invention, also under a severe development condition in which development is started within a short time period after turning on the power.

In the process for the thermal development, either drum type heaters or plate type heaters may be used. However, plate type heater processes are more preferred. Preferable process for the thermal development by a plate type heater may be a process described in JP-A NO. 11-133572, which discloses a thermal developing device in which a visible image is obtained by bringing a photothermographic material with a formed latent image into contact with a heating means at a thermal development region, wherein the heating means comprises a plate heater, and plurality of retainer rollers are oppositely provided along one surface of the plate heater, the thermal developing device is characterized in that thermal development is performed by passing the photothermographic material between the retainer rollers and the plate heater. It is preferred that the plate heater is divided into 2 to 6 sections, with the leading end having the lower temperature by 1 to 10° C. For example, 4 sets of plate heaters which can be independently subjected to the temperature control are used, and are controlled so that they respectively become 112° C., 119° C., 121° C., and 120° C. Such a process is also described in JP-A NO. 54-30032, which allows for excluding moisture and organic solvents included in the photothermographic material out of the system, and also allows for suppressing the change of shapes of the support of the photothermographic material upon rapid heating of the photothermographic material.

For downsizing the thermal developing apparatus as well as reduction in thermal development time period, it is preferred that more stable control of the heater can be accomplished, and in addition, it is desired that light exposure is started from the leading end of one photosensitive material sheet followed by thermal development which is started before completing the light exposure up to the posterior end. Preferable imagers which enable a rapid treatment according to the invention are described in for example, Japanese Patent Application Nos. 2001-088832 and 2001-091114. When such imagers are used, thermal developing treatment can be performed in 14 seconds with a plate type heater having three sections which are controlled to be 107° C.-121° C.-121° C. Thus, the output time period for the first sheet can be reduced to about 60 seconds. For such a rapid developing treatment, to use the photothermographic materials of the invention in combination, which are highly sensitive and less susceptible to the environmental temperature, is preferred.

In one preferable embodiment of the invention, transportation speed of the photosensitive material upon the thermal development is 23 mm/sec or greater. More preferably, the transportation speed is 25 mm/sec or greater.

Preferable thermal developing apparatus according to the invention is illustrated in FIG. 1.

150 thermal development recording device
A photothermographic material supplying station
B image exposing station
C thermal development station
D cooling station
3 photothermographic material
10*a*, 10*b*, 10*c* photothermographic material tray
13*a*, 13*b*, 13*c* sheet conveyor roller
15*a*, 15*b*, 15*c* tray for photothermographic material
16 upper light shielding cover
17 sub-scanning transportation station (sub-scanning means)
19 scanning exposure station (laser irradiation means)
51*a*, 51*b*, 51*c* thermal development plate
52 driving roller
53 speed reduction gear
55 retainer roller in transportation
57 cooling roller
59 cooling roller
61 cooling plate
63 discharge roller
100 laser recording apparatus
150 thermal development recording apparatus A photothermographic material 3 supplied from a photothermographic material supply station A, under scanning exposure by a laser beam L in an image exposure station B, is transported partially from the top end to a thermal developing station C and thermally developed by being conveyed between thermal developing plates 51*a*, 51*b*, 51*c* and an retainer roller 55*a*. The sensitive material after the thermal development is cooled in a cooling station D and then discharged by a discharge roller 63 to the outside of the apparatus.

Color tone of the resulting image may be altered depending on various conditions for the thermal development as described above. Thus, it is necessary to control the color tone in the preferable range to meet the intended use. In particular, color tone is important in a medical image forming method because it may affect the diagnosability.

In the medical image forming method, it is preferred that a hue angle hab, which is defined according to JIS Z 8729, at a chemical density D of 1.2 after completing the thermal development is within the following range.

$180° < hab < 270°$

More preferably, the hue angle is within the range below.

$185° < hab < 260°$

3) System

Examples of a medical laser imager equipped with a light exposing part and a thermal developing part include Fuji Medical Dry Laser Imager FM-DP L. In connection with FM-DPL, description is found in Fuji Medical Review No. 8, pages 39-55. It goes without mentioning that those techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

15. Application of the Invention

The image forming method in which the photothermographic material of the invention is used is preferably employed as image forming methods for photothermographic materials for use in medical imaging, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

1. Preparation of PET Support 1-1. Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, melted at 300° C., and the dye BB having the following structure was included at 0.04% by weight. Thereafter, the mixture was extruded from a T-die and rapidly cooled to form a non-tentered film having such a thickness that the thickness should become 175 μm after tentered and thermal fixation.

dye BB

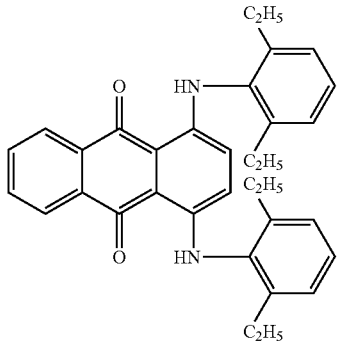

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part were slit off, and both edges of the film were knurled. Then the film was rolled up at the tension of 4 kg/cm$^2$ to obtain a roll having the thickness of 175 μm.

1-2. Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

2. Preparation and Coating of Coating Solution for Back Layer

To 830 g of MEK were added 84.2 g of cellulose acetate butyrate (Eastman Chemical, CAB381-20) and 4.5 g of a polyester resin (Bostic Co., Vitel PE2200B) with stirring, and dissolved. To this dissolved solution was added 0.30 g of dye -B, and thereto were added 4.5 g of a fluorocarbon surfactant (Asahi Glass Co., Ltd., Surflon HK40) which had been dissolved in 43.2 g of methanol, and 2.3 g of a fluorocarbon surfactant (Dai-Nippon Ink & Chemicals, Inc., Megafac(R) F120K). The mixture was thoroughly stirred until dissolution was completed. Finally, 75 g of silica (W. R. Grace Co., Siloid 64X6000) dispersed in methyl ethyl ketone at a concentration of 1% by weight with a dissolver type homogenizer was added thereto followed by stirring to prepare a coating solution for the back layer.

(dye B)

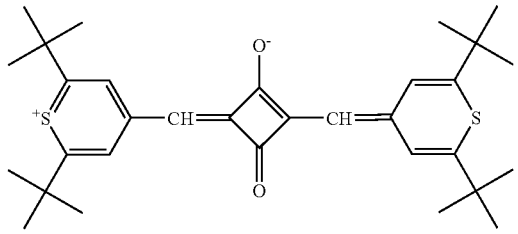

Thus prepared coating solution for the back layer was coated on the support with an extrusion coater so that the dry film thickness became 3.5 μm and dried. Drying was executed by a hot air with a temperature of 100° C., and a dew point of 10° C. over 5 minutes.

2. Image-Forming Layer and Surface Protective Layer 3-1. Preparation of Materials for Coating 1) Silver Halide Emulsion (Preparation of Silver Halide Emulsion −1)

In 5429 mL of water, 88.3 g of phenyl carbamoyl gelatin, 10 mL of a 10% by weight aqueous methanol solution of a PAO compound $(HO(CH_2CH_2O)_n—(CH(CH_3)CH_2O)_{17}—(CH_2CH_2O)_m—H$; m+n=5 to 7) and 0.32 g of potassium bromide were added and dissolved. To the resulting solution kept at 45° C., were added 659 mL of a 0.67 mol/L aqueous silver nitrate solution, and a solution including KBr at 0.703 mol and KI at 0.013 mol dissolved per one liter using a mixing and stirring machine disclosed in JP-B Nos. 58-58288 and 58-58289, while controlling the pAg of 8.09 by a parallel mixing process over 4 minutes and 45 seconds to proceed a neuclization. At one minute later, 20 mL of a 0.63 N potassium hydroxide solution was added thereto. After the lapse of 6 minutes, thereto were added 1976 mL of a 0.67 mol/L aqueous silver nitrate solution, and a solution including KBr at 0.657 mol, potassium iodide at 0.013 mol and potassium secondary iridiumate hexachloride at 30 μmol dissolved per 1 liter while controlling the temperature at 45° C. and pAg of 8.09 by a parallel mixing process over 14 minutes and 15 seconds. After stirring for 5 minutes, the mixture was cooled to 40° C.

Thereto was added 18 mL of a 56% by weight aqueous acetic acid solution to precipitate a silver halide emulsion. The supernatant was removed so that 2 L of a precipitate portion remains. To the precipitate portion was added 10 L of water followed by stirring to precipitate the silver halide emulsion once again. Moreover, the supernatant was removed to leave 1.5 L of a precipitate portion, and 10 L of water was further added to the precipitate portion followed by stirring to precipitate the silver halide emulsion. After removing the supernatant to leave 1.5 L of a precipitate portion, thereto was added a solution of 1.72 g of sodium carbonate anhydride dissolved in 151 mL of water. Then, the mixture was warmed to 60° C., and stirring was conducted for additional 120 minutes. Finally, the solution was adjusted to pH of 5.0, and water was added thereto to yield 1161 g per 1 mol of the amount of silver.

The particles in this emulsion were monodispersing cubic silver iodide bromide particles having a mean sphere equivalent diameter of 0.058 μm, a variation coefficient of the sphere equivalent diameter of 12%, and the [100] face ratio of 92%. Particle size and the like were determined from the average of 1000 particles using an electron microscope.

2) Preparation of Powdery Organic Silver Salt A to I

<<Purification of Behenic Acid>>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour.

Thus resulting crystal was subjected to centrifugal filtration, and washing was performed with 100 kg of isopropyl alcohol, followed by repeating the aforementioned recrystallization procedure twice additionally. Thereafter, the crystal was dried. Thus resulting crystal was esterified, and subjected to GC-FID analysis to give the results of the content of behenic acid being 98 mol %, and lignoceric acid 2 mol %. In addition, erucic acid was included at 0.000001 mol % or less.

<<Purification of Arachidic Acid>>

Arachidic acid manufactured by Tokyo Kasei Kogyo Co., Ltd. in an amount of 100 kg was admixed with 1200 kg of isopropyl alcohol, and dissolved at 50° C. The mixture was filtrated through a 10 μm filter, and cooled to 20° C. to allow recrystallization. Cooling speed for the recrystallization was controlled to be 3° C./hour.

Thus resulting crystal was subjected to centrifugal filtration, and washing was performed with 100 kg of isopropyl alcohol, followed by repeating the aforementioned recrystallization procedure twice additionally. Thereafter, deposit which was obtained at an early stage of the recrystallization was filtrated out to eliminate carboxylic acids having the longer chain length than arachidic acid, and dried. Thus resulting crystal was esterified, and subjected to GC-FID analysis to give the results of the content of arachidic acid being 100 mol %. In addition, erucic acid was included at 0.000001 mol % or less.

<<Purification of Stearic Acid>>

Stearic acid manufactured by Tokyo Kasei Kogyo Co., Ltd. in an amount of 100 kg was admixed with 1200 kg of isopropyl alcohol, and dissolved at 50° C. The mixture was filtrated through a 10 μm filter, and cooled to 20° C. to allow recrystallization. Cooling speed for the recrystallization was controlled to be 3° C./hour.

Thus resulting crystal was subjected to centrifugal filtration, and washing was performed with 100 kg of isopropyl alcohol, followed by repeating the aforementioned recrystallization procedure twice additionally. Thereafter, deposit which was obtained at an early stage of the recrystallization was filtrated out to eliminate carboxylic acids having the longer chain length than stearic acid, and dried. Thus resulting crystal was esterified, and subjected to GC-FID analysis to give the results of the content of stearic acid being 100 mol %. In addition, erucic acid was included at 0.000001 mol % or less.

<<Purification of Lignoceric Acid>>

Lignoceric acid manufactured by Tokyo Kasei Kogyo Co., Ltd. in an amount of 100 kg was admixed with 1200 kg of isopropyl alcohol, and dissolved at 50° C. The mixture was filtrated through a 10 μm filter, and cooled to 20° C. to allow recrystallization. Cooling speed for the recrystallization was controlled to be 3° C./hour.

Thus resulting crystal was subjected to centrifugal filtration, and washing was performed with 100 kg of isopropyl alcohol, followed by repeating the aforementioned recrystallization procedure twice additionally. Thereafter, deposit which was obtained at an early stage of the recrystallization was filtrated out to eliminate carboxylic acids having the longer chain length than lignoceric acid, and dried. Thus resulting crystal was esterified, and subjected to GC-FID analysis to give the results of the content of lignoceric acid being 100 mol %. In addition, erucic acid was included at 0.000001 mol % or less.

<<Preparation of Powdery Organic Silver Salts A to F>>

To 4720 ml of purified water were added behenic acid, arachidic acid, stearic acid, lignoceric acid and erucic acid at 0.7552 mol in total with a ratio presented in Table 1. After dissolving at 80° C., 540.2 ml of a 1.5 N aqueous NaOH solution was added to the solution, and thereto was added 6.9 ml of concentrated nitric acid, followed by cooling to 55° C. to obtain a solution of sodium salt of organic acid. While keeping the temperature of the sodium salt of organic acid solution at 55° C., 45.3 g of the aforementioned silver halide emulsion and 450 ml of purified water were added thereto. The mixture was stirred with a homogenizer manufactured by IKA JAPAN Co. (ULTRA-TURRAXT-25) at 13200 rpm (corresponding to 21.1 kHz of mechanical vibration frequency) for 5 minutes. Then, 702.6 mL of a 1 mol/L silver nitrate solution was added thereto over 2 minutes, followed by stirring for 10 minutes to obtain an organic silver salt dispersion. Thereafter, the resulting organic silver salt dispersion was transferred to a washing vessel, and thereto was added deionized water followed by stirring. The mixture was allowed to stand still so that the organic silver salt dispersion was floatated, and thus water soluble salts present in the bottom part were removed. Then, washing with deionized water and drainage of the waste water was repeated until the electric conductivity of the waste water became 2 μS/cm. After performing centrifugal dewatering, drying in a circulating dryer was performed with warm air having the oxygen partial pressure of 10% by volume at 40° C. until weight loss did not take place to obtain the powdery organic silver salts A to F.

TABLE 1

| organic silver salt | behenic acid | stearic acid | arachidic acid | lignoceric acid |
|---|---|---|---|---|
| A | 90 | 5 | 3 | 2 |
| B | 75 | 15 | 7 | 3 |
| C | 65 | 20 | 10 | 5 |
| D | 50 | 25 | 20 | 5 |
| E | 40 | 30 | 25 | 5 |
| F | 25 | 40 | 30 | 5 |

In Table 1, all values for the fatty acid are represented by mol %.

3) Preparation of Photosensitive Emulsion Dispersion −1 to 6

Polyvinyl butyral powder (Monsanto Co., Butvar B-79) in an amount of 14.57 g was dissolved in 1457 g of methyl ethyl ketone (MEK), and thereto was gradually added 500 g of either one of the powdery organic silver salts A to F while stirring with Dissolver DISPERMAT CA-40M type manufactured by VMA-GETZMANN Co., and thoroughly mixed to yield a slurry. The slurry was subjected to two passes dispersion with a GM-2 pressure type homogenizer manufactured by SMT Limited to prepare a photosensitive emulsion fluid dispersion. Upon this operation, the pressure for treatment with first-pass was set to be 280 kg/cm$^2$, whilst the pressure for treatment with second-pass was set to be 560 kg/cm$^2$.

4) Preparation of Coating Solutions for Image-Forming Layer 1 to 6

MEK was added in an amount of 15.1 g to either one of the photosensitive emulsion dispersion 1 to 6, and the mixture was kept at 21° C. while stirring with a dissolver type homogenizer at 1000 rpm. Thereto was added 390 μL of a 10% by weight methanol solution of an aggregate of: two molecules of N,N-dimethyl acetamide/one molecule of oxalic acid/one molecule of bromine, followed by stirring for 1 hour. Furthermore, thereto was added 494 μL of a 10% by weight methanol solution of calcium bromide, and the mixture was stirred for 20 minutes. Subsequently, 167 mg of a methanol solution containing 15.9% by weight of dibenzo-18-crown-6 and 4.9% by weight of potassium acetate was added to the mixture, followed by stirring for 10 minutes. Then, thereto was added 2.6 g of a MEK solution of 0.24% by weight spectral sensitizer A, 18.3% by weight 2-chlorobenzoic acid, 34.2% by weight salicylic acid-p-toluenesulfonate and 4.5% by weight 5-methyl-2-mercaptobenzimidazole, followed by stirring for one hour. Thereafter, the mixture was cooled to 13° C., and stirred for additional 30 minutes. After adding 13.31 g of polyvinyl butyral (Monsanto Co., Butvar B-79) while keeping the temperature at 13° C., followed by stirring for 30 minutes, 1.08 g of a 9.4% by weight tetrachlorophthalic acid solution was added thereto, followed by stirring for 15 minutes. While keeping stirring, 10.0 g of a 20% by weight MEK solution of the aforementioned reducing agent I-5, an MEK solution of the aforementioned development accelerator A-8 at 0.02 mol % per the reducing agent were added. Moreover, thereto was added 12.4 g of a 1.1% by weight MEK solution of 4-methyl phthalic acid and dye 1, then was subsequently added 1.5 g of 10% by weight Desmodur N3300 (Mobay, aliphatic isocyanate). Further, thereto was added 4.27 g of an MEK solution of 7.4% by weight tribromomethyl-2-azaphenylsulfone and 7.2% by weight phthalazine to obtain coating solutions for image forming layer 1 to 6.

5)Preparation of Coating Solution for Surface Protective Layer 1

In 512 g of MEK were mixed 61 g of methanol, 48 g of cellulose acetate butyrate (Eastman Chemical, CAB171-15S), 2.08 g of 4-methylphthalic acid, 3.3 g of a 16% by weight MEK solution of a fluorocarbon surfactant C, 1.9 g of polymethyl methacrylic acid (Rohm and Haas, Acryloid A-21), 2.5 ml of methanol solution containing 1% by weight of benzotriazole, 0.5 g of 1,3-di(vinylsulfonyl)-2-propanol at room temperature to prepare a coating solution for the surface protective layer.

3-2. Preparation of Photothermographic Materials

Photothermographic materials 1 to 6 were prepared by simultaneous double coating of either one of the coating solutions for image forming layer 1 to 6, and the coating solution for the surface protective layer 1 using a dual knife coater, on a reverse surface to the back layer of the support coated with the back layer. The coating was executed so that the image forming layer had the thickness after drying of 18.3 μm, and that the surface protective layer had the dry film thickness of 1.5 μm. This coating device has two knife coating blades which are laid side by side. After cutting the support to the size so that it meets with the volume of the solution used, knives equipped with a hinge were elevated to put them in a position on the coater floor. Then, the knives were brought down and fixed onto a predetermined position. The height of the knives was regulated using a wedge which was measured with an ammeter and which was controlled by a screw knob. Knife #1 was elevated up to a clearance corresponding to the thickness which was coordinated with total thickness of the substrate thickness and the desired wet thickness of the image forming layer (layer #1). Knife #2 was elevated up to the height equal to the total thickness of: support thickness+wet thickness of the image forming layer (layer #1)+desired thickness of the surface protective layer (layer #2). Thereafter, drying was performed with an air of the temperature of 75° C. and a dew point of 10° C. for 15 minutes.

Chemical structures of the compounds used in Examples of the invention are shown below.

(Spectral sensitizer A)

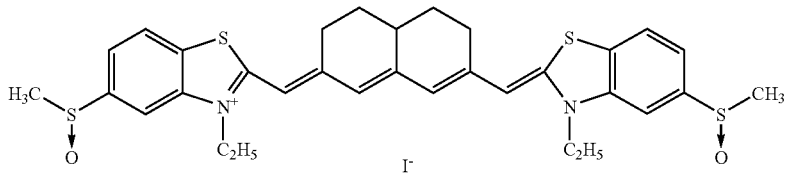

(Dye 1)

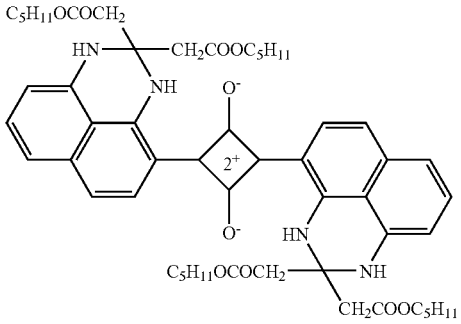

3. Evaluation of Photographic Performances (Preparation)

The resulting sample was cut into a half-cut size (43 cm in length×35 cm in width), and four corners were cut off. The sample was wrapped with the following packaging material under an environment of 25° C. and 50% RH, and stored for 2 weeks at an ambient temperature.

(Packaging Material)

PET 10 μm/PE 12 μm/aluminum foil 9 μm/Ny 15 μm/polyethylene 50 μm containing carbon at 3% by weight, oxygen permeability: 0.02 mL/atm/$m^2$/25° C./day, vapor permeability: 0.10 g/atm/$m^2$/25° C./day.

Evaluation for the photothermographic materials described above was carried out as follows.

(Exposure of Photothermographic Material)

An exposure machine was manufactured by way of trial, with semiconductor laser, which was longitudinally multiple modulated at the wavelength of 800 nm through 820 nm with high frequency superposition, as an exposure light source. Exposure was provided by laser scanning using this exposure machine to the image forming layer surface side of the samples 1 to 6 prepared as described hereinabove. Upon the exposure, images were recorded with an incident angle of the scanning laser beam to the surface of the photothermographic material set to be 75°.

(Development of the Photothermographic Materials)

<<Condition 1>>

After the exposure, thermal development was performed using an automated developing apparatus including three heat plates in combination having the length of 9 cm, with the development temperature set to be 107° C.-121° C.-121° C., and with the line speed of the photothermographic materials upon the thermal development of 19.3 mm/sec, and total development time period of 14 seconds.

<<Condition 2>>

After the exposure, thermal development was performed using an automated developing apparatus including three heat plates in combination having the length of 13 cm, with the development temperature set to be 107° C.-121° C.-121° C., and with the line speed of the photothermographic materials upon the thermal development of 27.9 mm/sec, and total development time period of 14 seconds.

(Results)

1) Evaluation of Color Tone

Exposure was performed with a determined exposure value so that an uniform image having the density of 1.0 at a central point (a position of 21.5 cm×17.5 cm) of the half-cut size (43 cm in length×35 cm in width). Then, a thermal developing process was performed in the longitudinal direction under either condition of the above condition 1 or 2. The photosensitive material was cut in half to divide the longitudinal direction (21.5 cm in length×35 cm in width). Comparison of the color tone was evaluated by visual observation of the photosensitive materials, which were cut in half, laid side by side to enable to watch and compare the leading end and posterior end of the thermal developing treatment.

A: None realized the difference in color tone.

B: Only two persons among 10 realized the difference in color tone.

C: Half persons realized the difference in color tone.

D: Everyone realized the difference in color tone.

2) Evaluation of Fog

Unexposed photosensitive material was subjected to thermal development under the thermal development condition 2. Evaluation of thus resulting image was carried out with Macbeth TD904 densitometer (visible density). Results of the measurement were evaluated for the minimal density, Dmin (fog).

TABLE 2

| | | Difference in color tone between leading and posterior ends of the developed samples | | |
|---|---|---|---|---|
| Photothermographic material | Behenic acid (mol %) | Thermal development condition 1 | Thermal development condition 2 | Fog |
| 1 | 90 | A | D | 0.18 |
| 2 | 75 | A | B | 0.18 |
| 3 | 65 | A | A | 0.18 |
| 4 | 50 | A | A | 0.19 |
| 5 | 40 | A | B | 0.20 |
| 6 | 25 | A | B | 0.30 |

As shown in Table 2, difference in color tone was found for the photothermographic material −1 having the content of silver behenate of 90 mol % under the condition 2 in which the line speed upon the exposure was rapid.

In addition, as for the photothermographic material −6 having the content of silver behenate of 25 mol %, the difference in color tone was at the similar level as those of other samples. However, fog was extensively caused in this instance, which precluded the possible use as a photothermographic material.

As for each one of the samples for the photothermographic materials 2 to 5 having the content of silver behenate of 30 to 85 mol %, preferable results were also obtained showing less difference in color tone under the thermal development condition 2 in which the line speed was such extremely rapid as 27.9 mm/sec. In particular, favorable results were achieved for the photothermographic materials 3 and 4 having the content of silver behenate of 50 mol % and 65 mol %.

Example 2

<<Preparation of Coating Solutions for Image-Forming Layer −7 to 9>>

Coating solutions for the image forming layer 7 to 9 were prepared in a similar manner to that in the preparation of the coating solution for the image forming layer −3 except that the addition of 10.0 g of the MEK solution of the reducing agent I-5 during the preparation of the coating solution for the image forming layer −3 was altered to the reducing agent as shown in Table 3, and that the added amount of the development accelerator A-8 was changed into the amount as shown in Table 3.

TABLE 3

| Photothermographic material | Behenic acid (mol %) | Reducing agent Type | Reducing agent Amount added (mol %) | Development accelerator Type | Development accelerator Amount added (mol % per reducing agent) | Difference in color tone between leading and posterior ends of the treatment: Thermal development condition 1 | Difference in color tone between leading and posterior ends of the treatment: Thermal development condition 2 | Fog |
|---|---|---|---|---|---|---|---|---|
| 3 | 65 | I-5 | 17 | A-8 | 0.02 | A | A | 0.18 |
| 7 | 65 | I-5 | 22 | A-8 | 0.015 | A | B | 0.18 |
| 8 | 65 | I-1 | 28 | A-8 | 0.01 | A | B | 0.18 |
| 9 | 65 | I-1 | 35 | A-8 | 0 | A | C | 0.18 |

As shown in Table 3, even though type and the added amount of the reducing agent as well as the added amount of the development accelerator are altered, stable images can be put out with few differences in color tone.

Example 3

<<Preparation of Thermal Developed samples −10 and 11>>

Thermal developed samples 10 and 11 were prepared completely similarly to Example 1 except that the developing temperature of the plate set to be 121° C. was altered as shown in Table 4 in the thermal development of Example 1. The sample herein used is the photothermographic material −3 having the content of silver behenate of 65 mol %.

<<Measurement of Hue Angle>>

Hue angle, hab, which is defined according to JIS Z 8729, at an optical density D of 1.2 is obtained. Hue angle, hab, was calculated on:

$$hab=\tan-1(b^*/a^*)$$

using chromaticity coordinates a* and b* of the L*a*b* chromatic system defined according to JIS Z 8729, from the XYZ chromatic system or tristimulus values X, Y, Z or X10, Y10, Z10 defined according to JIS Z 8701.

For the measurement, Spectro Scan Transmission measuring equipment manufactured by Macbeth Co. was used. The measurement was performed with a light source of FL5 and the measuring area of 5 mmϕ.

TABLE 4

| Sample No. | Behenic acid (mol %) | Development temperature (° C.) | Hue angle | Difference in color tone between leading and posterior ends of the treatment: Thermal development condition 1 | Difference in color tone between leading and posterior ends of the treatment: Thermal development condition 2 |
|---|---|---|---|---|---|
| 3 | 65 | 121 | 255° | A | A |
| 10 | 65 | 117 | 270° | A | B |
| 11 | 65 | 128 | 210° | A | B |

Results from altering the hue angle through the alteration of the thermal development temperature are presented in Table 4. As shown in Table 4, when the hue angle complies with 185°<hab<260°, favorable results were obtained with no difference in color tone giving uniform density of the image.

Example 4

<<Preparation of Sample>>

In addition to the samples cut into half-cut size (43 cm in length×35 cm in width) as prepared in Example 1, those cut into sixth-cut size (25 cm in length×20 cm in width) were provided.

After subjecting 10 samples of the sixth-cut size to exposure and development serially, and one sample of the half-cut size was subsequently subjected to exposure and development. The conditions for exposure and development are similar to those of Example 1.

<<Evaluation>>

The half-cut size sample subjected to the exposure and development afterwards was separated by cutting to give a central part where the sixth-cut size sample passed and an edge part where the sixth-cut size sample did not pass. The separated samples were laid side by side, and the evaluation for color tone was carried out by visual observation in a similar manner to Example 1.

TABLE 5

| Photothermographic material | Behenic acid (mol %) | Difference in color tone of the sample passed through a developing apparatus after passing on different size |
|---|---|---|
| 1 | 90 | C |
| 2 | 75 | B |
| 3 | 65 | A |
| 4 | 50 | A |
| 5 | 40 | B |
| 6 | 25 | B |

In Example 4, evaluation was carried out for the cases in which photothermographic materials having different size were serially processed, and thus slight difference in temperature is present on the heater between the part which had been contacted with the photosensitive material just before and the part which had not been contacted therewith. However, even under such development conditions, stable output images were obtained with few differences in color tone for the photothermographic materials having the content of silver behenate of 30 mol % to 85 mol %.

Example 5

1. Undercoat Layer

1) Preparation of Coating Solution for Undercoat Layer

Formula (1) (for undercoat layer on the image forming layer side)

| | |
|---|---|
| Pesresin A-520 manufactured by Takamatsu Oil & Fat Co., Ltd. (30% by weight solution) | 59 g |
| polyethyleneglycol monononylphenylether (average ethylene oxide number = 8.5) 10% by weight solution | 5.4 g |
| MP-1000 manufactured by Soken Chemical & Engineering Co., Ltd. (polymer fine particle, mean particle diameter of 0.4 μm) | 0.91 g |
| distilled water | 935 ml |

Formula (2) (for first layer on the back surface)

| | |
|---|---|
| Styrene-butadiene copolymer latex (solid content of 40% by weight, styrene/butadiene weight ratio = 68/32) | 158 g |
| 8% by weight aqueous solution of 2,4-dichloro-6-hydroxy-S-triazine sodium salt | 20 g |
| 1% by weight aqueous solution of sodium laurylbenzenesulfonate | 10 ml |
| distilled water | 854 ml |

Formula (3) (for second layer on the back surface)

| | |
|---|---|
| $SnO_2$/SbO (9/1 weight ratio, mean particle diameter of 0.038 μm, 17% by weight dispersion) | 84 g |
| gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 ml |
| NaOH (1% by weight) | 6 ml |
| Proxel (manufactured by Imperial Chemical Industries PLC) | 1 ml |
| distilled water | 805 ml |

2) Undercoating

Both surfaces of the biaxially tentered polyethylene terephthalate support having the thickness of 175 μm were subjected to the corona discharge treatment as described above. Thereafter, the aforementioned formula (1) of the coating solution for the undercoat was coated on one surface (image forming layer side) with a wire bar so that the amount of wet coating became 6.6 ml/m$^2$ (per one side), and dried at 180° C. for 5 minutes. Then, the aforementioned formula (2) of the coating solution for the undercoat was coated on the reverse face (back surface) with a wire bar so that the amount of wet coating became 5.7 ml/m$^2$, and dried at 180° C. for 5 minutes. Furthermore, the aforementioned formula (3) of the coating solution for the undercoat was coated on the reverse face (back surface) with a wire bar so that the amount of wet coating became 7.7 ml/m$^2$, and dried at 180° C. for 6 minutes. Thus, an undercoated support was produced.

2. Back Layer

1) Preparation of Coating Solution for Back Layer (Preparation of Dispersion of Solid Fine Particles (a) of Base Precursor)

A base precursor compound −1 in an amount of 2.5 kg, and 300 g of a surfactant (trade name: DEMOL N, manufactured by Kao Corporation), 800 g of diphenyl sulfone, 1.0 g of benzoisothiazolinone sodium salt and distilled water were added to give the total amount of 8.0 kg and mixed. The mixed liquid was subjected to beads dispersion using a horizontal sand mill (UVM-2: manufactured by IMEX Co., Ltd.). Process for dispersion included feeding the mixed liquid to UVM-2 packed with zirconia beads having the mean particle diameter of 0.5 mm with a diaphragm pump, followed by the dispersion at the inner pressure of 50 hPa or higher until desired mean particle diameter could be achieved.

The dispersion was continued until the ratio of the optical density at 450 nm and the optical density at 650 nm for the spectral absorption of the dispersion (D450/D650) became 3.0 upon spectral absorption measurement. Thus resulting dispersion was diluted with distilled water so that the concentration of the base precursor became 25% by weight, and filtrated (with a polypropylene filter having the mean fine pore diameter of 3 μm) for eliminating dust to put into practical use.

(Preparation of Dispersion of Solid Fine Particle of Dye)

A cyanine dye compound −1 in an amount of 6.0 kg, and 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total liquid amount of 60 kg. The mixed liquid was subjected to dispersion with 0.5 mm zirconia beads using a horizontal sand mill (UVM-2: manufactured by IMEX Co., Ltd.).

The dispersion was dispersed until the ratio of the optical density at 650 nm and the optical density at 750 nm for the spectral absorption of the dispersion (D650/D750) became 5.0 or greater upon spectral absorption measurement. Thus resulting dispersion was diluted with distilled water so that the concentration of the cyanine dye became 6% by weight, and filtrated with a filter (mean fine pore diameter: 1 μm) for eliminating dust to put into practical use.

(Preparation of Coating Solution for Antihalation Layer)

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzoisothiazolinone and 490 ml of water to allow gelatin to be dissolved. Additionally, 2.3 ml of a 1 mol/L aqueous sodium hydroxide solution, 40 g of the aforementioned dispersion of the solid fine particle of the dye, 90 g of the aforementioned dispersion of the solid fine particles (a) of the base precursor, 12 mL of a 3% by weight aqueous solution of sodium polystyrenesulfonate, and 180 g of a 10% by weight solution of SBR latex were admixed. Just prior to the coating, 80 mL of a 4% by weight aqueous solution of N,N-ethylenebis(vinylsulfone acetamide) was admixed to give a coating solution for the antihalation layer.

(Preparation of Coating Solution for Back Surface Protective Layer)

A vessel was kept at 40° C., and thereto were added 40 g of gelatin, 35 mg of benzoisothiazolinone and 840 ml of water to allow gelatin to be dissolved. Additionally, 5.8 ml of a 1 mol/L aqueous sodium hydroxide solution, liquid paraffin emulsion at 1.5 g equivalent to liquid paraffin, 10 mL of a 5% by weight aqueous solution of di(2-ethylhexyl) sodium sulfosuccinate, 20 mL of a 3% by weight aqueous solution of sodium polystyrenesulfonate, 2.4 mL of a 2% by weight solution of a fluorochemical surfactant (F-1), 2.4 mL of a 2% by weight solution of a fluorocarbon surfactant (F-2), and 32 g of a 19% by weight solution of methyl methacrylate/styrene/butyl acrylate/hydroxyethyl methacrylate/acrylic acid copolymer (copolymer weight ratio of 57/8/28/5/2) latex were admixed. Just prior to the coating, 25 mL of a 4% by weight aqueous solution of N,N-ethylenebis (vinylsulfone acetamide) was admixed to give a coating solution for the back surface protective layer.

2) Coating of Back Layer

The back surface side of the undercoated support as described above was subjected to simultaneous double coating so that the coating solution for the antihalation layer gives the coating amount of gelatin of 0.52 g/m$^2$, and so that the coating solution for the back surface protective layer gives the coating amount of gelatin of 1.7 g/m$^2$, followed by drying to produce a back layer.

3. Image Forming Layer, Intermediate Layer, and Surface Protective Layer

1) Preparation of Materials for Coating (Silver Halide Emulsion)

<<Preparation of Silver Halide Emulsion 1>>

To 1421 mL of distilled water was added 3.1 mL of a 1% by weight potassium bromide solution. Further, a liquid added with 3.5 mL of sulfuric acid having the concentration of 0.5 mol/L and 31.7 g of phthalated gelatin was kept at 30° C. while stirring in a stainless steel reaction pot, and thereto were added total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding total amount of the solution C at a constant flow rate over 20 minutes, accompanied by adding the solution D while maintaining the pAg at 8.1. Hexachloroiridium (III) potassium salt was added to give $1\times10^{-4}$ mol per one mol of silver at 10 minutes post initiation of the addition of the solution C and the solution D in its entirety. Moreover, at 5 seconds after completing the addition of the solution C, a potassium iron (II) hexacyanide aqueous solution was added at a total amount of $3\times10^{-4}$ mol per one mol of silver. The mixture was adjusted to the pH of 3.8 with sulfuric acid at the concentration of 0.5 mol/L. After stopping stirring, the mixture was subjected to precipitation/desalting/water washing steps. The mixture was adjusted to the pH of 5.9 with sodium hydroxide at the concentration of one mol/L to produce a silver halide dispersion having the pAg of 8.0.

The silver halide dispersion was kept at 38° C. with stirring, and thereto was added 5 mL of a 0.34% by weight methanol solution of 1,2-benzoisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per one mol of silver. At additional 5 minutes later, a tellurium sensitizer C in a methanol solution was added at $2.9\times10^{-4}$ mol per one mol of silver and subjected to aging for 91 minutes. Thereafter, a methanol solution of a spectral sensitizer A and a spectral sensitizer B with a molar ratio of 3:1 was added thereto at $1.2\times10^{-3}$ mol in total of the spectral sensitizer A and B per one mol of silver. At one minute later, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per one mol of silver, 1-phenyl-2-heptyl-5-mercapto-1,3,4-triazole in a methanol solution at $5.4\times10^{-3}$ mol per one mol of silver, and 1-(3-methylureidophenyl)-5-mercaptotetrazole in an aqueous solution at $8.5\times10^{-3}$ mol per one mol of silver were added to produce a silver halide emulsion 1.

Particles in thus prepared silver halide emulsion were silver iodide bromide particles having a mean sphere equivalent diameter of 0.042 μm, a variation coefficient of 20%, which uniformly include iodine at 3.5 mol %. Particle size and the like were determined from the average of 1000 particles using an electron microscope. The [100] face ratio of this particle was found to be 80% using a Kubelka-Munk method.

<<Preparation of Silver Halide Emulsion 2>>

Preparation of silver halide emulsion 2 was conducted in a similar manner to the process in the preparation of the silver halide emulsion 1 except that: the temperature of the liquid upon the nucleation process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30minutes; and potassium iron (II) hexacyanide was deleted. The precipitation/desalting/water washing/dispersion were carried out similarly to the silver halide emulsion 1. Furthermore, the spectral sensitization, chemical sensitization, and addition of 5-methyl-2-mercaptobenzimidazole and 1-phenyl-2-heptyl-5-mercapto-1,3,4-triazole was executed similarly to the emulsion 1 except that: the amount of the tellurium sensitizer C to be added was changed to $1.1\times10^{-4}$ mol per one mol of silver; the amount of the methanol solution of the spectral sensitizer A and a spectral sensitizer B with a molar ratio of 3:1 to be added was changed to $7.0\times10^{-4}$ mol in total of the spectral sensitizer A and the spectral sensitizer B per one mol of silver; the addition of 1-phenyl-2-heptyl-5-mercapto-1,3,4-triazole was changed to give $3.3\times10^{-3}$ mol per one mol of silver; and the addition of 1-(3-methylureidophenyl)-5-mercaptotetrazole was changed to give $4.7\times10^{-3}$ mol per one mol of silver to produce a silver halide emulsion 2. The emulsion particles in the silver halide emulsion 2 were pure cubic silver bromide particles having a mean sphere equivalent diameter of 0.080 μm and a variation coefficient of 20%.

<<Preparation of Silver Halide Emulsion 3>>

Preparation of a silver halide emulsion 3 was conducted in a similar manner to the process in the preparation of the silver halide emulsion 1 except that the temperature of the liquid upon the nucleation process was altered from 30° C. to 27° C. In addition, the precipitation/desalting/water washing/dispersion were carried out similarly to the silver halide emulsion 1. Silver halide emulsion 3 was obtained similarly to the emulsion 1 except that: the addition of the methanol solution of the spectral sensitizer A and the spectral sensitizer B was changed to the solid dispersion (aqueous gelatin solution) at a molar ratio of 1:1 with the amount to be added being $6.0\times10^{-3}$ mol in total of the spectral sensitizer A and spectral sensitizer B per one mol of silver; the amount of the tellurium sensitizer C to be added was changed to $5.2\times10^{-4}$ mol per one mol of silver; and bromoauric acid at $5\times10^{-4}$ mol per one mol of silver and potassium thiocyanate at $2\times10^{-3}$ mol per one mol of silver were added at 3 minutes following the addition of the tellurium sensitizer. The particles in the silver halide emulsion 3 were silver iodide bromide particles having a mean sphere equivalent diameter of 0.034 μm and a variation coefficient of 20%, which uniformly include iodine at 3.5 mol %.

<<Preparation of Mixed Emulsion A for Coating Solution>>

The silver halide emulsion 1 at 70% by weight, the silver halide emulsion 2 at 15% by weight and the silver halide emulsion 3 at 15% by weight were dissolved, and thereto was added benzothiazolium iodide at $7\times10^{-3}$ mol per one mol of silver with a 1% by weight aqueous solution. Further, water was added thereto to give the content of silver of 38.2 g per one kg of the mixed emulsion for a coating solution, and 1-(3-methylureidophenyl)-5-mercaptotetrazole was added to give 0.34 g per 1 kg of the mixed emulsion for a coating solution.

(Preparation of Dispersion of Silver Salt of Fatty Acid)

<<Preparation of Dispersion of Silver Salt of Fatty Acid G>>

Behenic acid, arachidic acid, stearic acid and lignoceric acid, each purified as in Example 1, were mixed to give 65, 20, 10 and 5 mol %, respectively. 87.6 kg of the mixed fatty acid, 423 L of distilled water, 49.2 L of an aqueous NaOH solution at the concentration of 5 mol/L, 120 L of t-butyl alcohol were admixed, and subjected to a reaction with stirring at 75° C. for one hour to give a solution A of a sodium salt of fatty acids. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution A of a sodium salt of fatty acids and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution A of a sodium salt of fatty acids was thereafter started, and during 14 minutes and 15 seconds following the completion of adding the aqueous silver nitrate solution, the added material was restricted to the solution A of a sodium salt of fatty acids alone. The temperature inside of the reaction vessel was then set to be 30° C., and the temperature outside was controlled so that the liquid temperature could be kept constant. In addition, the temperature of a pipeline for the addition system of the solution A of a sodium salt of fatty acids was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution A of a sodium salt of fatty acids was added and the position at which the aqueous silver nitrate solution was added were arranged symmetrically with a shaft for stirring located at a center. Moreover, both of the positions were adjusted to avoid contact with the reaction liquid.

After completing the addition of the solution A of a sodium salt of fatty acids, the mixture was left to stand at the temperature as it is for 20 minutes. The temperature of the mixture was then elevated to 35° C. over 30 minutes followed by aging for 210 minutes. Immediately after completing the aging, solid matters were filtered out with centrifugal filtration. The solid matters were washed with water until the electric conductivity of the filtrated water became 30 μS/cm. A silver salt of the fatty acids was thus obtained. The resulting solid matters were stored as a wet cake without drying.

When the shape of the resulting particles of the silver salt of the fatty acids was evaluated by an electron micrography, a flake crystal was revealed having a=0.14 μm, b=0.4 μm and c=0.6 μm on the average value, with a mean aspect ratio of 5.2, a mean sphere equivalent diameter of 0.52 μm and a variation coefficient of 15% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1260 kg/cm$^2$ to give a dispersion of the silver salt of the fatty acids. For the cooling manipulation, coiled heat exchangers were equipped fore and aft of the interaction chamber respectively, and accordingly, the temperature for the dispersion was set to be 18° C. by regulating the temperature of the cooling medium.

(Preparation of Reducing Agent Dispersion)

<<Preparation of Reducing Agent 1 Dispersion>>

To 10 kg of a reducing agent 1 (2,2'-methylenebis-(4-ethyl-6-tert-butylphenol)) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was subjected to thermal treatment at 60° C. for 5 hours to obtain a reducing agent −1 dispersion. Particles of the reducing agent included in thus resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<<Preparation of Reducing Agent 2 Dispersion>>

To 10 kg of a reducing agent 2 (6,6'-di-t-butyl-4,4'-dimethyl-2,2'-butylidenediphenol)) and 16 kg of a 10% by weight aqueous solution of modified polyvinyl alcohol (manufactured by Kuraray Co., Ltd., Poval MP203) was added 10 kg of water, and thoroughly mixed to give slurry.

This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent thermal treatment at 80° C. for one hour to obtain a reducing agent 2 dispersion. Particles of the reducing agent included in thus resulting reducing agent 2 dispersion had a median diameter of 0.50 μm, and a maximum particle diameter of 1.6 μm or less. The resultant reducing agent 2 dispersion was subjected to filtration with a polypropylene filter having a pore size of 3.0 μm to remove foreign substances such as dust, and stored.

(Preparation of Hydrogen Bonding Compound Dispersion)

To 10 kg of a hydrogen bonding compound 1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 4 hours. Thereafter, 0.2 g of a benzoisothiazolinone sodium salt and water were added thereto, thereby adjusting the concentration of the hydrogen bonding compound to be 25% by weight. This dispersion was warmed at 40° C. for one hour, followed by a subsequent thermal treatment at 80° C. for one hour to obtain a hydrogen bonding compound dispersion. Particles of the hydrogen bonding compound included in thus resulting hydrogen bonding compound 1-dispersion had a median diameter of 0.45 μm, and a maximum particle diameter of 1.3 μm or less. The resultant hydrogen bonding compound −1 dispersion was subjected to filtration with a polypropylene filter having a pore size of 3.0 μm to remove foreign substances such as dust, and stored.

(Preparation of Development Accelerator 1 Dispersion)

To 10 kg of a development accelerator 1 and 20 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minuets. Thereafter, 0.2 g of a benzoisothiazolinone sodium salt and water were added thereto, thereby adjusting the concentration of the development accelerating agent to be 20% by weight. Accordingly, a development accelerator 1 dispersion was obtained. Particles of the development accelerator included in thus resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

Also concerning solid dispersions of a development accelerator 2 and a color adjusting agent 1, dispersion was executed in a similar manner to the development accelerator 1, and thus dispersions of 20% by weight and 15% by weight were respectively obtained.

(Preparation of Polyhalogen Compound)

<<Preparation of Organic Polyhalogen Compound 1 Dispersion>>

An organic polyhalogen compound 1 (tribromomethane sulfonylbenzene) in an amount of 10 kg, 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 26% by weight. Accordingly, an organic polyhalogen compound −1 dispersion was obtained. Particles of the organic polyhalogen compound included in thus resulting polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound 2 Dispersion>>

An organic polyhalogen compound 2 (N-butyl-3-tribromomethane sulfonylbenzoamide) in an amount of 10 kg, 20 kg of a 10% by weight aqueous solution of modified polyvinyl alcohol (manufactured by Kuraray Co., Ltd., Poval MP203) and 0.4 kg of a 20% by weight aqueous solution of sodium triisopropylnaphthalenesulfonate were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain an organic polyhalogen compound 2 dispersion. Particles of the organic polyhalogen compound included in thus resulting polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

(Preparation of Phthalazine Compound 1 Solution)

Modified polyvinyl alcohol MP203 manufactured by Kuraray Co., Ltd., in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of a phthalazine compound 1 (6-isopropyl phthalazine) to prepare a 5% by weight solution of the phthalazine compound 1.

(Preparation of Mercapto Compound)

<<Preparation of an Aqueous Solution of Mercapto Compound 1>>

A mercapto compound 1 (1-(3-sulfophenyl)-5-mercaptotetrazole sodium salt) in an amount of 7 g was dissolved in 993 g of water to give a 0.7% by weight aqueous solution.

<<Preparation of an Aqueous Solution of Mercapto Compound 2>>

A mercapto compound 2 (1-(3-methylureidophenyl)-5-mercaptotetrazole) in an amount of 20 g was dissolved in 980 g of water to give a 2.0% by weight aqueous solution.

(Preparation of Pigment 1 Dispersion)

C.I. Pigment Blue 60 in an amount of 64 g and 6.4 g of DEMOL N manufactured by Kao Corporation were added to 250 g water and thoroughly mixed to give slurry. Zirconia beads having the mean particle diameter of 0.5 mm were provided in an amount of 800 g, and charged in a vessel with the slurry. Dispersion was performed with a dispersing machine (1/4G sand grinder mill: manufactured by IMEX Co., Ltd.) for 25 hours. Thereto was added water to adjust so that the concentration of the pigment became 5% by weight to obtain a pigment −1 dispersion. Particles of the pigment included in thus resulting pigment dispersion had a mean particle diameter of 0.21 μm.

(Preparation of SBR Latex Solution)

SBR latex was prepared as described below.

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO.,LTD.): solid matter content of 48.5% by weight), 14.06 mL of 1 mol/liter NaOH, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereinto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/liter NaOH and $NH_4OH$ to give the molar ration of $Na^+$ ion: $NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had the mean particle diameter of 90 nm, Tg of 17° C., solid matter concentration of 44% by weight, the equilibrium moisture content at 25° C., 60% RH of 0.6% by weight, ionic conductance of 4.80 mS/cm (measurement of the ionic conductance performed using a conductivity meter CM-30S manufactured by Toa Electronics Ltd. for the latex stock solution (44% by weight) at 25° C.).

2) Preparation of Coating Solution (Preparation of Coating Solution for Image Forming Layer 12)

The dispersion G of the silver salt of fatty acid obtained as described above in an amount of 1000 g, 135 mL of water, 36 g of the pigment 1 dispersion, 25 g of the organic polyhalogen compound 1 dispersion, 39 g of the organic polyhalogen compound 2 dispersion, 171 g of the phthalazine compound 1 solution, 1060 g of the SBR latex (Tg: 17° C.) solution, 153 g of the reducing agent 2 dispersion, 55 g of the hydrogen bonding compound 1 dispersion, 4.8 g of the development accelerator 1 dispersion, 5.2 g of the development accelerator 2 dispersion, 2.1 g of the color adjusting agent 1 dispersion, and 8 mL of the mercapto compound 2 aqueous solution were serially added. The coating solution for the image forming layer prepared by adding 140 g of the silver halide mixed emulsion A thereto followed by thorough mixing just prior to the coating was fed directly to a coating die, and was coated.

Viscosity of the coating solution for the image forming layer was measured with a B type viscometer from Tokyo Keiki, and was revealed to be 40 [mPa·s] at 40° C. (No. 1 rotor, 60 rpm).

Viscosity of the coating solution at 38° C. when it was measured using RheoStress RS150 manufactured by Haake was 30, 43, 41, 28, and 20 [mPa·s], respectively, at the shearing rate of 0.1, 1, 10, 100, 1000 [1/second]. The amount of zirconium in the coating solution was 0.32 mg per one g of silver.

(Preparation of Coating Solution for Intermediate Layer)

To 1000 g of polyvinyl alcohol PVA-205 (manufactured by Kuraray Co., Ltd.), 163 g of the pigment 1 dispersion, 33 g of an aqueous solution of a blue dye 1 (manufactured by Nippon Kayaku Co., Ltd.: Kayafect turquoise RN liquid 150), 27 mL of a 5% by weight aqueous solution of di(2-ethylhexyl) sodium sulfosuccinate and 4200 mL of a 19% by weight solution of methyl methacrylate/styrene/butyl acrylate/hydroxyethyl methacrylate/acrylic acid copolymer (weight ratio of the copolymerization of 57/8/28/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with NaOH to give the pH of 7.5. Accordingly, the coating solution for the intermediate layer was prepared, and was fed to a coating die to provide 8.9 mL/$m^2$.

Viscosity of the coating solution was 58 [mPa·s] which was measured with a B type viscometer at 40° C. (No. 1 rotor, 60 rpm).

(Preparation of Coating Solution for First Layer of Surface Protective Layers)

In 840 mL of water were dissolved 100 g of inert gelatin and 10 mg of benzoisothiazolinone, and thereto were added 180 g of a 19% by weight solution of methyl methacrylate/styrene/butyl acrylate/hydroxyethyl methacrylate/acrylic acid copolymer (weight ratio of the copolymerization of 57/8/28/5/2) latex, 46 mL of a 15% by weight methanol solution of phthalic acid and 5.4 mL of a 5% by weight aqueous solution of di(2-ethylhexyl) sodium sulfosuccinate, and were mixed. Immediately before coating, 40 mL of a 4% by weight chrome alum which had been mixed with a static mixer was fed to a coating die so that the amount of the coating solution became 26.1 ml/$m^2$.

Viscosity of the coating solution was 20 [mPa·s] which was measured with a B type viscometer at 40° C. (No. 1 rotor, 60 rpm).

(Preparation of Coating Solution for Second Layer of Surface Protective Layers)

In 800 mL of water were dissolved 100 g of inert gelatin and 10 mg of benzoisothiazolinone, and thereto were added 180 g of a 19% by weight solution of methyl methacrylate/styrene/butyl acrylate/hydroxyethyl methacrylate/acrylic acid copolymer (weight ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of a fluorocarbon surfactant (F-2), 28 mL of a 5% by weight aqueous solution of di(2-ethylhexyl) sodium sulfosuccinate, 4 g of polymethyl methacrylate fine particles (mean particle diameter of 0.7 μm) and 21 g of polymethyl methacrylate fine particles (mean particle diameter of 4.5 μm), and were mixed to give a coating solution for the surface protective layer, which was fed to a coating die so that 8.3 ml/m$^2$ could be provided.

Viscosity of the coating solution was 19 [mPa·s] which was measured with a B type viscometer at 40° C. (No. 1 rotor, 60 rpm).

3) Coating of Photothermographic Material 12

Reverse surface of the back surface was subjected to simultaneous overlaying coating by a slide bead coating method in order of the image forming layer, intermediate layer, first layer of the surface protective layer and second layer of the surface protective layer starting from the undercoated face, and thus a sample of the photothermographic material was produced. In this method, the temperature of the coating solution was adjusted to 31° C. for the image forming layer and intermediate layer, to 36° C. for the first layer of the surface protective layer, and to 37° C. for the second layer of the surface protective layer.

The coating amount of each compound for the image forming layer (g/m$^2$) is as follows.

| | |
|---|---|
| Silver salt of fatty acid | 5.27 |
| Pigment (C. I. Pigment Blue 60) | 0.036 |
| Polyhalogen compound 1 | 0.14 |
| Polyhalogen compound 2 | 0.28 |
| Phthalazine compound 1 | 0.18 |
| SBR latex | 9.43 |
| Reducing agent −2 | 0.77 |
| Hydrogen bonding compound 1 | 0.28 |
| Development accelerator 1 | 0.019 |
| Development accelerator 2 | 0.016 |
| Color toner 1 | 0.006 |
| Mercapto compound 2 | 0.003 |
| Silver halide (on the basis of Ag content) | 0.13 |

Conditions for coating and drying are as follows.

Coating was performed at the speed of 160 m/min, with the clearance between the leading end of the coating die and the support being 0.10 to 0.30 mm, and with the pressure in the vacuum chamber set to be lower than atmospheric pressure by 196 to 882 Pa. The support was decharged by ionic wind prior to coating.

In the subsequent cooling zone, the coating solution was cooled by wind having the dry-bulb temperature of 10 to 20° C. Thereafter, conveyance with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH. Then, the film surface was heated to be 70° C. to 90° C. After heating, the film surface was cooled to 25° C.

Thus prepared photothermographic material had the matness of 550 seconds on the image forming layer side surface, and 130 seconds on the back surface as Beck's smoothness. In addition, measurement of the pH of the film surface on the image forming layer side surface gave the result of 6.0.

Chemical structures of the compounds used in Examples of the invention are shown below.

Spectral sensitizer A

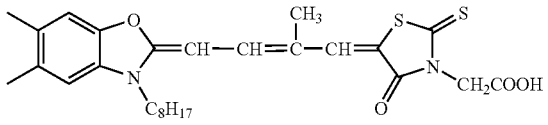

Spectral sensitizer B

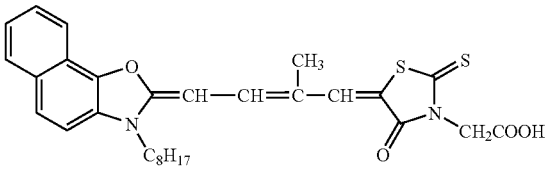

Tellulium sensitizer C

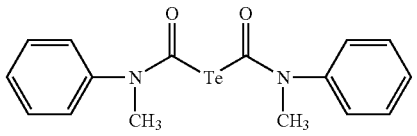

Base precursor 1

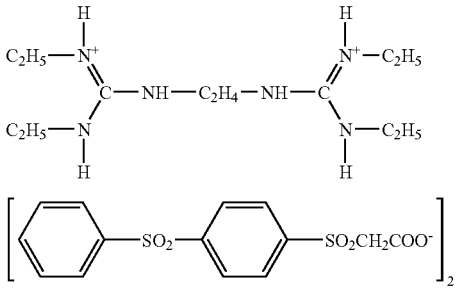

Cyanine compound 1

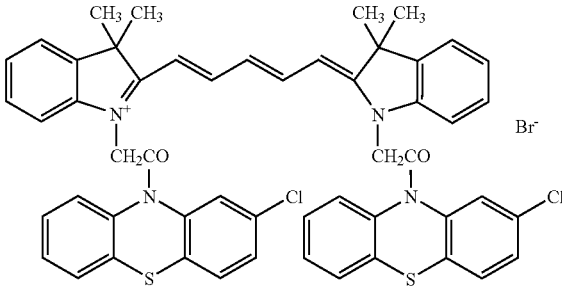

Blue dye 1

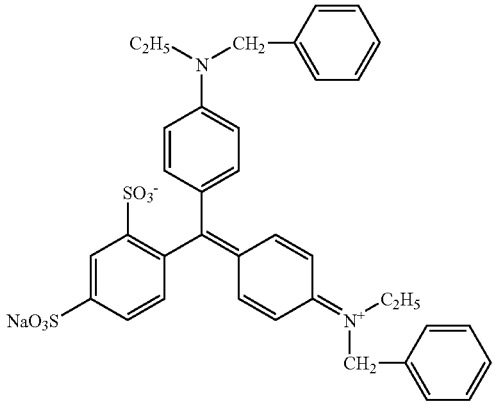

-continued

Phthalazine compound 1

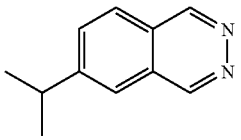

Development accelerator 1

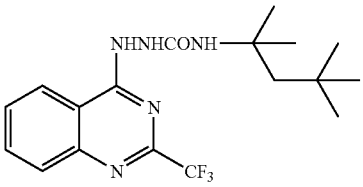

Development accelerator 2

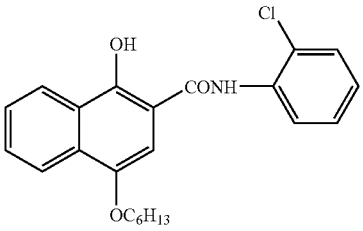

Color adjusting agent 1

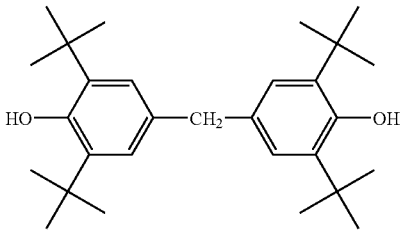

F-1 $CF_3—(CF_2)_n—CH_2CH_2SCH_2CH_2CO_2Li$
mixture of n=5~11

F-2 $CF_3—(CF_2)_n—CH_2CH_2O—(CH_2CH_2O)_m—H$
mixture of n=5~11 and m=5~15

8. Evaluation of Photographic Performances

1) Preparation and Packaging Material

Preparation and packaging materials employed were similar to those in Example 1.

2) Exposure and Development of Photothermographic Materials

<<Condition 1>>

Exposure and thermal development (18.8 seconds in total with 4 panel heaters set to be 105° C.-105° C.-121° C.-121° C.) were performed with Fuji Medical Dry Laser Imager FM-DP L (equipped with 660 nm semiconductor laser having the maximum output of 60 mW (IIIB)). Evaluation of thus resulting images was carried out with a densitometer. Line speed in this process was 21.3 mm/sec.

<<Condition 2>>

Exposure and thermal development (14 seconds in total with 3 panel heaters set to be 107° C.-121° C.-121° C.) were performed with a laser imager (equipped with 660 nm semiconductor laser having the maximum output of 50 mW (IIIB)) described in Japanese Patent Application No. 2002-088832 and Japanese Patent Application No. 2002-091114. Evaluation of thus resulting images was carried out with a densitometer. Line speed in this process was 28.6 mm/sec.

3) Results

Evaluation of photographic performance was carried out in a similar manner to Example 1. The results are shown in Table 6.

TABLE 6

| Photothermographic material | Behenic acid (mol %) | Difference in color tone between leading and posterior ends of the developed samples: Thermal development condition 1 | Thermal development condition 2 | Fog |
|---|---|---|---|---|
| 12 | 65 | A | A | 0.18 |

As shown in Table 6, output of stable images can be achieved with few differences found in color tone, even if a sample was prepared with a coating solution of which solvent is water.

Example 6

1. Preparation of PET Support 1-1. Film Manufacturing

PET having intrinsic viscosity, IV, of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, and melted at 300° C. Thereafter, the mixture was extruded from a T-die and rapidly cooled to form an unstretched film having such a thickness that the thickness should become 175 μm after stretching and thermal fixation.

The film was stretched along the longitudinal direction by 3.3 times using rollers with different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking parts of the tenter were slitted off, and the both edges of the film were knurled. Then the film was rolled up at the tension of 4 $kg/cm^2$ to obtain a roll having thickness of 175 μm.

1-2. Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 kV·A·minute/$m^2$ was executed on the support, judging from the readings of current and voltage on that occasion. The frequency of the treatment on that occasion was 9.6 kHz, and the gap clearance between the electrode and dielectric roll was 1.6 mm.

1-3. Undercoating

<Preparation of Coating Solution for Undercoat Layer>

Formula (1) (for undercoat layer on the image forming layer side)

| | |
|---|---|
| Pesresin A-520 manufactured by Takamatsu Oil & Fat Co., Ltd. (30% by weight solution) | 59 g |
| 10% by weight solution of polyethyleneglycol monononylphenylether (average ethylene oxide number = 8.5) | 5.4 g |

-continued

| | |
|---|---|
| MP-1000 manufactured by Soken Chemical & Engineering Co., Ltd. (polymer fine particle, mean particle diameter of 0.4 μm) | 0.91 g |
| Distilled water | 935 ml |

Formula (2) (for first layer on the back surface)

| | |
|---|---|
| Styrene-butadiene copolymer latex (solid content of 40% by weight, styrene/butadiene weight ratio = 68/32) | 158 g |
| 8% by weight aqueous solution of 2,4-dichloro-6-hydroxy-S-triazine sodium salt | 20 g |
| 1% by weight aqueous solution of sodium laurylbenzenesulfonate | 10 ml |
| Distilled water | 854 ml |

Formula (3) (for second layer on the back surface)

| | |
|---|---|
| $SnO_2$/SbO (9/1 weight ratio, mean particle diameter of 0.038 μm, 17% by weight dispersion) | 84 g |
| gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 ml |
| NaOH (1% by weight) | 6 ml |
| Proxel (manufactured by Imperial Chemical Industries PLC) | 1 ml |
| Distilled water | 805 ml |

<Coating of Solution for Undercoat>

Both surfaces of the aforementioned biaxially stretched polyethylene terephthalate support having the thickness of 175 μm were subjected to the corona discharge treatment as described above. Thereafter, the aforementioned formula (1) of the coating solution for the undercoat was coated on one surface (image forming layer side) with a wire bar so that the amount of wet coating became 6.6 ml/m$^2$, and dried at 180° C. for 5 minutes. Then, the aforementioned formula (2) of the coating solution for the undercoat was coated on the reverse face (back surface) with a wire bar so that the amount of wet coating became 5.7 ml/m$^2$, and dried at 180° C. for 5 minutes. Furthermore, the aforementioned formula (3) of the coating solution for the undercoat was coated on the reverse face (back surface) with a wire bar so that the amount of wet coating became 7.7 ml/m$^2$, and dried at 180° C. for 6 minutes. Thus, the undercoated support was produced.

2. Back Layer

Similarly to Example 5, a coating solution for the anti-halation layer and a coating solution for the back surface protective layer were prepared, and were coated to the back surface side.

3. Image Forming Layer, Intermediate Layer, and Surface Protective Layer 3-1. Preparation of Materials for Coating 1) Preparation of Mixed Emulsion A for Coating Solution The solution was prepared similarly to Example 5.

Preparation of Dispersion of Silver Salt of Fatty Acid

<<Preparation of Dispersion 1 of Silver Salt of Fatty Acid >>

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. Thus resulting crystal was subjected to centrifugal filtration, and washing was conducted with 100 kg of isopropyl alcohol. Thereafter, the crystal was dried. Thus resulting crystal was esterified, and subjected to GC-FID analysis to give the results of the content of behenic acid being 96 mol %, and in addition thereto, lignoceric acid at 2 mol %, arachidic acid at 2 mol %, and erucic acid at 0.001 mol % were included.

<Dispersion 1 of Silver Salt of Fatty Acid >

Recrystallized Behenic acid in an amount of 88 kg, 422 L of distilled water, 49.2 L of an aqueous NaOH solution at the concentration of 5 mol/L, 120 L of t-butyl alcohol were admixed, and subjected to a reaction with stirring at 75° C. for one hour to give a sodium behenate solution B. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at a temperature of 30° C., and thereto were added the total amount of the sodium behenate solution B and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the sodium behenate solution B was thereafter started, and during 14 minutes and 15 seconds following the completion of adding the aqueous silver nitrate solution, the added material was restricted to the sodium behenate solution B alone. The temperature inside of the reaction vessel was then set to be 30° C., and the temperature outside was controlled so that the liquid temperature could be kept constant. In addition, the temperature of a pipeline for the addition system of the sodium behenate solution B was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the sodium behenate solution B was added and the position at which the aqueous silver nitrate solution was added were arranged symmetrically with a shaft for stirring located at a center. Moreover, both positions were adjusted to avoid contact with the reaction liquid.

After completing the addition of the sodium behenate solution B, the mixture was left to stand at the temperature as it is for 20 minutes. The temperature of the mixture was then elevated to 35° C. over 30 minutes followed by aging for 210 minutes. Immediately after completing the aging, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting silver behenate particles was evaluated by an electron micrography, a crystal was revealed having a=0.21 μm, b=0.4 μm and c=0.4 μm on the average value, with a mean aspect ratio of 2.1, and a coefficient of variation of the sphere equivalent diameter of 11% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a silver behenate dispersion. For the cooling manipulation, coiled heat exchangers were equipped fore and aft of the interaction chamber respectively, and accordingly, the temperature for the dispersion was set to be 18° C. by regulating the temperature of the cooling medium.

<<Preparation of Dispersion 2 to 4 of Silver Salt of Fatty Acid>>

Silver salt dispersions 2 to 4 were prepared substantially similarly to the preparation of the silver salt dispersion 1 except that use of the recrystallized behenic acid was altered to blend the fatty acids (behenic acid, stearic acid, lignoceric acid and arachidic acid) to give the constitution shown in Table 7.

TABLE 7

| | Fatty acid constitution (mol %) | | | |
|---|---|---|---|---|
| Silver salt dispersion | behenic acid | lignoceric acid | arachidic acid | stearic acid |
| 1 | 96% | 2% | 2% | 0% |
| 2 | 75% | 2% | 15% | 8% |
| 3 | 40% | 1% | 35% | 25% |
| 4 | 15% | 0% | 50% | 35% |

3) Preparation of Dispersion of Thermal Solvent

To 10 kg of a thermal solvent (stearic amide (melting point of 100° C.)) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 4 hours and 30 minutes. Thereafter, 0.2 g of a benzoisothiazolinone sodium salt and water were added thereto, thereby adjusting the concentration of the thermal solvent to be 22% by weight to obtain a thermal solvent dispersion. Time period for dispersion was regulated so that the median diameter became 0.45 μm. Accordingly, particles of the thermal solvent included in thus resulting hot melt agent dispersion had a median diameter of 0.45 μm, and a maximum particle diameter of 1.4 μm or less. The resultant hot melt agent dispersion was subjected to filtration with a polypropylene filter having a pore size of 3.0 μm to remove foreign substances such as dust.

3-2. Preparation of Coating Solution

1) Preparation of Coating Solutions for Image Forming Layer 21 to 24

Any one of the silver salt dispersions 1 to 4 obtained as described above in an amount of 1000 g, 135 mL of water, 36 g of the pigment 1 dispersion, 25 g of the polyhalogen compound 1 dispersion, 39 g of the polyhalogen compound 2 dispersion, 171 g of the phthalazine compound 1 solution, 1060 g of the SBR latex (Tg: 17° C.) solution, 153 g of the reducing agent 2 dispersion, 55 g of the hydrogen bonding compound 1 dispersion, 4.8 g of the development accelerator 1 dispersion, 5.2 g of the development accelerator 2 dispersion, 2.1 g of the color toner 1 dispersion, 8 mL of the mercapto compound 2 aqueous solution, and 76 g of the hot melt agent dispersion were serially added. The coating solution for the image forming layer prepared by adding 140 g of the silver halide mixed emulsion A thereto followed by thorough mixing just prior to the coating was fed directly to a coating die, and was coated.

Any one of the pigment 1 dispersion, the polyhalogen compound 1, the polyhalogen compound 2, the phthalazine compound 1 solution, the SBR latex (Tg: 17° C.) solution, the reducing agent 2 dispersion, the hydrogen bonding compound 1 dispersion, the development accelerator 1 dispersion, the development accelerator 2 dispersion, the color toner 1 dispersion, and the mercapto compound 2 aqueous solution used in the aforementioned preparation is identical to the one used in Example 5.

2) Coating Solution for Intermediate Layer

The solution having the identical composition to that in Example 5 was employed.

3) Coating Solution for First Layer of Surface Protective Layers and Coating Solution for Second Layer of Surface Protective Layers The solutions having the identical composition to those in Example 5 were employed.

3-3. Preparation of Photothermographic Materials 101 to 104

Similarly to Example 5, reverse surface of the back surface was subjected to simultaneous overlaying coating by a slide bead coating method in order of the image forming layer, intermediate layer, first layer of the surface protective layer and second layer of the surface protective layer to produce photothermographic materials 101 to 104.

The coating amount of each compound for the image forming layer (g/m$^2$) is as follows.

| | |
|---|---|
| Silver salt of fatty acid | 5.27 |
| Thermal solvent | 0.35 |
| Pigment (C. I. Pigment Blue 60) | 0.036 |
| Polyhalogen compound 1 | 0.14 |
| Polyhalogen compound 2 | 0.28 |
| Phthalazine compound 1 | 0.18 |
| SBR latex | 9.43 |
| Reducing agent 1 | 0.77 |
| Hydrogen bonding compound 1 | 0.28 |
| Development accelerator 1 | 0.019 |
| Development accelerator 2 | 0.016 |
| Color toner 1 | 0.006 |
| Mercapto compound 1 | 0.003 |
| Silver halide (on the basis of Ag content) | 0.13 |

Thus prepared photothermographic materials had the matness of 550 seconds on the image forming layer side surface, and 130 seconds on the back surface as Beck's smoothness. In addition, measurement of the pH of the film surface on the image forming layer side surface gave the result of 6.0.

4. Evaluation of Photographic Performances 4-1. Preparation and Packaging Material Preparation and packaging materials employed were similar to those in Example 1.

Exposure and Thermal Development

In a laser imager (equipped with 660 nm semiconductor laser having the maximum output of 50 mw (IIIB)) described in Japanese Patent Application Nos. 2002-088832 and 2002-091114, panel heaters were set to be 107° C.-121° C.-121° C., and the tarnsporting speed was set so that the time period of heating became 14 seconds.

The power of the developing apparatus had been disconnected and left to stand still at 25° C. for 16 hours. Thereafter, the power was turned on, and the time period until the leading end of the photothermographic material reached to the thermal development region (start-up time, abbreviated as "start-up") was controlled to be as shown in Table 8 to perform the development. The development was performed after the exposure by heating for 14 seconds in total with 3 panel heaters set to be 107° C.-121° C.-121° C.

4-3. Results

1) Evaluation of Image Density

Exposure was performed so that the density became 3.0 for the half-cut size (43 cm in length×35 cm in width). Then, five photothermographic materials for each samples were successively subjected to a developing treatment without changing the light exposure condition. Density at the central point (a position of 21.5 cm×17.5 cm) thereof was measured with a densitometer. Density difference between the lowest value and the highest value among the values from five photosensitive materials was determined as ΔD. Smaller ΔD means that a more stable image is provided, which is preferred.

2) Evaluation of Fog

Evaluation on the unexposed part of the photothermographic materials were carried out with Macbeth TD904 densitometer (visible density). Results of the measurement were evaluated for the minimal density, Dmin (fog). Although Dmin in the first output sheet is shown in Table 2, alteration of Dmin of the successive output for all of the samples was not found.

3) Measurement of Hue Angle

Similarly to Example 3, hue angle was measured as described below.

Hue angle, hab, which was defined according to JIS Z 8729, at a optical density D of 1.2 was determined. Hue angle, hab, was calculated on:

$$hab=\tan-1\ (b^*/a^*)$$

using chromaticity coordinates a* and b* of the L*a*b* chromatic system defined according to JIS Z 8729, from the XYZ chromatic system or tristimulus values X, Y, Z or X10, Y10, Z10 defined according to JIS Z 8701.

For the measurement, Spectro Scan Transmission measuring equipment manufactured by Macbeth Co. was used. The measurement was performed with a light source of FL5 and the measuring area of 5 mmϕ.

Values for the samples exhibited the smallest hue angle and for the sample exhibited the largest hue angle among the 5 photosensitive materials are shown in Table 8.

TABLE 8

| Photothermographic material | Content of silver behenate (mol %) | Start-up time (min) | Fog (Dmin) | Density difference ΔD | Hue angle |
|---|---|---|---|---|---|
| 101 | 99% | 10 | 0.18 | 0.45 | 172° to 201° |
| 102 | 75% | 10 | 0.18 | 0.08 | 195° to 201° |
| 103 | 40% | 10 | 0.18 | 0.06 | 198° to 201° |
| 104 | 15% | 10 | 0.21 | 0.06 | 198° to 201° |
| 101 | 99% | 15 | 0.18 | 0.26 | 181° to 203° |
| 102 | 75% | 15 | 0.18 | 0.06 | 196° to 202° |
| 103 | 40% | 15 | 0.18 | 0.04 | 199° to 202° |
| 104 | 15% | 15 | 0.22 | 0.04 | 199° to 202° |

As shown in Table 8, output of stable images can be achieved with few differences in density for the photothermographic materials 102 and 103 having the content of silver behenate of 30 mol % or greater and 85 mol % or less, even if a start-up time was 10 minutes.

In addition, as for the photothermographic material 104 having the content of silver behenate of 15 mol %, the density difference was almost the same level as other samples. However, fog was so increased, that this sample was not preferable as a photothermographic material.

Furthermore, in instances of the hue angle being 180°<hab<270°, density difference was small, and uniform density of the image was achieved, exhibiting favorable results.

Example 7

<<Preparation Of Iridium-Doped Core-Shell Type Silver Iodobromide Emulsion>>

In 1500 mL of deionized water were dissolved 71.4 mg of KBr and 30 g of phthalized gelatin kept at a temperature of 34° C., followed by adjusting the pH to 5.0 with 3 mol/L nitric acid to prepare first solution. To the first solution were simultaneously added a solution of 27.4 g of KBr and 3.3 g of KI dissolved in 275 mL of deionized water, and a solution of 42.5 g of silver nitrate dissolved in 364 mL of deionized water in 9.5 minutes. Then, thereto were simultaneously mixed a solution of 179 g of KBr and 10 mg of potassium secondary hexachloroiridiumate dissolved in 812 mL of deionized water, and a solution of 127 g of silver nitrate dissolved in 1090 g of deionized water in 28.5 minutes. The value of pAg was kept constant using pAg feedback control loop described in Research disclosure No. 17643, U.S. Pat. Nos. 3,415,650; 3,782,954; and 3,821,002.

Thus resulting emulsion was subjected to water washing and desalting. Mean particle diameter (area weighted mean) was 0.045 μm. Particle diameter of silver halide was determined by a transmission electron microscopy (TEM).

<<Preparation of Organic Silver Salt Dispersion containing Iridium-doped and Previously Formed Silver Halide>>

In 13 liter of water were dissolved 118 g of Humko fatty acid 9718 (Witco Co., Memphis, Term.) and 570 g of Humko fatty acid 9022 (Witco Co., Memphis, Term.) at 80° C., followed by mixing for 15 minutes. Then, thereto was added a solution of 89.18 g of NaOH dissolved in 1.5 liter of water at 80° C. followed by mixing for 5 minutes to form a dispersion of sodium salt of the fatty acids. A solution of 19 mL of concentrated nitric acid diluted with 50 mL of water was added to this dispersion at 80° C., and then the dispersion was cooled to 55° C. and stirred for 25 minutes. Thereafter, 0.10 mL of the silver halide emulsion which had been iridium doped and previously formed at 700 g/mol in 1.25 liter of water at 42° C. was added to the dispersion at 55° C. and mixed for 5 minutes. Further, thereto was added a solution of 3365 g of silver nitrate dissolved in 2.5 liter of water at 55° C. followed by mixing at 10 minutes. Thus resulting organic silver salt dispersion containing silver halide was subjected to desalting, water washing and concentration by the centrifugal filtration until the electric conductivity of the wash water became 2 μS/cm. Thereafter, drying was conducted with a warm air at 45° C. for 72 hours.

The organic silver salt dispersion containing silver halide in an amount of 209 g as prepared above was stirred and mixed in 780 g of methyl ethyl ketone (MEK) and 11 g of polyvinyl butyral (Monsant Co., Butvar B-79) for 10 minutes, and allowed to stand overnight at 7° C. In addition, the dispersion was homogenized twice at processing pressure of 6000 psi to prepare a silver soap dispersion.

<<Preparation of Coating Solution for Image Forming Layer>>

The silver soap dispersion in an amount of 507 g was stirred at 13° C. for 15 minutes, and thereto was added 3.9 mL of a 10% by weight methanol solution of pyridinium hydrobromide perbromide (PHP). After stirring for 2 hours, 5.2 mL of a 72% by weight methanol solution of calcium bromide was added thereto. After continuing to stir for 30 minutes, 117 g of Butvar B-79 was added thereto. After stirring for additional 30 minutes, 27.3 g of 1,1-bis(2-hydroxy-3,5-dimethylphenyl)-2-methylpropane was added thereto, and the dispersion was further stirred for 15 minutes. Thereafter, 2.73 g of 2-(tribromomethylsulfonyl)quinoline was added thereto, and additional stirring for 15 minutes was conducted. This mixture was added to a solution of 1.39 g of Desmodur N3300 (Mobay, aliphatic isocyanate) dissolved in 12.3 g of MEK, and further stirred for 15 minutes followed by heating at 21° C. for 15 minutes.

To 100 g of this dispersion were added 1 mg of Comparative spectral sensitizer or the sensitizer of the invention (described in Table 9), 2.2 g of 4-chlorobenzophenone-2-carboxylic acid, 0.47 g of 2-chlorobenzoic acid and 0.47 g of 5-methyl-2-mercaptobenzimidazole, and the mixture was stirred at 21° C. for 1 hour. Then, thereto were added 0.368 g of phthalazine, 0.123 g of tetrachlorophthalic acid, and 2 g of a comparative dye or the dye of the invention (described in Table 9) to obtain a coating solution for the image forming layer.

<<Preparation of Coating Solution for Surface Protective Layer>>

In 512 g of MEK were mixed 61 g of methanol, 48 g of cellulose acetate butyrate (Eastman Chemical, CAB171-15S), 2.08 g of 4-methylphthalic acid, 3.3 g of a 16% by weight MEK solution of a fluorocarbon surfactant C, 5 g of a 15% by weight MEK solution of the compound represented by the general formula (F) of the invention, 1.9 g of polymethyl methacrylic acid (Rohm and Haas, Acryloid A-21), 0.5 g of 1,3-di(vinylsulfonyl)-2-propanol at room temperature to prepare a coating solution for the surface protective layer.

<<Coating of Undercoat Layer on Back Surface>>

Coating solution for the lower undercoat layer and the upper undercoat layer on the back surface having the formula described below was sequentially coated on a bluish polyethylene terephthalate support having the thickness of 176 μm, and dried at 180° C. for 4 hours, respectively.

1) Lower undercoat layer

| | |
|---|---|
| Julimer ET-410 (manufactured by Nihon Junyaku Co., Ltd.) | 95 mg/m$^2$ |
| $SnO_2$/Sb (weight ratio of 9/1, needle shaped particle, manufactured by Ishihara Sangyo Kaisha, Ltd., trade name of FS-10D) | 100 mg/m$^2$ |
| Crosslinking agent (Denacol EX-614B, manufactured by Nagase Chemicals Ltd.) | 17 mg/m$^2$ |

2) Upper undercoat layer

| | |
|---|---|
| Latex binder (CHEMIPEARL S-120, manufactured by Mitsui Petrochemical Industries, Ltd.) | 1070 mg/m$^2$ |
| Colloidal silica (Snowtex C, manufactured by NISSAN CHEMICA INDUSTRIES, LTD) | 40 mg/m$^2$ |
| Crosslinking agent (Denacol EX-614B, manufactured by Nagase Chemicals Ltd.) | 215 mg/m$^2$ |

<<Coating of Back Layer>>

To 786.7 g of a MEK solution of 12.6% by weight cellulose acetate butyrate (Eastman Chemical, CAB380-20) and 0.17% by weight polyester (Goodyear, Vitel TM PE-200) were added 0.9 g of dye C and 78.7 g of MEK. Then, thereto was added 78.7 g of a dispersion of silica matting agent having mean particle size of 8 μm and variation coefficient of 40% dispersed in MEK at 0.38% by weight. Furthermore, 15.7 g of an antistatic agent C and 3.93 g of MEK were added thereto followed by stirring to obtain a coating solution for the back surface.

Thus resulting coating solution for the back surface was coated and dried on the aforementioned undercoat layer to give the thickness of 7.6 μm. Transmission density (optical density) was 0.39 at the wavelength of 800 nm.

<<Preparation of Photothermographic Materials>>

Next, to the surface on the reverse side of the back side of the aforementioned PET support were simultaneously coated with the coating solution for the image forming layer and the coating solution for the surface protective layer with a dual knife coater. The coating solution for the image forming layer was coated on the support so that the coating amount of silver as described in Table 9 is provided. The coating solution for the surface protective layer was coated on the image forming layer with the wet thickness which provides the dry film thickness of 3.4 μm.

This coating device has dual knife coating blades which are laid side by side. After cutting the support to the size so that it meets with the volume of the solution used, knives equipped with a hinge were elevated to put them in a position on the coater floor. Then, the knives were brought down and fixed onto a predetermined position. The height of the knives was regulated using a wedge which was controlled by a screw knob and which was measured with an ammeter. Knife No. 1 was elevated up to a clearance corresponding to the thickness which was coordinated with total thickness of the substrate thickness and the desired wet thickness of the image forming layer (layer No. 1). Knife No. 2 was elevated up to the height equal to the desired thickness of: support thickness plus the wet thickness of the image forming layer (layer No. 1) plus desired thickness of the top coat layer (layer No. 2).

Thus resulting photothermographic material had Beck's smoothness of 180 seconds on the BC surface side and Beck's smoothness on the image forming layer surface side of 550 seconds.

Chemical structures of the compounds used in Example 7 are illustrated below.

Fluorocarbon polymer surfactant C

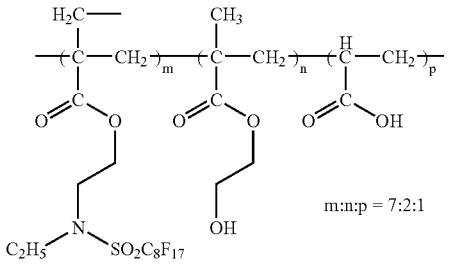

Anti-static agent C $C_8H_{17}-SO_3^-H_3^+N-(CH_2-CH_2-O)_{12}-CH_2-CH_2-NH_3^+C_8F_{17}-SO_3^-$ -continued Dye C

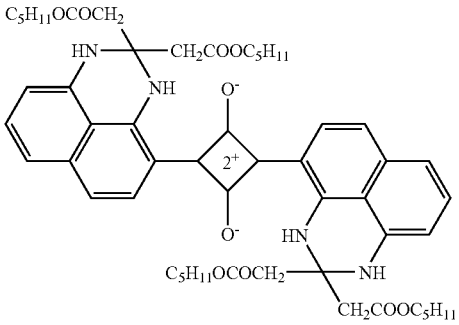

Comparative sensitizer

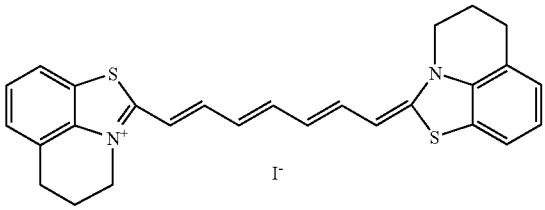

Comparative dye 1

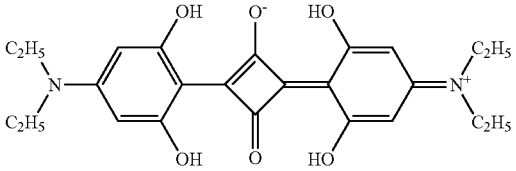

Comparative dye 2

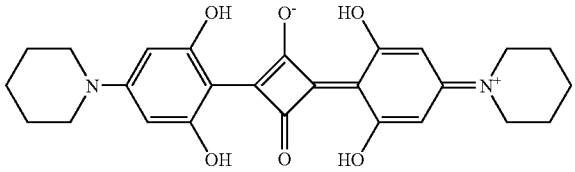

-continued

Comparative dye 3

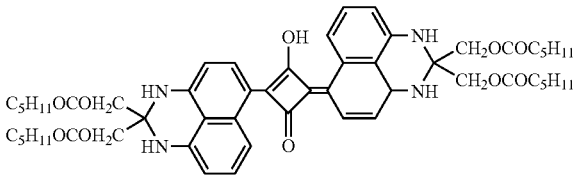

(Measurement of Sensitivity)

The photothermographic materials above obtained were cut into test pieces of 10 inches×8 inches (25.4 cm×20.3 cm), and they were exposed to light by a exposure machine having semiconductor laser, which was longitudinally multiple modulated at 800 nm through 820 nm with high frequency superposition, as a light source. The laser beam was irradiated at an incident angle with respect to the exposure surface of 75°. After the exposure, the film test piece was developed by heating at 124° C. for 10 seconds using an automatic developing apparatus having a heat drum so that the protective layer of the photothermographic material is brought into contact with the drum surface, with a transporting speed of the photothermographic material being 24 mm/sec to obtain an image. Next, thus resulting image was measured with a commercially available optical densitometer, and the sensitivity value was determined. The sensitivity was represented by a reciprocal of the exposure which gives higher density than the fog density by 1.0, and relative sensitivity of the sample 1 was assumed as 100, with the values for other samples also represented by the relative value. Higher numerical value corresponds to higher sensitivity.

(Evaluation of Image Stability)

The samples which were subjected to thermal development for the purpose of measuring sensitivity were stored in an environment of 30° C. and the relative humidity of 70% for 24 hours, under fluorescent lighting of 1000 Lux. Thereafter, measurement of the density of the image was carried out. The increased amount of the density of the non-imaging part (Dmin) with respect to the density immediately after the development was evaluated as a measure for the image stability.

Results of the evaluation are shown in Table 9.

As is clear from Table 9, the photothermographic material according to the invention exhibits favorable photographic performance even under the rapid treatment condition, i.e., 10 seconds, as in this Example, and is excellent in image stability after the treatment.

TABLE 9

| Sample No. | Coating amount of silver (g/m$^2$) | Dyes represented by the general formula (I) | Sentizer represented by the general formula (2a) to (2d) | Comound represented by the general formula (F) | Photographic performance Dmin | Photographic performance Sensitivity | Images stability (Increased amount of Dmin) |
|---|---|---|---|---|---|---|---|
| 201 | 2.3 | Comparative dye 1 | No.5 | F-15 | 0.15 | 100 | 0.17 |
| 202 | 1.8 | Comparative dye 1 | No.5 | F-15 | 0.13 | 100 | 0.10 |
| 203 | 1.4 | Comparative dye 1 | No.5 | F-15 | 0.11 | 98 | 0.08 |
| 204 | 2.3 | Comparative dye 2 | No.5 | F-15 | 0.15 | 102 | 0.18 |
| 205 | 1.8 | Comparative dye 2 | No.5 | F-15 | 0.14 | 100 | 0.11 |
| 206 | 1.4 | Comparative dye 2 | No.5 | F-15 | 0.11 | 98 | 0.08 |
| 207 | 2.3 | Comparative dye 3 | No.5 | F-15 | 0.16 | 100 | 0.16 |
| 208 | 1.8 | Comparative dye 3 | No.5 | F-15 | 0.12 | 99 | 0.10 |
| 209 | 1.4 | Comparative dye 3 | No.5 | F-15 | 0.10 | 98 | 0.09 |
| 210 | 2.3 | 1-1 | Compaarative pigment | F-15 | 0.13 | 95 | 0.15 |
| 211 | 1.8 | 1-1 | Compaarative pigment | F-15 | 0.10 | 97 | 0.10 |
| 212 | 1.4 | 1-1 | Compaarative pigment | F-15 | 0.09 | 93 | 0.08 |

TABLE 9-continued

| Sample No. | Coating amount of silver (g/m$^2$) | Dyes represented by the general formula (I) | Sentizer represented by the general formula (2a) to (2d) | Comound represented by the general formula (F) | Photographic performance Dmin | Photographic performance Sensitivity | Images stability (Increased amount of Dmin) |
|---|---|---|---|---|---|---|---|
| 213 | 2.3 | 1-1 | No.5 | F-15 | 0.10 | 102 | 0.13 |
| 214 | 1.8 | 1-1 | No.5 | F-15 | 0.09 | 100 | 0.07 |
| 215 | 1.4 | 1-1 | No.5 | F-15 | 0.08 | 100 | 0.05 |
| 216 | 2.3 | 1-1 | No.5 | — | 0.15 | 103 | 0.15 |
| 217 | 1.8 | 1-1 | No.5 | — | 0.11 | 102 | 0.11 |
| 218 | 1.4 | 1-1 | No.5 | — | 0.09 | 102 | 0.09 |
| 219 | 2.3 | 1-1 | No.5 | F-17 | 0.15 | 100 | 0.14 |
| 220 | 1.8 | 1-1 | No.5 | F-17 | 0.10 | 100 | 0.07 |
| 221 | 1.4 | 1-1 | No.5 | F-17 | 0.09 | 100 | 0.05 |
| 222 | 2.3 | 1-3 | | F-17 | 0.14 | 98 | 0.19 |
| 223 | 1.8 | 1-3 | | F-17 | 0.11 | 96 | 0.11 |
| 224 | 1.4 | 1-3 | | F-17 | 0.09 | 95 | 0.08 |
| 225 | 2.3 | 1-3 | No.20 | — | 0.16 | 103 | 0.17 |
| 226 | 1.8 | 1-3 | No.20 | — | 0.12 | 100 | 0.11 |
| 227 | 1.4 | 1-3 | No.20 | — | 0.08 | 100 | 0.07 |
| 228 | 2.3 | 1-3 | No.20 | F-3 | 0.14 | 100 | 0.15 |
| 229 | 1.8 | 1-3 | No.20 | F-3 | 0.08 | 100 | 0.08 |
| 230 | 1.4 | 1-3 | No.20 | F-3 | 0.07 | 98 | 0.05 |

Example 8

(Preparation of PET Support)

Both surfaces of a PET film having the thickness of 175 μm, which was blue-colored to the density of 0.16, were subjected to a corona discharge treatment at 8 w/m$^2$/min.

(Preparation of Photosensitive Silver Halide Emulsion)

In 900 mL of water were dissolved 7.5 g of ossein gelatin having the average molecular weight of 100000, and 10 mg of potassium bromide. After adjusting the temperature of 35° C. and the pH of 3.0, thereto were added 370 mL of an aqueous solution containing 74 g of silver nitrate, and 370 mL of an aqueous solution of potassium bromide and potassium iodide at a molar ratio of (98/2) and iridium chloride at $1\times10^{-4}$ mol per 1 mol of silver by a control double jet method over 10 minutes while keeping the pAg of 7.7. Thereafter, 0.3 g of 4-hydroxy-6-methyl-1,3,3a,7-tetrazaindene was added thereto, and the pH was adjusted to 5 with NaOH to obtain cubic silver iodobromide particles having a mean particle size (area weighted mean) of 0.06 μm, a variation coefficient of 12%, and the [100] face ratio of 87%. This emulsion was subjected to aggregation and precipitation of silver halide grains using a gelatin coagulating agent followed by a desalting treatment. Then, thereto was added 0.1 g of phenoxyethanol, followed by adjusting the pH of 5.9 and the pAg of 7.5 to obtain a photosensitive silver halide emulsion.

The temperature of the above photosensitive silver halide emulsion was elevated to 55° C., and thereto was added $5\times10^{-5}$ mol of compound A. Subsequently, $7\times10^{-5}$ mol of ammonium thiocyanate and $5.3\times10^{-5}$ mol of chloroauric acid were added. Moreover, silver iodide fine particles were added at 0.3 mol %. After subjecting to aging for 100 minutes, the mixture was cooled to 38° C. to complete the chemical sensitization. Accordingly, silver halide grains were obtained. In this procedure, the amount which was added is a value per one mol of AgX, wherein X is halide.

Compound A

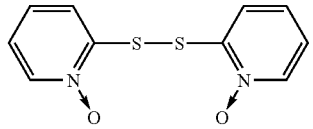

(Preparation of Powdery Organic Silver Salt)

To 4720 ml of purified water were added 111.4 g of behenic acid, 83.8 g of arachidic acid, and 54.9 g of stearic acid, and dissolved at 80° C. Next, thereto was added 540.2 mL of a 1.5 M aqueous sodium hydroxide solution while stirring at a high speed. After adding 6.9 mL of concentrated nitric acid, the mixture was cooled to 55° C. to obtain a solution of sodium salt of the organic acids. While keeping the temperature of the solution at 55° C., silver halide grains (containing 0.038 mol of silver) and 450 ml of purified water were added thereto followed by stirring for 5 minutes. Next, 760.6 mL of a 1 M silver nitrate solution was added thereto over 2 minutes, and the mixture was stirred for additional 20 minutes. Water soluble salts were eliminated by filtration. Thereafter, wasing with deionized water and filtration were repeated until the electric conductivity of the filtrated water became 2 μS/cm. After performing centrifugal dewatering, drying under a heated nitrogen gas stream was executed until weight loss did not take place to obtain the powdery organic silver salt.

(Preparation of Photosensitive Emulsion Dispersion)

Polyvinyl butyral powder (Monsanto Co., Butvar B-79) in an amount of 14.57 g was dissolved in 1457 g of methyl ethyl ketone, and thereto was gradually added 500 g of the aforementioned powdery organic silver salt while stirring with a dissolver type homogenizer, and sufficiently mixed. Thereafter, a dispersion was performed with a media type dispersing machine (manufactured by Gettzmann) packed with 80% by volume 1 mm Zr beads (manufactured by Toray) at a circumferential velocity of 13 m, and retention time of 0.5 minute in the mill to prepare a photosensitive emulsion dispersion.

(Preparation of Coating Solution for Image-Forming Layer)

Using 500 g of the aforementioned photosensitive emulsion dispersion, 100 g of methyl ethyl ketone (MEK) was added thereto while stirring under a nitrogen gas stream, and incubated at 24° C. The antifoggant 1 as described below (2.50 mL of a 10% methanol solution) was added thereto followed by stirring for one hour. Furthermore, calcium bromide (4 mL of a 10% methanol solution) was added, and stirred for 15 minutes.

Thereto was added 1.8 mL of a 1:5 mixed solution of the following dye adsorption promotor and potassium acetate (a 20% by weight ethanol solution of the dye adsorption promotor), followed by stirring for 15 minutes. Next, 7 mL of a mixed solution of a spectral sensitizer (described in Table 10) and 4-chloro-2-benzoylbenzoic acid, and supersensitizer (5-methyl-2-mercaptobenzimidazole), with a mixing ratio of 1:250:20 by weight (accounting for 0.1% by weight methanol solution of the spectral sensitizer) was added, followed by stirring for 1 hour. Thereafter, the temperature was lowered to 13° C., and the mixture was further stirred for 30 minutes. To this mixture was added 48 g of polyvinyl butyral while keeping the temperature at 13° C. After allowing for sufficient dissolution, the following additives were added. (All of these operations were performed under a nitrogen gas stream.)

| | |
|---|---|
| Phthalazine | 1.5 g |
| Tetrachlorophthalic acid | 0.5 g |
| 4-Methylphthalic acid | 0.5 g |
| Dye (described in Table 10) | 2.0 g |
| Developing agent (1,1-bis(2-hydroxy-3,5-dimethylphenyl)-2-methylpropane) | 15 g |
| Desmodur N3300 (Mobay, aliphatic isocyanate) | 1.10 g |
| Antifoggant 2 (2-(tribromomethylsulfonyl)-quinoline) | 1.55 g |
| Antifoggant 3 | 0.9 g |

Dye adsorbing promotor

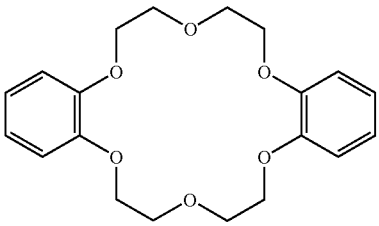

Antifoggant 1

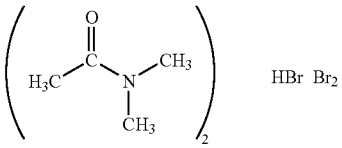

-continued

Antifoggant 3

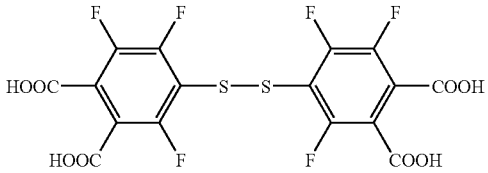

<Coating of Image Forming Layer>

The coating solution for the image forming layer having the above composition was coated on the support so that the coating amount of silver was provided as shown in Table 10 respectively, and that the coating amount of polyvinyl butyral as a binder became 8.5 g/m$^2$.

<Surface Protective Layer>

A solution having the following composition was coated on each image forming layer so that the wet thickness of 100 μm was provided.

| | |
|---|---|
| Acetone | 175 ml |
| 2-Propanol | 40 ml |
| Methanol | 15 ml |
| Cellulose acetate | 8 g |
| Phthalazinone (4.5% by weight DMF solution) | 8 ml |
| Phthalazine | 1.5 g |
| 4-Methylphthalic acid | 0.72 g |
| Tetrachlorophthalic acid | 0.22 g |
| Tetrachlorophthalic acid anhydride | 0.5 g |
| Monodispersed silica having mean particle diameter of 4 μm (variation coefficient of 20%) 1% by weight per binder | |
| Compound represented by the general formula (F) (described in Table 10) | 0.5 g |

<Coating of Back Layer>

Similarly to Example 7, the dye which is identical to the dye used in the coating solution for the image forming layer was used in the coating solution for the back surface, and coating was performed in a similar manner to Example 7. Thus resulting photosensitive material had Beck's second of 200 seconds on the BC surface side and Beck's second on the image forming layer side of 800 seconds.

Development was performed similarly to Example 7, and the measurement of sensitivity and image stability was performed. Results of the evaluation were shown in Table 10.

TABLE 10

| Sample No. | Coating amount of silver (g/m$^2$) | Dyes represented by the general formula (I) | Sentizer represented by the general formula (2a) to (2d) | Comound represented by the general formula (F) | Photographic performance Dmin | Photographic performance Sensitivity | Images stability (Increased amount of Dmin) |
|---|---|---|---|---|---|---|---|
| 231 | 2.3 | Comparative dye 1 | No24 | F-1 | 0.16 | 100 | 0.19 |
| 232 | 1.8 | Comparative dye 1 | No24 | F-1 | 0.14 | 1.2 | 0.12 |
| 233 | 1.4 | Comparative dye 1 | No24 | F-1 | 0.11 | 100 | 0.09 |

TABLE 10-continued

| Sample No. | Coating amount of silver (g/m$^2$) | Dyes represented by the general formula (I) | Sentizer represented by the general formula (2a) to (2d) | Comound represented by the general formula (F) | Photographic performance Dmin | Photographic performance Sensitivity | Images stability (Increased amount of Dmin) |
|---|---|---|---|---|---|---|---|
| 234 | 2.3 | Comparative dye 2 | No24 | F-1 | 0.16 | 1.1 | 0.18 |
| 235 | 1.8 | Comparative dye 2 | No24 | F-1 | 0.14 | 98 | 0.11 |
| 236 | 1.4 | Comparative dye 2 | No24 | F-1 | 0.12 | 98 | 0.09 |
| 237 | 2.3 | — | No24 | F-1 | 0.18 | 104 | 0.18 |
| 238 | 1.8 | — | No24 | F-1 | 0.14 | 100 | 0.12 |
| 239 | 1.4 | — | No24 | F-1 | 0.12 | 100 | 0.10 |
| 240 | 2.3 | 1-8 | Comparaative pigment | F-1 | 0.15 | 92 | 0.18 |
| 241 | 1.8 | 1-8 | Comparaative pigment | F-1 | 0.12 | 93 | 0.12 |
| 242 | 1.4 | 1-8 | Comparaative pigment | F-1 | 0.10 | 90 | 0.10 |
| 243 | 2.3 | 1-8 | No41 | — | 0.17 | 102 | 0.17 |
| 244 | 1.8 | 1-8 | No41 | — | 0.12 | 100 | 0.12 |
| 245 | 1.4 | 1-8 | No41 | — | 0.10 | 100 | 0.10 |
| 246 | 2.3 | 1-8 | No41 | F-1 | 0.10 | 102 | 0.12 |
| 247 | 1.8 | 1-8 | No41 | F-1 | 0.08 | 100 | 0.06 |
| 248 | 1.4 | 1-8 | No41 | F-1 | 0.07 | 100 | 0.05 |
| 249 | 2.3 | 1-8 | No41 | F-29 | 0.15 | 103 | 0.13 |
| 250 | 1.8 | 1-8 | No41 | F-29 | 0.09 | 101 | 0.07 |
| 251 | 1.4 | 1-8 | No41 | F-29 | 0.07 | 100 | 0.05 |
| 252 | 2.3 | 1-10 | Comparaative pigment | F-29 | 0.15 | 95 | 0.19 |
| 253 | 1.8 | 1-10 | Comparaative pigment | F-29 | 0.10 | 93 | 0.12 |
| 254 | 1.4 | 1-10 | Comparaative pigment | F-29 | 0.08 | 91 | 0.09 |
| 255 | 2.3 | 1-10 | No52 | — | 0.16 | 103 | 0.17 |
| 256 | 1.8 | 1-10 | No52 | — | 0.12 | 100 | 0.12 |
| 257 | 1.4 | 1-10 | No52 | — | 0.08 | 100 | 0.09 |
| 258 | 2.3 | 1-10 | No52 | F-25 | 0.13 | 102 | 0.14 |
| 259 | 1.8 | 1-10 | No52 | F-25 | 0.07 | 100 | 0.07 |
| 260 | 1.4 | 1-10 | No52 | F-25 | 0.06 | 100 | 0.05 |

As is clear from Table 10, the photothermographic material according to the invention exhibits favorable photographic performances even in the rapid processing, and is excellent in image stability after the treatment.

What is claimed is:

1. An image forming method comprising:

providing a sheet of a photothermographic material comprising, on at least one surface of a support, at least a photosensitive silver halide, a non-photosensitive organic silver salt, a reducing agent for silver ions and a binder, wherein the non-photosensitive organic silver salt containing 30 mol % to 85 mol % of silver behenate, and imagewise exposing and thermally developing continuously said sheet of the photothermographic material during transportation at a transportation speed of 23 mm/sec or faster using a thermal developing apparatus having an image exposing station and a developing station, wherein the imagewise exposing is started from a leading end of the sheet of the photothermographic material followed by thermal development which is started before completing the imagewise exposing up to a posterior end of the sheet of the photothermographic material;

wherein a hue angle (hab) of the image according to JIS Z 8729 at an optical density D of 1.2 is within the following range:

185°<hab<260°.

2. An image forming method according to claim 1, wherein the reducing agent is contained in amount of 0.1 mol % to 30 mol % per one mol of the non-photosensitive organic silver salt.

3. An image forming method according to claim 2, wherein the reducing agent is a bisphenolic reducing agent.

4. An image forming method according to claim 3, wherein the reducing agent is represented by the following general formula (R):

General formula (R)

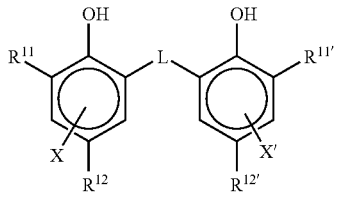

wherein $R^{11}$ and $R^{11'}$ each independently represent an alkyl group having 1 to 20 carbon atoms; $R^{12}$ and $R^{12'}$ each independently represent a hydrogen atom or a substituent capable of substituting for a hydrogen atom on a benzene ring; L represents a —S— group or a —$CHR^{13}$— group, $R^{13}$ represents a hydrogen atom or an alkyl group having 1 to 20 carbon atoms; and X and $X^1$ each independently represents a hydrogen atom or a group capable of substituting for a hydrogen atom on a benzene ring.

5. An image forming method according to claim 4, wherein $R^{11}$ and $R^{4'}$ in the above general formula (R) each independently represent a secondary or tertiary alkyl group having 3 to 15 carbon atoms.

6. An image forming method according to claim 1, wherein a coating amount of silver in the photothermographic material is 1.9 g/m$^2$ or less.

7. An image forming method according to claim 1, wherein the photothermographic material contains a development accelerator.

* * * * *